US009568173B2

(12) United States Patent
Waters

(10) Patent No.: US 9,568,173 B2
(45) Date of Patent: Feb. 14, 2017

(54) LIGHTED HAT

(71) Applicant: Michael Waters, Aspen, CO (US)

(72) Inventor: Michael Waters, Aspen, CO (US)

( * ) Notice: Subject to any disclaimer, the term of this patent is extended or adjusted under 35 U.S.C. 154(b) by 168 days.

(21) Appl. No.: 14/292,592

(22) Filed: May 30, 2014

(65) Prior Publication Data

US 2014/0268684 A1 Sep. 18, 2014

Related U.S. Application Data

(63) Continuation-in-part of application No. 14/212,820, filed on Mar. 14, 2014, and a continuation-in-part of application No. PCT/US2012/071480, filed on Dec. 21, 2012.

(60) Provisional application No. 61/798,971, filed on Mar. 15, 2013, provisional application No. 61/580,181, filed on Dec. 23, 2011.

(51) Int. Cl.

| | |
|---|---|
| ***F21V 21/084*** | (2006.01) |
| ***F21V 21/14*** | (2006.01) |
| ***A42B 1/24*** | (2006.01) |

(52) U.S. Cl.

CPC ..... *F21V 21/14* (2013.01); *A42B 1/244* (2013.01); *F21V 21/084* (2013.01)

(58) Field of Classification Search

CPC ..... A42B 1/244; F21V 21/12; F21V 21/084; F21V 33/0008; F21L 4/08

See application file for complete search history.

(56) References Cited

U.S. PATENT DOCUMENTS

| | | | |
|---|---|---|---|
| 645,984 | A | 3/1900 | Tournier |
| 909,742 | A | 1/1909 | Borchert |
| 1,098,628 | A | 6/1914 | Hyman |
| 1,109,415 | A | 9/1914 | Harris |
| 1,261,824 | A | 1/1918 | La Vine |
| 1,255,265 | A | 2/1918 | Zachara |
| 1,323,822 | A | 12/1919 | Bramming |
| D58,302 | S | 7/1921 | Bartholomew |
| 1,438,586 | A | 12/1922 | Eaton |
| 1,448,353 | A | 3/1923 | Barany |
| 1,475,653 | A | 11/1923 | Rosenberg |

(Continued)

FOREIGN PATENT DOCUMENTS

| | | |
|---|---|---|
| AU | 1178576 | 9/1977 |
| AU | 6310994 | 11/1994 |

(Continued)

OTHER PUBLICATIONS

'Initial Non-Infringement, Invalidity and Unenforceability, Contentions' with Exhibit A, Exhibits B-1 and B-2, and Exhibits C-1 through C7, *Waters Industries, Inc.* v. *Outdoor Cap Co., Inc.*, United States District Court for the Northern District of Illinois, Case No. 1:13-cv-07191, 263 pages (Dec. 18, 2013).

(Continued)

*Primary Examiner* — Peggy Neils

(74) *Attorney, Agent, or Firm* — Fitch, Even, Tabin & Flannery LLP

(57) ABSTRACT

Lighted headgear is described having a light assembly mounted thereto. The light assembly includes a power source, a switch device, and one or more light sources. The light sources are mounted to the headgear within a transparent or translucent light holder configured to orient the light sources to project light along desired axes.

10 Claims, 66 Drawing Sheets

(56) References Cited

U.S. PATENT DOCUMENTS

| | | | |
|---|---|---|---|
| 1,572,210 | A | 2/1926 | Kolibas |
| 1,615,067 | A | 1/1927 | Boerman |
| 1,744,777 | A | 1/1930 | Lundgren |
| 1,749,998 | A | 3/1930 | Collins |
| 1,879,512 | A | 9/1932 | Rotea |
| 1,883,756 | A | 10/1932 | Bloom |
| D114,980 | S | 1/1939 | Wengen |
| 2,196,543 | A | 4/1940 | Anderson |
| 2,373,553 | A | 10/1942 | Fetterman |
| D137,375 | S | 2/1944 | Heit |
| 2,369,829 | A | 2/1945 | Johnson |
| 2,461,254 | A | 2/1949 | Bassett |
| 2,473,394 | A | 6/1949 | Scott |
| 2,531,585 | A | 11/1950 | Pope |
| 2,540,435 | A | 2/1951 | Ferguson |
| 2,552,764 | A | 5/1951 | Bedford, Jr. |
| 2,567,046 | A | 9/1951 | Anderson |
| 2,591,112 | A | 4/1952 | Zwierzynski |
| 2,638,532 | A | 5/1953 | Brady |
| 2,640,980 | A | 6/1953 | Prupis |
| 2,705,751 | A | 4/1955 | Harris |
| 2,730,720 | A | 1/1956 | Saunders |
| 2,788,439 | A | 4/1957 | Hesse |
| 2,904,670 | A | 9/1959 | Calmes |
| 2,966,580 | A | 12/1960 | Taylor |
| 2,978,696 | A | 4/1961 | Keller |
| 3,008,040 | A | 11/1961 | Moore |
| 3,032,647 | A | 5/1962 | Wansky |
| 3,040,881 | A | 6/1962 | McNeill |
| 3,057,992 | A | 10/1962 | Baker |
| 3,060,308 | A | 10/1962 | Fortuna |
| 3,123,208 | A | 3/1964 | Barnum |
| 3,184,058 | A | 5/1965 | Crowther |
| 3,201,771 | A | 8/1965 | Proulx |
| D207,919 | S | 6/1967 | Fai |
| 3,350,552 | A | 10/1967 | Lawrence |
| 3,358,137 | A | 12/1967 | Sinclair |
| 3,447,164 | A | 6/1969 | Greenhouse |
| D215,751 | S | 10/1969 | Castelliano |
| 3,491,374 | A | 1/1970 | Frangos |
| 3,535,282 | A | 10/1970 | Mallory |
| 3,537,909 | A | 11/1970 | Horton |
| 3,602,759 | A | 8/1971 | Evans |
| 3,634,676 | A | 1/1972 | Castellano |
| 3,647,059 | A | 3/1972 | Humphreys |
| 3,666,901 | A | 5/1972 | Weinhart |
| 3,683,168 | A | 8/1972 | Tatje |
| 3,749,902 | A | 7/1973 | Drew |
| 3,769,663 | A | 11/1973 | Perl |
| D229,975 | S | 1/1974 | Klugmann |
| 3,793,517 | A | 2/1974 | Carlini |
| 3,845,389 | A | 10/1974 | Phillips |
| 3,947,676 | A | 3/1976 | Battilana |
| 3,963,917 | A | 6/1976 | Romano |
| 4,005,776 | A | 2/1977 | Seeley |
| 4,011,600 | A | 3/1977 | Malk |
| 4,053,688 | A | 10/1977 | Perkins |
| 4,092,704 | A | 5/1978 | Malm |
| 4,176,932 | A | 12/1979 | Young |
| 4,186,429 | A | 1/1980 | Johnston |
| 4,210,952 | A | 7/1980 | Ressmeyer |
| 4,231,079 | A | 10/1980 | Heminover |
| 4,254,451 | A | 3/1981 | Cochran |
| 4,268,894 | A | 5/1981 | Bartunek |
| 4,270,227 | A | 6/1981 | Wolfe |
| 4,283,127 | A | 8/1981 | Rosenwinkel |
| 4,298,913 | A | 11/1981 | Lozar |
| 4,317,162 | A | 2/1982 | Richards et al. |
| 4,332,007 | A | 5/1982 | Gibstein |
| 4,364,107 | A | 12/1982 | Wieczorek |
| 4,392,183 | A | 7/1983 | Ostlund |
| 4,398,237 | A | 8/1983 | Doyel |
| 4,406,040 | A | 9/1983 | Cannone |
| 4,425,531 | A | 1/1984 | Holmes |
| D272,733 | S | 2/1984 | Cosmos |
| 4,430,532 | A | 2/1984 | Matsumoto |
| 4,442,478 | A | 4/1984 | Stansbury |
| 4,462,064 | A | 7/1984 | Schweitzer |
| 4,470,263 | A | 9/1984 | Lehovec |
| 4,483,021 | A | 11/1984 | McCall |
| 4,516,157 | A | 5/1985 | Campbell |
| 4,521,831 | A | 6/1985 | Thayer |
| 4,541,698 | A | 9/1985 | Lerner |
| 4,551,857 | A | 11/1985 | Galvin |
| 4,559,516 | A | 12/1985 | Schott |
| 4,570,206 | A | 2/1986 | Deutsch |
| 4,602,191 | A | 7/1986 | Davila |
| 4,604,760 | A | 8/1986 | Coin |
| 4,616,297 | A | 10/1986 | Liu |
| 4,631,644 | A | 12/1986 | Dannhauer |
| 4,638,410 | A | 1/1987 | Barker |
| 4,641,647 | A | 2/1987 | Behan |
| 4,642,817 | A | 2/1987 | Ferstenfeld |
| 4,665,568 | A | 5/1987 | Stutes |
| 4,667,274 | A | 5/1987 | Daniel |
| 4,669,610 | A | 6/1987 | Lindsey |
| 4,680,815 | A | 7/1987 | Hirsch |
| 4,774,643 | A | 9/1988 | McGinnis |
| 4,794,496 | A | 12/1988 | Lanes |
| 4,817,212 | A | 4/1989 | Benoit |
| 4,822,160 | A | 4/1989 | Tsai |
| 4,822,161 | A | 4/1989 | Jimmy |
| 4,827,384 | A | 5/1989 | VonSchlemmer |
| 4,829,285 | A | 5/1989 | Brand |
| 4,872,218 | A | 10/1989 | Holt |
| 4,875,147 | A | 10/1989 | Auer |
| 4,884,067 | A | 11/1989 | Nordholm |
| 4,901,210 | A | 2/1990 | Hanabusa |
| 4,901,211 | A | 2/1990 | Shen |
| 4,902,119 | A | 2/1990 | Porsche |
| 4,904,078 | A | 2/1990 | Gorike |
| 4,920,466 | A | 4/1990 | Liu |
| 4,945,458 | A | 7/1990 | Batts |
| 4,951,068 | A | 8/1990 | Ichikawa |
| 4,959,760 | A | 9/1990 | Wu |
| 4,963,045 | A | 10/1990 | Willcox |
| 4,991,068 | A | 2/1991 | Mickey |
| 4,998,187 | A | 3/1991 | Herrick |
| 5,003,640 | A | 4/1991 | Pizzacar |
| D316,932 | S | 5/1991 | Escher, Jr. |
| 5,039,829 | A | 8/1991 | Brucksch |
| 5,060,814 | A | 10/1991 | Oglesbee |
| 5,068,771 | A | 11/1991 | Savage, Jr. |
| 5,070,436 | A | 12/1991 | Alexander |
| 5,088,127 | A | 2/1992 | Thornock |
| 5,111,366 | A | 5/1992 | Rife |
| 5,113,325 | A | 5/1992 | Eisenbraun |
| 5,117,510 | A | 6/1992 | Broussard |
| 5,122,943 | A | 6/1992 | Pugh |
| 5,138,538 | A | 8/1992 | Sperling |
| 5,140,116 | A | 8/1992 | Schmitt-Walter |
| 5,140,220 | A | 8/1992 | Hasegawa |
| 5,143,443 | A | 9/1992 | Madsen |
| 5,158,356 | A | 10/1992 | Guthrie |
| 5,163,420 | A | 11/1992 | VanDerBel |
| 5,164,749 | A | 11/1992 | Shelton |
| 5,165,789 | A | 11/1992 | Womack |
| 5,183,326 | A | 2/1993 | Case |
| 5,189,512 | A | 2/1993 | Cameron |
| 5,193,220 | A | 3/1993 | Ichinohe |
| 5,193,347 | A | 3/1993 | Apisdorf |
| 5,207,500 | A | 5/1993 | Rios |
| 5,218,385 | A | 6/1993 | Lii |
| 5,224,772 | A | 7/1993 | Fustos |
| 5,230,558 | A | 7/1993 | Jong |
| 5,238,344 | A | 8/1993 | Nagayama |
| 5,245,516 | A | 9/1993 | deHaas |
| 5,249,675 | A | 10/1993 | Strauss |
| D343,470 | S | 1/1994 | Yuen |
| 5,278,734 | A | 1/1994 | Ferber |
| D349,123 | S | 7/1994 | Cooley |
| 5,329,637 | A | 7/1994 | Walker |
| 5,331,333 | A | 7/1994 | Tagawa |
| 5,331,357 | A | 7/1994 | Cooley |

(56) References Cited

U.S. PATENT DOCUMENTS 5,353,205 A 10/1994 Hudak
5,357,409 A 10/1994 Glatt
5,363,291 A 11/1994 Steiner
5,367,345 A 11/1994 da Silva
5,404,593 A 4/1995 Kronenberger
5,408,393 A 4/1995 Becker
5,410,746 A 4/1995 Gelber
5,412,545 A 5/1995 Rising
5,418,565 A 5/1995 Smith
5,423,419 A 6/1995 Wentz
5,438,698 A 8/1995 Burton
5,452,190 A 9/1995 Priesemuth
5,460,346 A 10/1995 Hirsch
5,463,538 A 10/1995 Womack
5,467,992 A 11/1995 Harkness
5,485,358 A 1/1996 Chien
5,488,361 A 1/1996 Perry
5,503,637 A 4/1996 Kyricos
5,508,900 A 4/1996 Norman
5,510,961 A 4/1996 Peng
5,541,767 A 7/1996 Murphy
5,541,816 A 7/1996 Miserendino
5,542,627 A 8/1996 Crenshaw
5,546,099 A 8/1996 Quint
5,564,128 A 10/1996 Richardson
5,567,038 A 10/1996 Lary
D375,372 S 11/1996 Allen
5,575,554 A 11/1996 Guritz
5,601,358 A 2/1997 Chien
5,606,743 A 2/1997 Vogt
5,608,808 A 3/1997 da Silva
5,610,678 A 3/1997 Tsuboi
5,644,189 A 7/1997 Busby
5,655,374 A 8/1997 Santilli
D383,754 S 9/1997 Yuen
D383,863 S 9/1997 Yuen
5,667,291 A 9/1997 Caplan
5,667,292 A 9/1997 Sabalvaro, Jr.
5,676,449 A 10/1997 Newsome
5,677,079 A 10/1997 DeZorzi
5,680,718 A 10/1997 Ratcliffe
5,688,039 A 11/1997 Johnson
D388,113 S 12/1997 Feinbloom
5,692,244 A 12/1997 Johnson
5,708,449 A 1/1998 Heacock
5,709,464 A 1/1998 Tseng
5,718,335 A 2/1998 Boudreaux
5,722,762 A 3/1998 Soll
5,730,290 A 3/1998 Futo
5,741,060 A 4/1998 Johnson
5,743,621 A 4/1998 Mantha
5,758,947 A 6/1998 Glatt
5,774,338 A 6/1998 Wessling, III
5,786,665 A 7/1998 Ohtsuki
5,800,278 A 9/1998 Varriano
5,806,961 A 9/1998 Dalton
5,822,636 A 10/1998 Cho
5,829,063 A 11/1998 Cheng
5,829,860 A 11/1998 Lawther
5,836,673 A 11/1998 Lo
5,845,778 A 12/1998 Hickey, Jr.
5,845,987 A 12/1998 Painter
5,857,220 A 1/1999 Erny
5,865,333 A 2/1999 Wolfe
5,871,271 A 2/1999 Chien
D407,187 S 3/1999 Makki
5,876,241 A 3/1999 Frantz
5,893,631 A 4/1999 Padden
5,894,604 A 4/1999 Crabb
5,918,966 A 7/1999 Arnold
5,920,910 A 7/1999 Calvo
5,921,674 A 7/1999 Koczi
5,922,489 A 7/1999 Adachi
5,931,693 A 8/1999 Yamazaki
5,946,071 A 8/1999 Feldman
5,982,969 A 11/1999 Sugiyama
5,997,165 A 12/1999 Lehrer
6,005,536 A 12/1999 Beadles
6,007,212 A 12/1999 Chan
6,007,213 A 12/1999 Baumgartner
6,009,563 A 1/2000 Swanson
6,012,822 A 1/2000 Robinson
6,012,827 A 1/2000 Caplan
D420,035 S 2/2000 Hartman
D420,207 S 2/2000 Barton
6,021,525 A 2/2000 Mertins
6,023,788 A 2/2000 McCallum
6,028,627 A 2/2000 Helmsderfer
6,032,291 A 3/2000 Asenguah
6,032,293 A 3/2000 Makki
6,056,413 A 5/2000 Urso
D428,431 S 7/2000 Jordan
6,086,214 A 7/2000 Ridge
6,087,037 A 7/2000 Rieder
6,088,053 A 7/2000 Hammack
6,094,749 A 8/2000 Proctor
6,113,243 A 9/2000 Saul
6,113,244 A 9/2000 Baumgartner
6,116,745 A 9/2000 Yei
6,124,056 A 9/2000 Kimura
6,126,294 A 10/2000 Koyama
6,167,570 B1 1/2001 Su
6,168,286 B1 1/2001 Duffy
6,172,657 B1 1/2001 Kamakura
6,174,075 B1 1/2001 Fuwausa
6,176,601 B1 1/2001 Nester
6,206,543 B1 3/2001 Henry
6,236,007 B1 5/2001 Ho
6,237,147 B1 5/2001 Brockman
6,240,566 B1 6/2001 Scantlin
6,244,721 B1 6/2001 Rodriguez
6,250,769 B1 6/2001 Kirk
D445,928 S 7/2001 Sharrah
6,256,795 B1 7/2001 Habel
D446,324 S 8/2001 Lynch
6,290,368 B1 9/2001 Lehrer
6,299,323 B1 10/2001 Yu
6,302,570 B1 10/2001 Petell
6,306,538 B1 10/2001 Saitoh
6,307,526 B1 10/2001 Mann
6,311,350 B1 11/2001 Kaiserman
6,311,837 B1 11/2001 Blaustein
6,320,822 B1 11/2001 Okeya
6,325,521 B1 12/2001 Gregg
6,328,454 B1 12/2001 Davis
6,340,234 B1 1/2002 Brown, Jr.
6,345,716 B1 2/2002 Chapman
6,347,410 B1 2/2002 Lee
6,363,537 B1 4/2002 Park
6,366,344 B1 4/2002 Lach
6,367,949 B1 4/2002 Pederson
D457,670 S 5/2002 Allen
6,382,407 B1 5/2002 Chao
6,386,701 B1 5/2002 Khulusi
6,390,640 B1 5/2002 Wong
6,398,386 B1 6/2002 Huang
6,416,199 B1 7/2002 Heine
6,431,904 B1 8/2002 Berelsman
6,439,738 B1 8/2002 Matthews
6,442,764 B1 9/2002 Badillo
6,457,838 B1 10/2002 Dugmore
6,461,015 B1 10/2002 Welch
6,461,025 B1 10/2002 Payne
6,474,830 B1 11/2002 Hansen
6,476,391 B1 11/2002 Zhang
6,497,493 B1 12/2002 Theisen
D469,198 S 1/2003 Olson
6,504,099 B2 1/2003 Huang
6,523,973 B2 2/2003 Galli
6,530,672 B2 3/2003 Galli
6,538,567 B2 3/2003 Stewart
D473,890 S 4/2003 Waters
6,549,231 B1 4/2003 Matsui
6,553,570 B1 4/2003 Flynn

(56) References Cited

U.S. PATENT DOCUMENTS 6,554,444 B2 4/2003 Shimada
6,578,982 B1 6/2003 Lynch
D477,432 S 7/2003 Parsons
6,598,991 B2 7/2003 Altman
6,604,837 B2 8/2003 Sandberg
6,612,695 B2 9/2003 Waters
6,612,696 B2 9/2003 Waters
6,616,293 B2 9/2003 Mickey
6,634,031 B1 10/2003 Schlapkohl
6,642,667 B2 11/2003 Avis
D483,928 S 12/2003 Mansell
6,659,618 B2 12/2003 Waters
D484,905 S 1/2004 Waters
6,679,615 B2 1/2004 Spearing
6,704,044 B1 3/2004 Foster
6,709,142 B2 3/2004 Gyori
6,713,956 B2 3/2004 HsingChen
6,715,309 B1 4/2004 Junkins
6,719,437 B2 4/2004 Lary
6,721,962 B1 4/2004 Polaire
D489,165 S 5/2004 Waters
6,733,150 B1 5/2004 Hanley
6,749,166 B2 6/2004 Valentine
6,760,925 B1 7/2004 Maxwell
6,764,194 B1 7/2004 Cooper
6,802,636 B1 10/2004 Bailey, Jr.
6,808,284 B1 10/2004 Chao
6,811,441 B2 11/2004 Simpson
6,817,711 B2 11/2004 Schubert
6,830,357 B2 12/2004 Lopez
D501,266 S 1/2005 Harris
6,837,590 B2 1/2005 Marston
6,857,739 B1 2/2005 Watson
6,860,628 B2 3/2005 Robertson
6,863,416 B2 3/2005 Waters
6,865,285 B1 3/2005 Villa-Aleman
6,880,989 B2 4/2005 Sotome
6,908,208 B1 6/2005 Hyde
D507,368 S 7/2005 Waters
D507,369 S 7/2005 Waters
6,918,678 B2 7/2005 McClanahan
6,923,322 B2 8/2005 Lenker
6,929,375 B2 8/2005 Satomi
6,929,878 B2 8/2005 Chen
6,932,216 B2 8/2005 Blaustein
6,935,761 B2 8/2005 Vanderschuit
6,941,583 B2 9/2005 Yan
6,966,668 B2 11/2005 Cugini
6,969,178 B2 11/2005 Zuloff
6,977,776 B2 12/2005 Volkenandt
6,993,803 B2 2/2006 Chan
6,994,445 B1 2/2006 Pomes
6,997,552 B1 2/2006 Hung
7,000,841 B2 2/2006 Becker
7,003,353 B1 2/2006 Parkhouse
7,004,439 B1 2/2006 Taylor
7,004,582 B2 2/2006 Jannard
7,008,074 B1 3/2006 Halm
7,021,790 B2 4/2006 Parsons
D520,460 S 5/2006 Wadsworth
7,052,154 B2 5/2006 Vanderschuit
7,055,179 B2 6/2006 Warner
7,086,749 B1 8/2006 Hanley
7,094,981 B2 8/2006 Sorrentino
7,104,670 B2 9/2006 Waters
7,105,939 B2 9/2006 Bednyak
7,111,956 B2 9/2006 Brown
7,114,823 B2 10/2006 McCullough et al.
7,118,241 B2 10/2006 Sohn
7,118,262 B2 10/2006 Negley
7,128,434 B1 10/2006 Nally
7,147,324 B2 12/2006 Jannard
7,147,338 B2 12/2006 Gregg
7,150,526 B2 12/2006 Jannard
7,163,309 B2 1/2007 Sohn
7,182,478 B2 2/2007 Marston
7,186,159 B1 3/2007 Baxter
7,192,151 B2 3/2007 Clupper
7,209,652 B2 4/2007 Uenaka
7,213,917 B2 5/2007 Jannard
7,216,973 B2 5/2007 Jannard
7,226,180 B2 6/2007 Sung
7,234,831 B1 6/2007 Hanley
7,255,437 B2 8/2007 Howell
7,264,350 B2 9/2007 Jannard
D553,177 S 10/2007 Chen
7,278,734 B2 10/2007 Jannard
7,281,826 B2 10/2007 Huang
7,318,654 B2 1/2008 McClanahan
7,331,064 B1 2/2008 Quintal
D566,044 S 4/2008 DArco
D568,922 S 5/2008 Anderl
7,369,174 B2 5/2008 Olita
7,377,664 B2 5/2008 Waters
7,427,149 B2 9/2008 Sohn
7,431,472 B2 10/2008 Becker
7,438,409 B2 10/2008 Jordan
7,457,536 B2 11/2008 Hamada
7,461,764 B2 12/2008 Thompson
7,466,040 B2 12/2008 Bruwer
7,470,022 B2 12/2008 Lerner
7,506,992 B2 3/2009 Carter
D591,675 S 5/2009 Waters
7,562,979 B2 7/2009 Waters
7,576,800 B2 8/2009 Swain
D600,208 S 9/2009 Waters
D600,738 S 9/2009 Su
7,598,928 B1 10/2009 Buskop
7,607,775 B2 10/2009 Hermanson
7,609,295 B2 10/2009 Aridome
7,611,255 B1 11/2009 Lagassey
7,621,000 B1 11/2009 Fulton
D605,381 S 12/2009 Mastrantonio et al.
7,661,818 B2 2/2010 Waters
D611,086 S 3/2010 Meng-Suen
7,677,751 B2 3/2010 Kinsman
7,699,486 B1 4/2010 Beiner
D617,826 S 6/2010 Waters
7,753,547 B2 7/2010 Waters
7,755,219 B2 7/2010 Bruwer
7,784,960 B2 8/2010 Lahtinen
7,862,979 B2 1/2011 Waters
7,934,846 B1 5/2011 Schwanz
7,938,553 B1 5/2011 Beiner
7,942,543 B2 5/2011 Ritter
8,002,437 B2 8/2011 Sohn
8,075,153 B2 12/2011 Werner
8,141,395 B2 3/2012 Dillavou
8,157,403 B2 4/2012 Lau
D659,351 S 5/2012 Benkendorfer
8,333,485 B2 12/2012 Waters
8,364,220 B2 1/2013 Sandmore
8,388,164 B2 3/2013 Waters
8,491,145 B2 7/2013 Waters
8,550,651 B2 10/2013 Waters
8,698,027 B2 4/2014 Anderst
8,757,931 B2 6/2014 Püttmann
8,769,723 B1 7/2014 Ilges
8,774,420 B2 7/2014 Belafonte et al.
8,813,268 B1 8/2014 Fitzgerald et al.
8,919,984 B1 * 12/2014 Fitzgerald ..... A42B 1/244 362/105
8,950,012 B2 2/2015 Ilges et al.
9,057,500 B2 * 6/2015 Opolka ..... F21L 4/005
D734,925 S 7/2015 Waters
2001/0024365 A1 9/2001 Aknine
2002/0027777 A1 3/2002 Takasu
2002/0129989 A1 9/2002 Parsons
2002/0131275 A1 9/2002 Yamamoto
2002/0159250 A1 10/2002 Kuo
2002/0163800 A1 11/2002 Hansen
2002/0186557 A1 12/2002 Lary
2002/0187806 A1 12/2002 Jang
2003/0079387 A1 5/2003 Derose

(56) References Cited

U.S. PATENT DOCUMENTS

2003/0086053 A1 5/2003 Waters
2003/0086054 A1 5/2003 Waters
2003/0106918 A1 6/2003 Hung
2003/0122958 A1 7/2003 Olita
2003/0151910 A1 8/2003 Marston
2003/0169207 A1 9/2003 Beigel
2003/0189824 A1 10/2003 Meeder
2003/0206269 A1 11/2003 Waters
2003/0231489 A1 12/2003 Hsiao
2004/0001150 A1 1/2004 Schindler
2004/0008157 A1 1/2004 Brubaker
2004/0085745 A1 5/2004 Yoshihara
2004/0128737 A1 7/2004 Gesten
2004/0141312 A1 7/2004 Henning
2004/0141316 A1* 7/2004 Twardawski ..... B62J 6/02 362/184
2004/0165109 A1 8/2004 Lee
2004/0222638 A1 11/2004 Bednyak
2004/0240067 A1 12/2004 Marusi
2004/0240204 A1 12/2004 Russ
2004/0264176 A1 12/2004 Vanderschuit
2005/0001433 A1 1/2005 Seelin
2005/0035925 A1 2/2005 Ostromek
2005/0047116 A1 3/2005 Gagne
2005/0066422 A1 3/2005 Yan
2005/0072458 A1 4/2005 Goldstein
2005/0078473 A1 4/2005 Zuloff
2005/0083676 A1 4/2005 VanderSchuit
2005/0099799 A1 5/2005 Cugini
2005/0105285 A1 5/2005 Maden
2005/0161313 A1 7/2005 Sorrentino
2005/0174753 A1 8/2005 Cao
2005/0204490 A1 9/2005 Kemp
2005/0211187 A1 9/2005 Harman
2005/0211574 A1 9/2005 Reeve
2005/0213340 A1 9/2005 Suzuki
2005/0219837 A1 10/2005 Brown
2005/0237479 A1* 10/2005 Rose ..... A61N 5/0618 351/123
2005/0248932 A1 11/2005 Waters
2005/0254238 A1 11/2005 Parker
2005/0265015 A1 12/2005 Salazar
2006/0012974 A1 1/2006 Su
2006/0012975 A1 1/2006 Huttner
2006/0037125 A1 2/2006 McDowell
2006/0091784 A1 5/2006 Conner
2006/0092621 A1 5/2006 Lai
2006/0093264 A1 5/2006 Tabuchi
2006/0107952 A1 5/2006 Schlosser
2006/0125624 A1 6/2006 Ostrovsky
2006/0126323 A1 6/2006 Pomes
2006/0138440 A1 6/2006 Jyo
2006/0141828 A1 6/2006 Dean
2006/0157569 A1 7/2006 Becker
2006/0158895 A1 7/2006 Brands
2006/0165160 A1 7/2006 Winningstad
2006/0198122 A1 9/2006 Senter
2006/0212994 A1 9/2006 Proctor
2006/0215393 A1 9/2006 VanderSchuit
2006/0232955 A1 10/2006 Labine
2006/0238995 A1 10/2006 Wang
2006/0239018 A1 10/2006 Jardin
2006/0263677 A1 11/2006 Tsai
2006/0285315 A1 12/2006 Tufenkjian
2006/0286443 A1 12/2006 Huang
2006/0291193 A1 12/2006 Hill
2007/0003826 A1 1/2007 Hsu
2007/0013865 A1 1/2007 Joradn
2007/0030442 A1 2/2007 Howell
2007/0048598 A1 3/2007 Huang
2007/0053179 A1 3/2007 Pang
2007/0058361 A1 3/2007 Sevilla
2007/0064413 A1 3/2007 Slater
2007/0072655 A1 3/2007 Cascone
2007/0074752 A1 4/2007 Shau
2007/0086182 A1 4/2007 Kelly
2007/0097668 A1 5/2007 Choi
2007/0127250 A1 6/2007 Waters
2007/0140675 A1 6/2007 Yanagi
2007/0145746 A1 6/2007 Biamonte
2007/0153500 A1 7/2007 Waters
2007/0153537 A1 7/2007 Scott
2007/0159810 A1 7/2007 Kim
2007/0159823 A1 7/2007 Ho
2007/0171628 A1 7/2007 Seade
2007/0189003 A1 8/2007 Daley
2007/0206373 A1 9/2007 Whiteside
2007/0236649 A1 10/2007 Lin
2007/0236915 A1 10/2007 Chen
2007/0236916 A1 10/2007 Hsu
2008/0049963 A1 2/2008 Mann et al.
2008/0069391 A1 3/2008 Steyn
2008/0130272 A1 6/2008 Waters
2008/0152482 A1 6/2008 Patel
2008/0186705 A1 8/2008 Liu
2008/0263750 A1 10/2008 Chen
2008/0266839 A1 10/2008 Claypool
2009/0010474 A1 1/2009 Ouryouji
2009/0126076 A1 5/2009 Ochoa
2009/0147503 A1 6/2009 Bennett
2009/0148149 A1 6/2009 Chishima
2009/0193566 A1 8/2009 Waters
2009/0213323 A1 8/2009 Mermanson
2009/0268936 A1 10/2009 Goldberg et al.
2009/0323317 A1 12/2009 Spartano
2010/0024091 A1 2/2010 Mehtab
2010/0095431 A1 4/2010 Liao
2010/0134761 A1 6/2010 Johns
2010/0182563 A1 7/2010 Waters
2010/0214767 A1 8/2010 Waters
2010/0242155 A1 9/2010 Carullo
2010/0307931 A1 12/2010 Waters
2010/0313335 A1 12/2010 Waters
2011/0013135 A1 1/2011 Waters
2011/0075095 A1 3/2011 Waters
2011/0122601 A1 5/2011 Waters
2011/0187989 A1 8/2011 Waters
2011/0210685 A1 9/2011 Liao
2011/0211156 A1 9/2011 Waters
2011/0228211 A1 9/2011 Waters
2012/0014095 A2 1/2012 Waters
2012/0098465 A1 4/2012 Rothschild
2013/0025612 A1 1/2013 Hunter
2013/0111651 A1 5/2013 Waters
2013/0192961 A1 8/2013 Waters
2013/0198935 A1 8/2013 Waters
2014/0049947 A1 2/2014 Lombard
2014/0101827 A1 4/2014 Dennis
2014/0173807 A1 6/2014 Waters
2014/0237706 A1 8/2014 OConner
2014/0268683 A1 9/2014 Waters
2014/0270685 A1 9/2014 Letke
2015/0358515 A1 12/2015 Resnick

FOREIGN PATENT DOCUMENTS

AU 199940150 2/2000
AU 199959545 3/2000
AU 2002100976 6/2003
AU 2003100277 7/2003
AU 2003248016 11/2004
CA 2029772 5/1991
CA 2198625 2/1997
CA 2184336 5/1997
CA 2406450 11/2001
CA 2466175 A1 5/2003
CA 2608746 A1 11/2006
CA 2610073 A1 5/2008
CN 86208973 10/1987
CN 2173427 8/1994
CN 2239167 11/1996
CN 2423761 3/2001
CN 2433836 6/2001
CN 2458892 11/2001

(56) References Cited

FOREIGN PATENT DOCUMENTS

| | | | |
|---|---|---|---|
| CN | 2508592 | | 9/2002 |
| CN | 2544551 | | 4/2003 |
| CN | 1462597 | | 12/2003 |
| CN | 1603677 | A | 4/2005 |
| CN | 101950091 | A | 1/2011 |
| CN | 301445845 | S | 1/2011 |
| DE | 3043007 | | 6/1982 |
| DE | 8230583 | | 9/1983 |
| DE | 9410886 | | 9/1994 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 102007006860 | A1 | 8/2007 |
| EP | 1072204 | | 1/2001 |
| EP | 1374707 | | 1/2004 |
| EP | 2290433 | A1 | 3/2011 |
| EP | 2299311 | A1 | 3/2011 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2272073 | A | 5/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61006304 | | 1/1986 |
| JP | 4289602 | | 10/1992 |
| JP | H08027610 | A | 1/1996 |
| JP | H08298004 | A | 11/1996 |
| JP | H09209210 | A | 8/1997 |
| JP | H09296319 | A | 11/1997 |
| JP | H10081275 | A | 3/1998 |
| JP | H10331019 | A | 12/1998 |
| JP | 2001131818 | A | 5/2001 |
| JP | 3084061 | | 11/2001 |
| JP | 3090973 | | 10/2002 |
| JP | 2004207580 | | 7/2004 |
| JP | 2004346470 | | 12/2004 |
| JP | 2005216832 | A | 8/2005 |
| JP | 2006097156 | A | 4/2006 |
| JP | 2007119980 | | 5/2007 |
| JP | 2008542558 | | 11/2008 |
| KR | 200164075 | | 2/2000 |
| KR | 200168822 | Y1 | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |
| TW | 386364 | | 4/2000 |
| WO | 9402043 | | 2/1994 |
| WO | 9704434 | | 2/1997 |
| WO | 0113033 | A1 | 2/2001 |
| WO | 0177575 | A1 | 10/2001 |
| WO | 0244611 | | 6/2002 |
| WO | 02062165 | | 8/2002 |
| WO | 02074398 | | 9/2002 |
| WO | 02077520 | | 10/2002 |
| WO | 03040808 | A2 | 5/2003 |
| WO | 03047377 | | 6/2003 |
| WO | 03083811 | | 10/2003 |
| WO | 04000054 | | 12/2003 |
| WO | 2004064555 | | 5/2004 |
| WO | 2004103104 | | 12/2004 |
| WO | 2005002378 | | 1/2005 |
| WO | 2005005882 | | 1/2005 |
| WO | 2005038337 | | 4/2005 |
| WO | 2005096856 | | 10/2005 |
| WO | 2005098314 | | 10/2005 |
| WO | 2006037845 | | 4/2006 |
| WO | 2006124928 | | 11/2006 |
| WO | 2007073047 | | 6/2007 |
| WO | 2007073219 | | 6/2007 |
| WO | 2007089236 | | 8/2007 |
| WO | 2007093348 | | 8/2007 |
| WO | 2007112338 | | 10/2007 |
| WO | 2008011750 | | 1/2008 |
| WO | 2009079656 | A2 | 6/2009 |
| WO | 2010099504 | | 9/2010 |
| WO | 2011041591 | A1 | 4/2011 |
| WO | 2011100471 | A1 | 8/2011 |
| WO | 2011137400 | | 11/2011 |
| WO | 2011137406 | | 11/2011 |
| WO | 2013096895 | | 6/2013 |
| WO | 2013096904 | | 6/2013 |
| ZA | 20043826 | A | 9/2005 |

OTHER PUBLICATIONS

'Panther Vision Power Beanie—Available at Bunnings Warehouse,' screenshot of a video posted to Youtube on Jun. 16, 2014. Retrieved from the Internet on Mar. 9, 2015. URL: https://www.youtube.com/watch?v=ZOWodRoEuvc. (1 page).

'Waters Industries' Answer to Defendants Amended Counterclaims', *Waters Industries, Inc.* v. *Outdoor Cap Co., Inc.*, United States District Court for the Northern District of Illinois, Case No. 1:13-cv-07191, 12 pages (Document No. 38, Dec. 18, 2013).

"4 LED Lighted Fleece Beanie; POWERCAP," article posted online to Wise-Shop.ca. Added to the businesses catalog on Nov. 6, 2013. Retrieved from the Internet on Jun. 17, 2014. URL: http://www.wise-shop.ca/product_info.php?products_id=489.

"Answer to Complaint, Counterclaims", filed by *Sweet Baby, Inc. dba AJ Morgan, Waters Industries, Inc.* v. *Sweet Baby, Inc. dba Aj Morgan et al.*, United States District Court for the Northern District of Illinois, Case No. 1:09-cv-07595, 15 pages (Feb. 4, 2010).

"Complaint", *Waters Industries, Inc.* v. *Kikkerland Design, Inc.*, United States District Court for the Northern District of Illinois, Case No. 1:10-cv-04076, 21 pages (Jun. 30, 2010).

"Complaint", *Waters Industries, Inc.* v. *Mr. Christmas Incorporated, et al.*, United States District Court for the Northern District of Illinois, Case No. 1:09-cv-07577, 38 pages (Dec. 7, 2009).

"Complaint", *Waters Industries, Inc.* v. *Sweet Baby, Inc. dba AJ Morgan et al.*, United States District Court for the Northern District of Illinois, Case No. 1:09-cv-07595, 78 pages (Dec. 7, 2009).

"Complaint", *Waters Industries, Inc.* v. *The Gerson Company*, United States District Court for the Northern District of Illinois, Case No. 1:10-cv-01865,71 pages (Mar. 24, 2010).

(56) References Cited

OTHER PUBLICATIONS

"Complaint" with Exhibit A through D, *Waters Industries, Inc.* v. *JJI International, Inc., et al.*, United States District Court for the Northern District of Illinois, Case No. 1:11-cv-03791, 73 pages (Jun. 3, 2011).
"Defendants' Answer and Counterclaim" and "Responses to Specific Allegations", *Waters Industries, Inc.* v. *JJI International, Inc. and Stein Mart, Inc.*, United States District Court for the Northern District of Illinois, Case No. 1:11-cv-03791, 16 pages (Jun. 28, 2011).
"Defendants' Initial Non-Infringement and Invalidity Contentions" with Appendix A though G, *Waters Industries, Inc.* v. *JJI International, Inc. and Stein Mart, Inc.*, United States District Court for the Northern District of Illinois, Case No. 1:11-cv-03791, 78 pages (Aug. 9, 2011).
"Kikkerland Design, Inc.'s Answer to Complaint, Affirmative Defenses and Counterclaim", *Waters Industries, Inc.*v. *Kikkerland Design, Inc.*,United States District Court for the Northern District of Illinois, Case No. 1:10-cv-04076, 12 pages (Aug. 6, 2010).
"Panther Vision Powercap LED Lighted Beanie," article posted on-line and available for sale at Dick's Sporting Goods with reviews posted as early as Nov. 14, 2014. Retrieved from the Internet on Mar. 9, 2015. URL: http://www.dickssportinggoods.com/product/index.jsp?productId=52376526. (4 pages).
"Plaintiff's Initial Infringement Contentions Under Local Patent Rule 2.2" with Appendix A through F,*Waters Industries, Inc.* v. *JJI International, Inc. and Stein Mart, Inc.*, United States District Court for the Northern District of Illinois, Case No. 1:11-cv-03791, 44 pages (Jul. 26, 2011).
"Plaintiffs Initial Response to Invalidity Contentions Under Local Patent Rule 2.5" with Appendix A and B, *Waters Industries, Inc.* v. *JJI International, Inc. and Stein Mart, Inc.*, United States District Court for the Northern District of Illinois, Case No. 1:11-cv-03791, 29 pages (Aug. 23, 2011).
"Powercap Beanie," article posted on-line to Panther Vision. Publication date unknown. Retrieved from the Internet on Mar. 9, 2015. URL: http://www.panther-vision-promotional-products.com/Prod-18-1-96-10/powercap-trade-beanie.htm. (2 pages).
Docket report of *Waters Industries, Inc.* v. *Kikkerland Design, Inc.*, United States District Court for the Northern District of Illinois, Case No. 1:10-cv-04076, filed Jun. 30, 2010, 4 pages.
Docket report of *Waters Industries, Inc.* v. *Mr. Christmas Incorporated, et al.*, United States District Court for the Northern District of Illinois, Case No. 1:09-cv-07577, filed Dec. 7, 2009, 5 pages.
Docket report of *Waters Industries, Inc.* v. *Outdoor Cap Co., Inc.*, United States District Court for the Northern District of Oklahoma, Case No. 4:13-cv-00665-CVE-FHM, filed Oct. 8, 2013 (7 pages).
Docket report of *Waters Industries, Inc.* v. *Sweet Baby, Inc. dba AJ Morgan et al.*, United States District Court for the Northern District of Illinois, Case No. 1:09-cv-07595, filed Dec. 7, 2009, 7 pages.
Docket report of *Waters Industries, Inc.* v. *The Gerson Company*, United States District Court for the Northern District of Illinois, Case No. 1:10-cv-01865, filed Mar. 24, 2010, 3 pages.
Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).
Extended European search report issued in the related European Application No. 08 86 2753.4 dated Dec. 7, 2012 (7 pages).
Extended European search report issued in the related European Application No. 10 18 1592.6 dated Jan. 31, 2011 (7 pages).
Extended European search report issued in the related European Application No. 10 18 1593.4 dated Feb. 1, 2011 (8 pages).
International Search Report from the International Bureau of WIPO issued in the related International Application No. PCT/US02/35665, dated Jun. 27, 2003, 1 page.
Notification Concerning Transmittal of International Preliminary Report on Patentability and the Written Opinion of the International Searching Authority from the International Bureau of WIPO for International Application No. PCT/US2013/076689, dated Jul. 2, 2015, 7 pages.
Notification of Transmittal of the International Search Report and the Written Opinion of the International Searching Authority, or the Declaration from the International Bureau of WIPO for International Application No. PCT/US10/50978, dated Dec. 3, 2010, 16 pages.
Notification of Transmittal of the International Search Report and the Written Opinion of the International Searching Authority, or the Declaration from the International Bureau of WIPO for International Application No. PCT/US14/28613, 13 pages.
Notification of Transmittal of the International Search Report and the Written Opinion of the International Searching Authority, or the Declaration from the International Bureau of WIPO for International Application No. PCT/US2008/087542 dated May 4, 2009, 12 pages.
Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2011/024400, dated Apr. 29, 2011, 13 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for International Application No. PCT/US2011/051596, dated Jan. 18, 2012, 9 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.
Office Action issued in related Canadian Application No. 2,466,175 dated Sep. 22, 2010 (3 pages).
Office Action issued in related European Application No. 02 778 755.5 dated Feb. 20, 2007 (7 pages).
Office Action issued in related Japanese Application No. 2010-539834 dated Mar. 19, 2013 and English translation of the same (10 pages).
Patent Examination Report issued in related Australian Application No. 2008338320 dated Nov. 1, 2012 (5 pages).
Supplementary European search report issued in the related European Application No. 02 77 8755 dated Jan. 19, 2005 (2 pages).
Written Opinion of the International Searching Authority and International Search Report from the International Bureau of WIPO for International Application No. PCT/US2006/018968, dated Oct. 16, 2006, 12 pages.
Written Opinion of the International Searching Authority and International Search Report from the International Bureau of WIPO for International Application No. PCT/US2008/087542, dated May 4, 2009, 12 pages.
"Answer and Counterclaim of Defendant Outdoor Cap Co., Inc.," *Waters Industries, Inc.* v. *Outdoor Cap Co., Inc.*, United States District Court for the Northern District of Illinois, Case No. 1:13-cv-07191, 11 pages (Oct. 30, 2013).
"Complaint", *Waters Industries, Inc.* v. *Totes Isotoner Corporation, et al.*, United States District Court for the Northern District of Illinois, Case No. 1:10-cv-04487 (26 pages).
"Declaratory Judgment Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 52 pages (Oct. 8, 2013).
"First Amended Answer and Counterclaim of Defendant Outdoor Cap Co., Inc." with Exhibit A through G, *Waters Industries, Inc.* v.

(56) References Cited

OTHER PUBLICATIONS

*Outdoor Cap Co., Inc.*, United States District Court for the Northern District of Illinois, Case No. 1:13-cv-07191, 201 pages (Dec. 11, 2013).
"Plaintiff's Complaint" with Exhibit A, *Waters Industries, Inc.* v. *Outdoor Cap Co., Inc.*, United States District Court for the Northern District of Illinois, Case No. 1:13-cv-07191, 7 pages (Oct. 8, 2013).
"Plaintiffs First Amended Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 51 pages (Oct. 10, 2013).
"Plaintiffs Initial Infringement Contentions Under Local Patent Rule 2.2" with Appendix A, Figures 1-5, and Exhibits 1-3, *Waters Industries, Inc.* v. *Outdoor Cap Co., Inc.*, United States District Court for the Northern District of Illinois, Case No. 1:13-cv-07191, 58 pages (Nov. 27, 2013).
"Waters Industries' Answer to Defendant's Counterclaims," *Waters Industries, Inc.* v. *Outdoor Cap Co., Inc.*, United States District Court for the Northern District of Illinois, Case No. 1:13-cv-07191, 5 pages (Nov. 20, 2013).

* cited by examiner

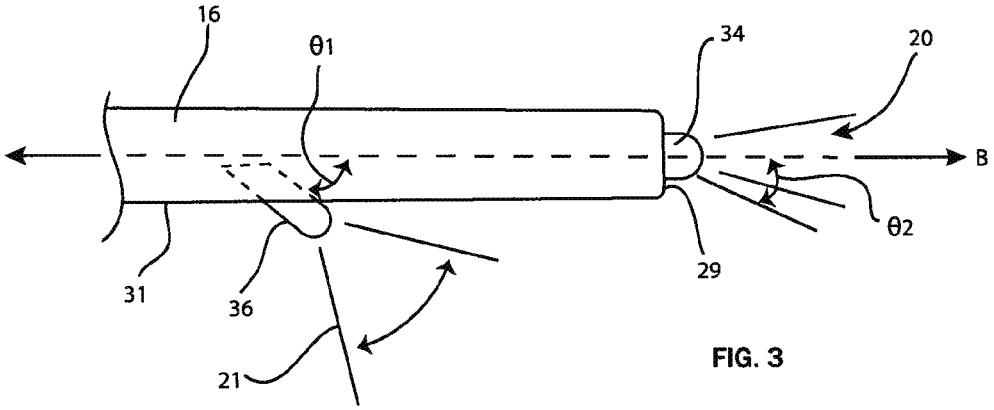
FIG. 3
FIG. 4A
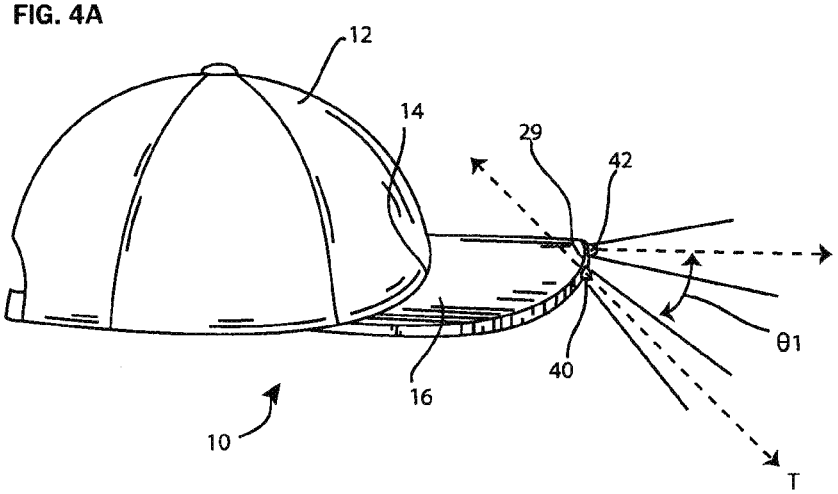

FIG. 43A
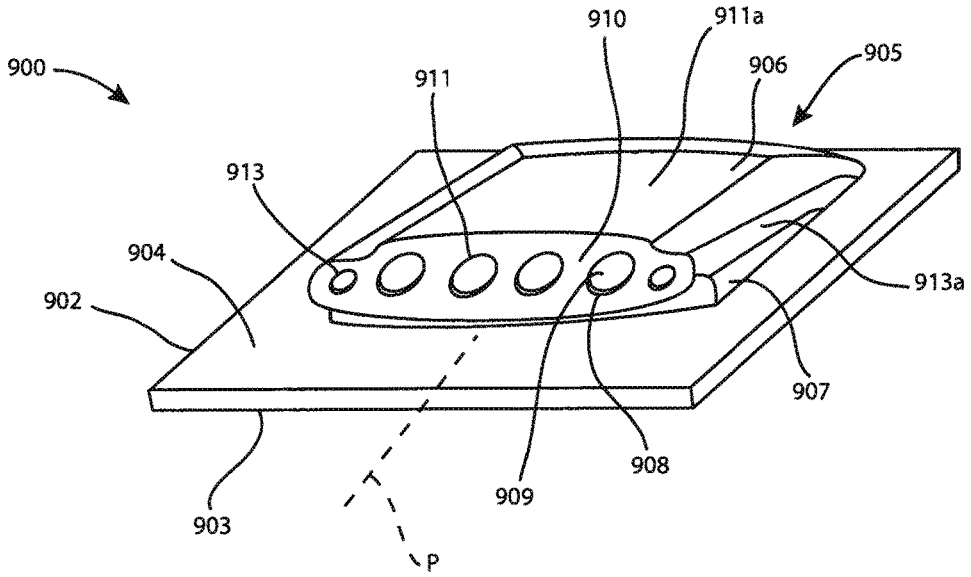
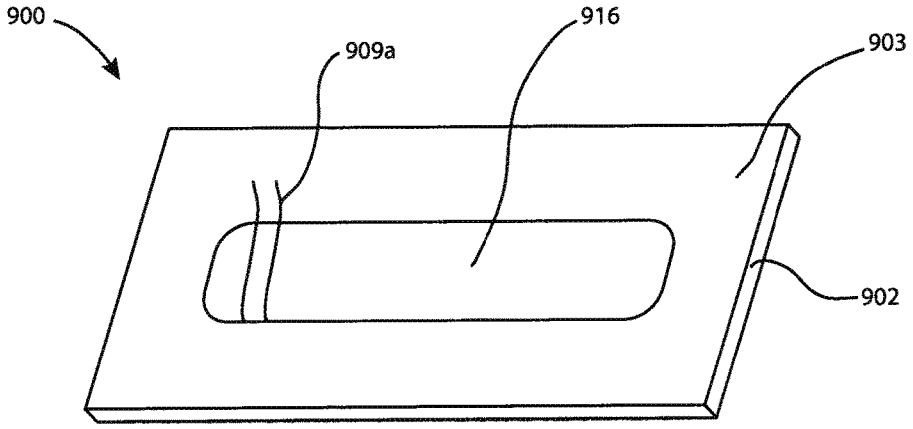
FIG. 43B

FIG. 46
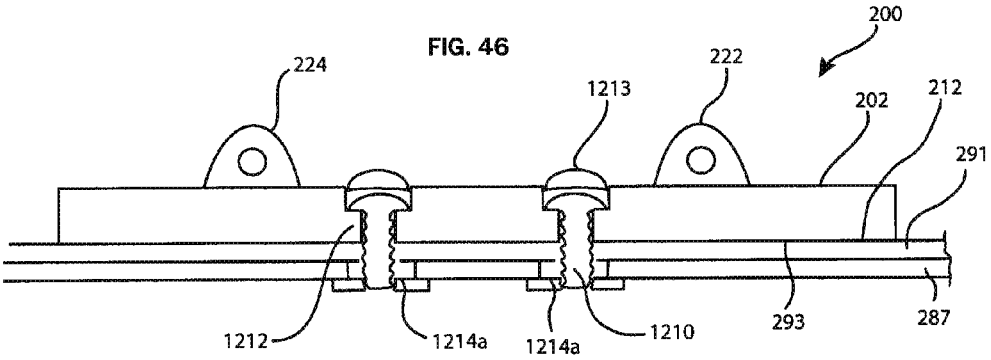
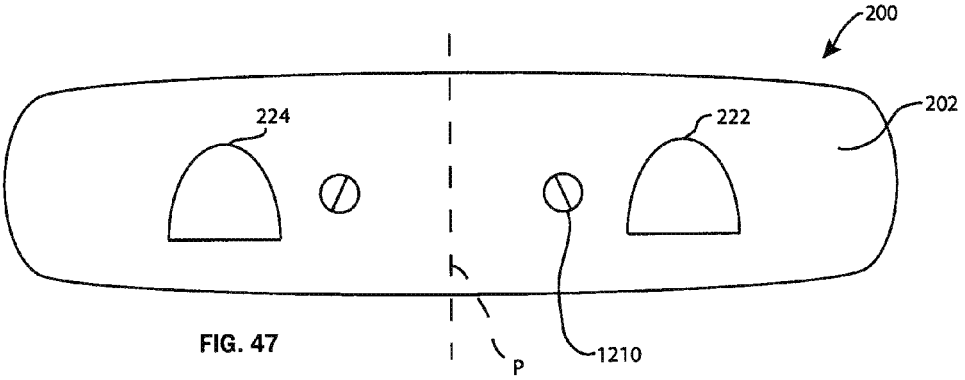
FIG. 47
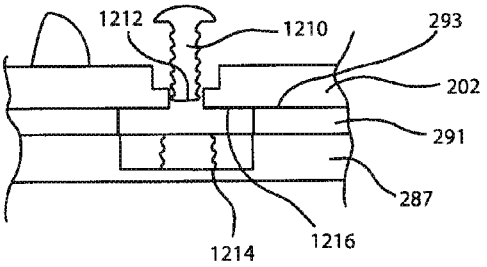
FIG. 49A
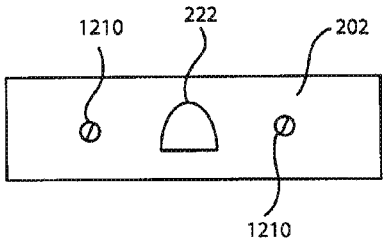
FIG. 48

FIG. 54
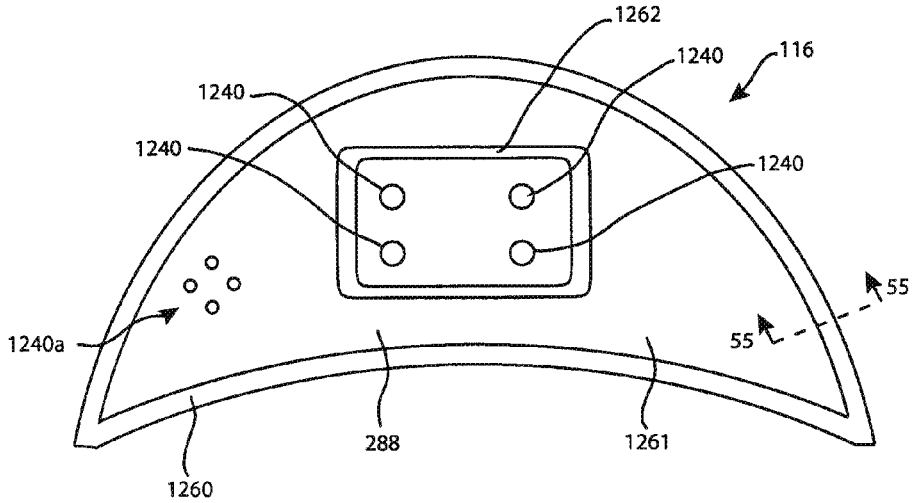
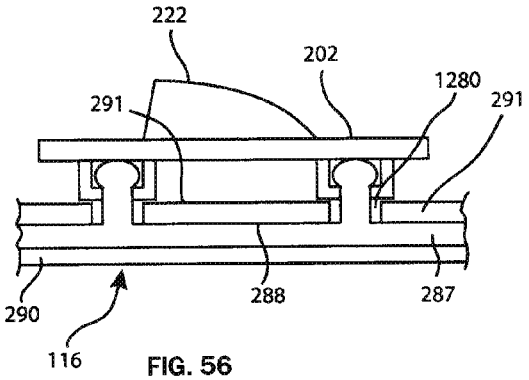
FIG. 56
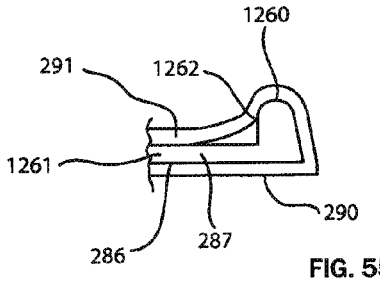
FIG. 55
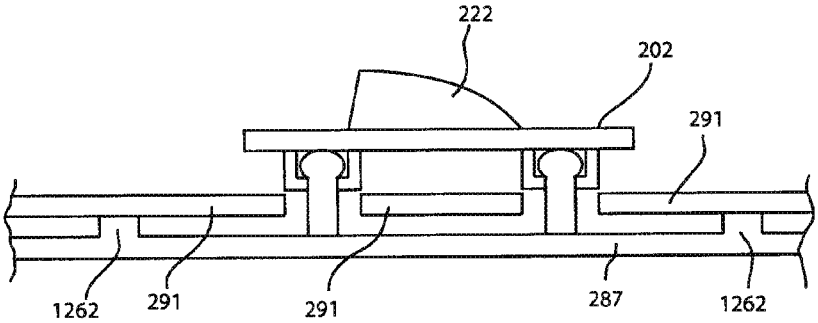
FIG. 57

FIG. 58
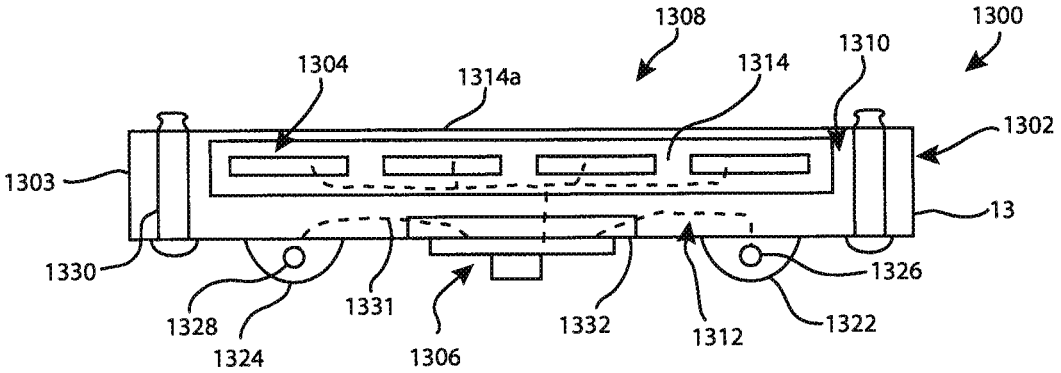
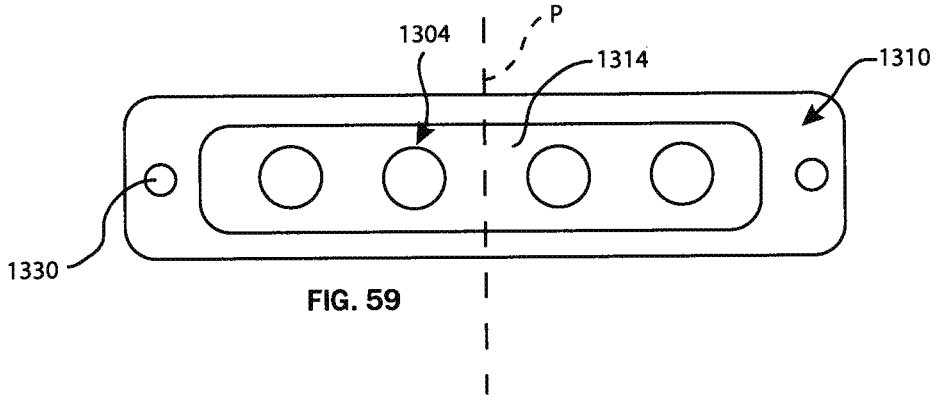
FIG. 59
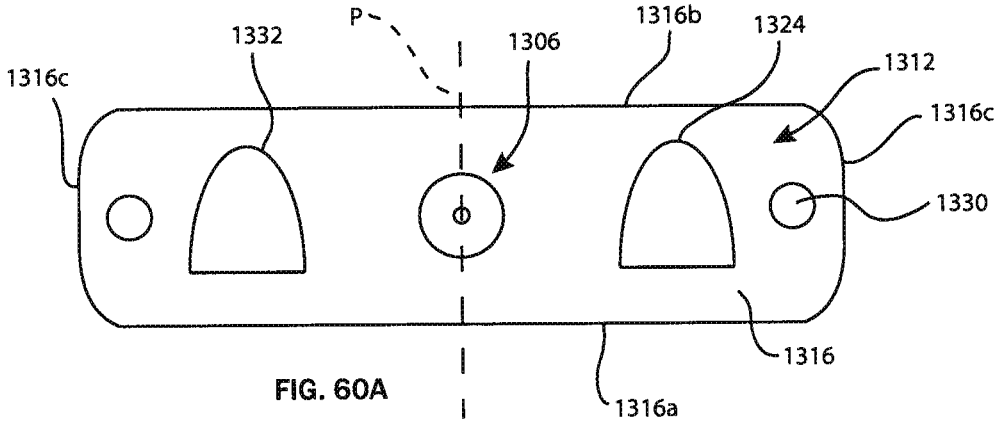
FIG. 60A

FIG. 61
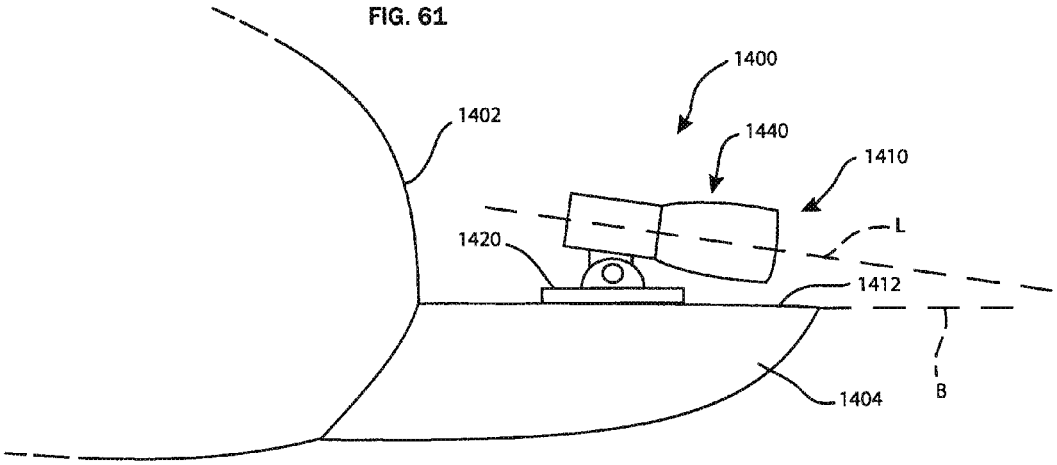
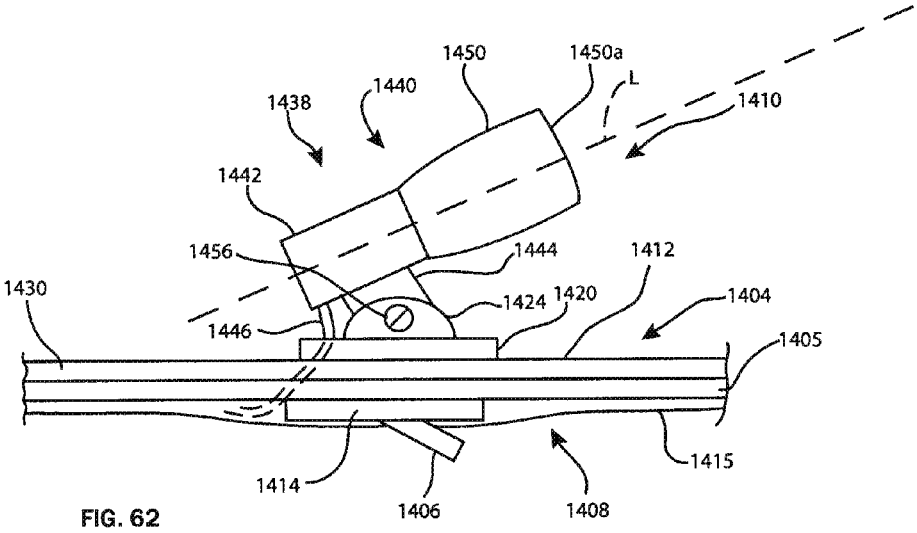
FIG. 62

FIG. 63A
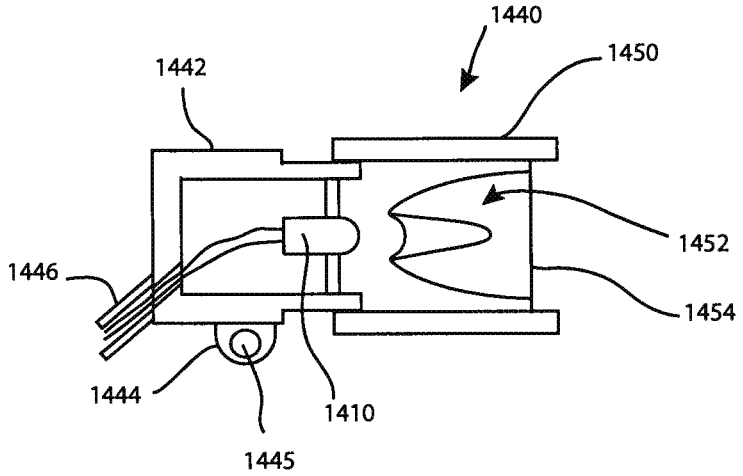
FIG. 64
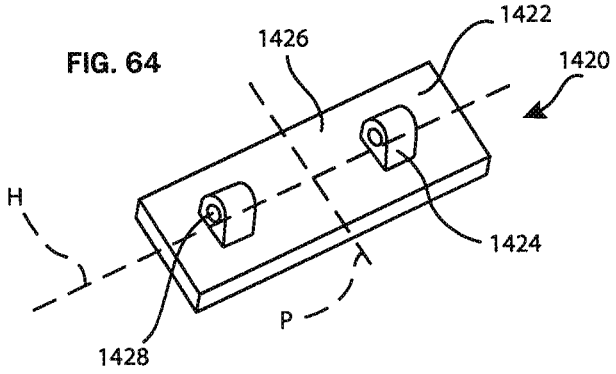
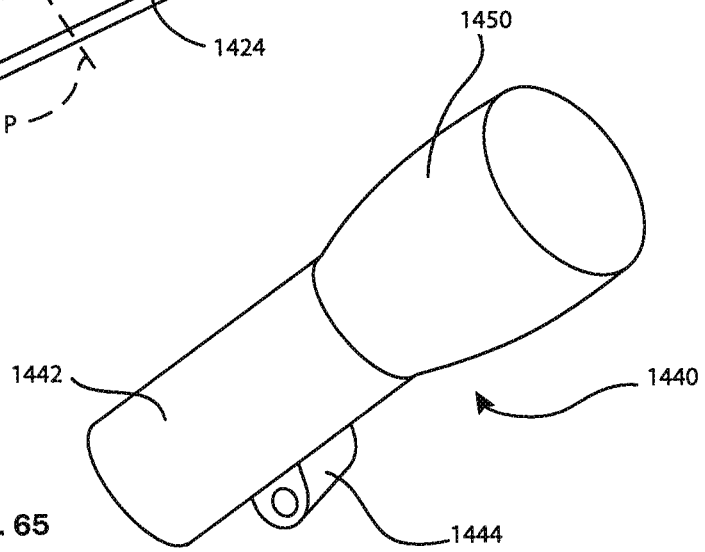
FIG. 65

FIG. 66
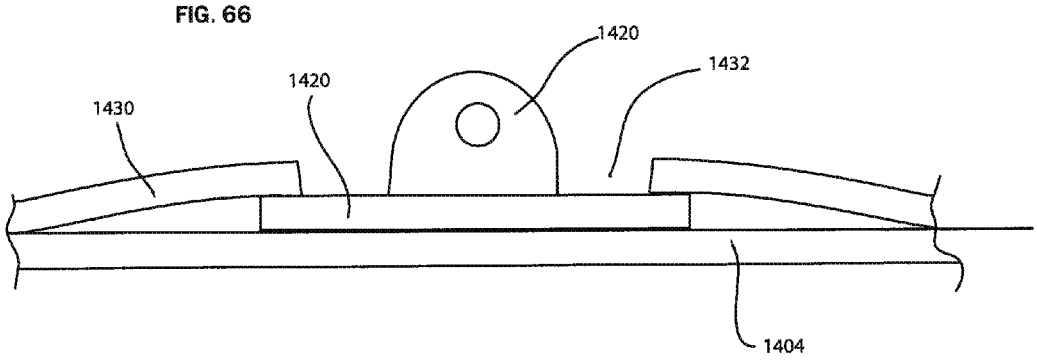
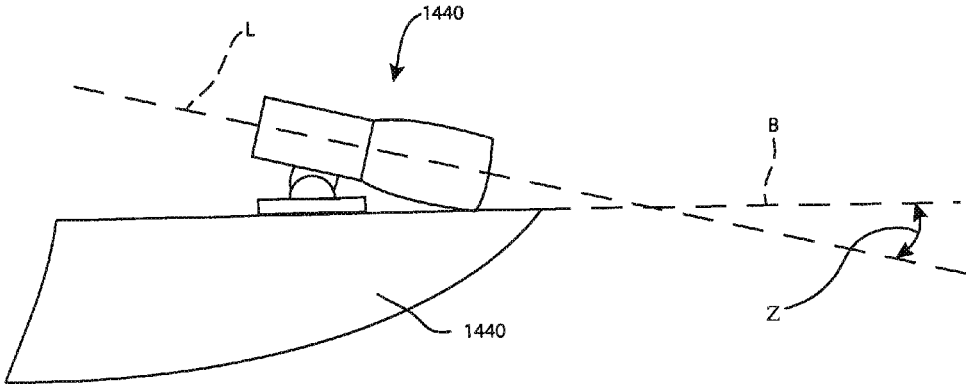
FIG. 67

FIG. 68
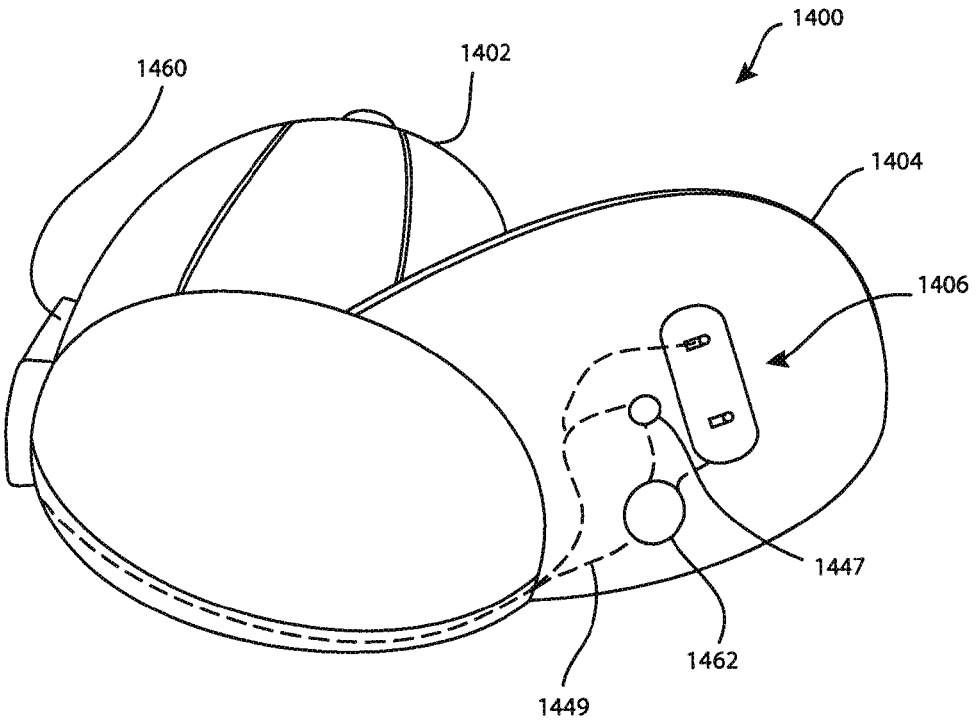
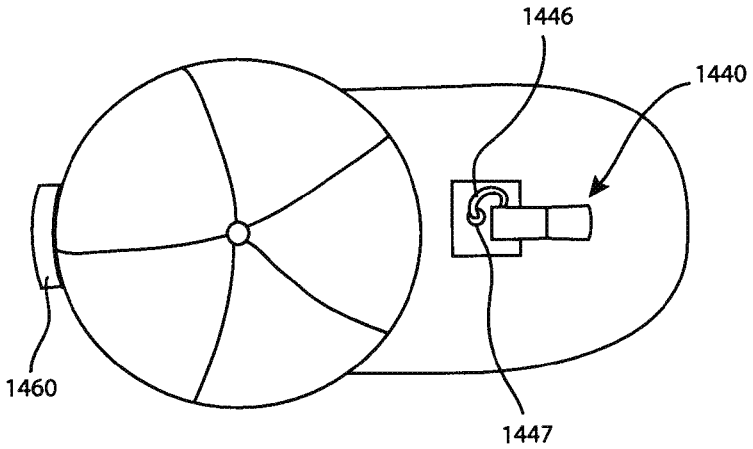
FIG. 69

FIG. 78
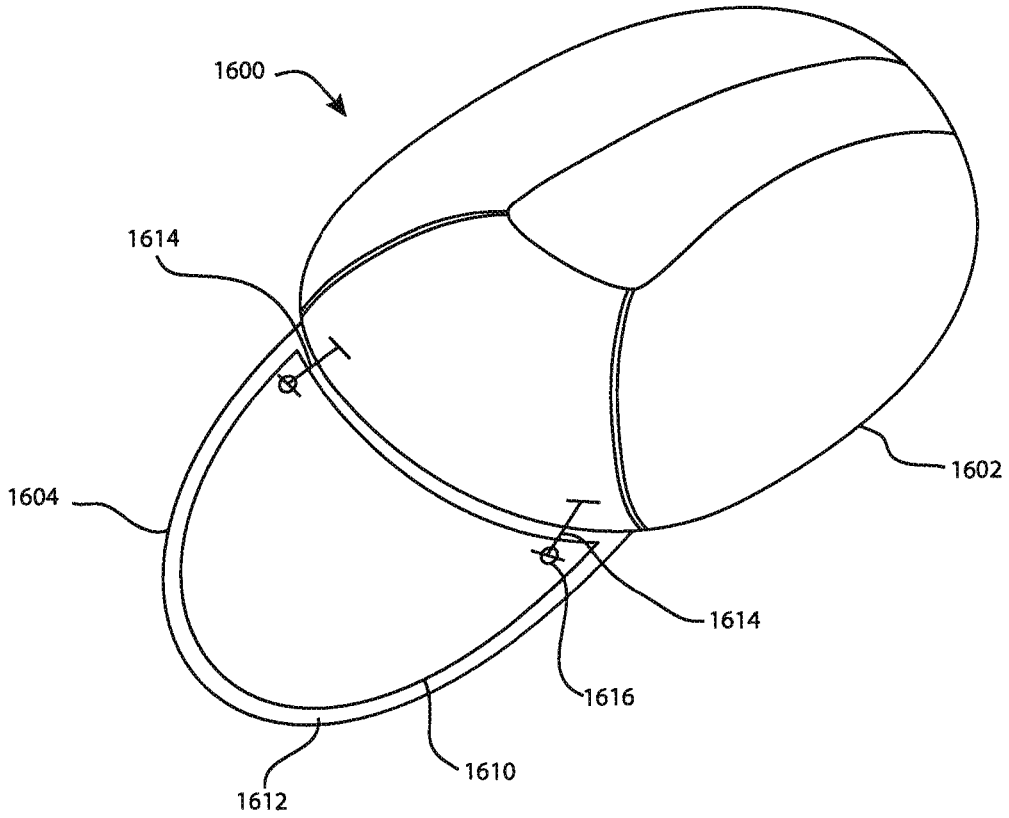
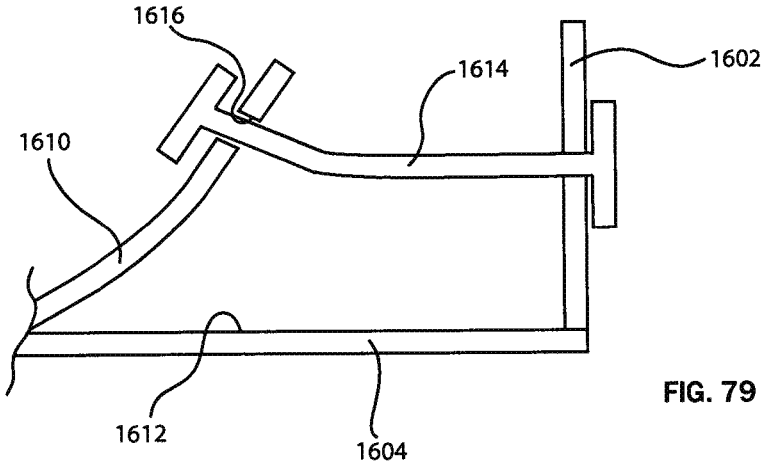
FIG. 79

FIG. 86
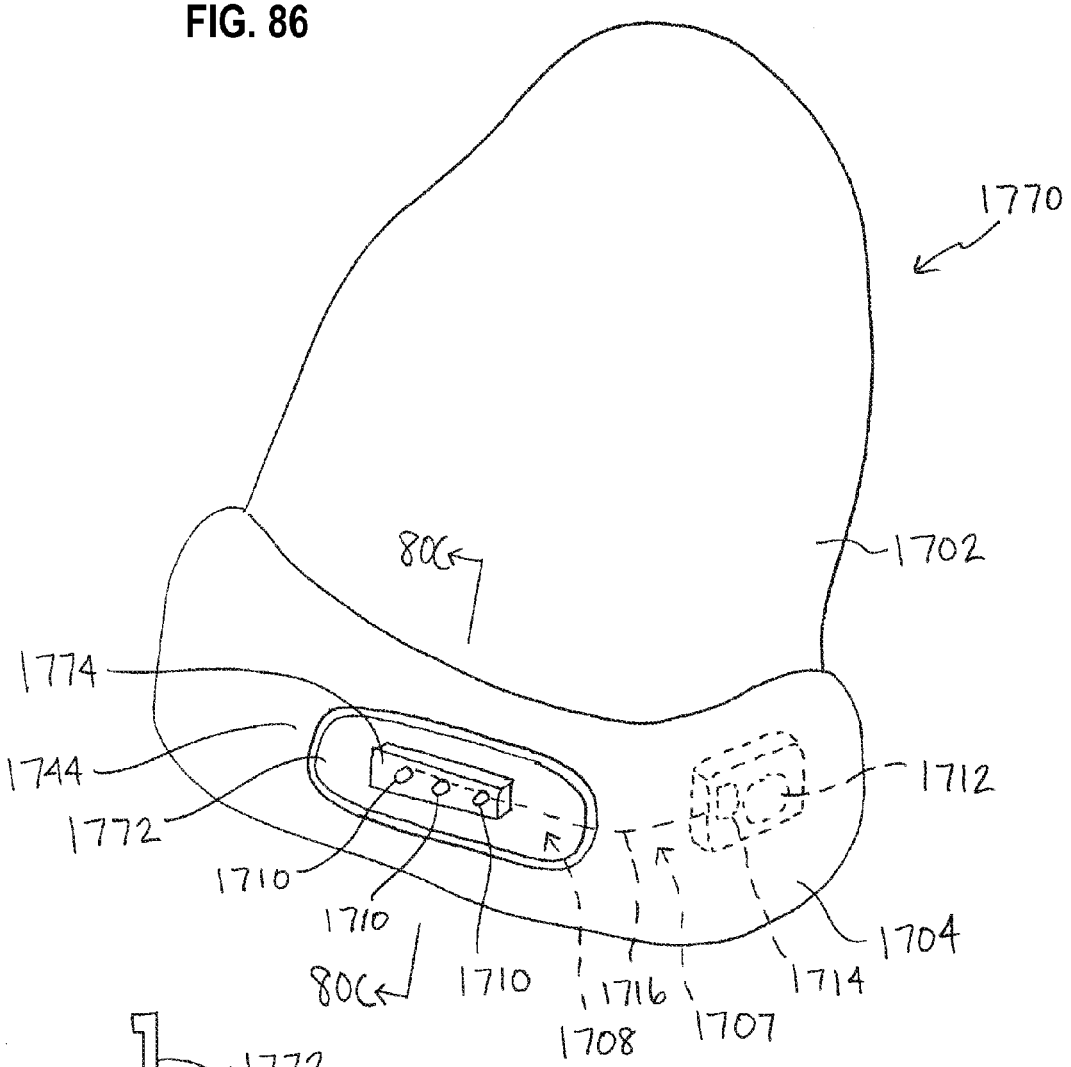
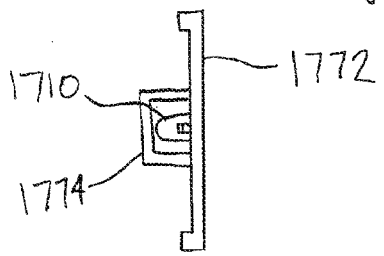
FIG. 87

LIGHTED HAT

CROSS-REFERENCE TO RELATED APPLICATIONS

This application is a continuation-in-part of U.S. application Ser. No. 14/212,820, filed Mar. 14, 2014, which claims the benefit of U.S. Appl. No. 61/798,971, filed Mar. 15, 2013 and is a continuation-in-part of PCT/US12/71480, filed Dec. 21, 2012, which claims the benefit of U.S. Appl. No. 61/580,181, filed Dec. 23, 2011; which are all hereby incorporated by reference herein in their entirety.

FIELD OF THE INVENTION

The invention relates to hands-free lighting devices and, in particular, to lighted hats capable of providing illumination for a wearer.

BACKGROUND OF THE INVENTION

Often an individual desires a light focused to illuminate an area while performing a task or a light directed in a general forwardly direction along their line of sight for visibility. Holding a flashlight is an option, but such lighting devices are often cumbersome and may detract from the task being completed because only one hand is available for the task since the other hand is holding the flashlight. As a result, hands-free lighting is desirable so that both hands are available for performing a task in lighted conditions.

Headgear is known that may include light sources attached so as to illuminate an area within the wearer's line of vision. The light source may be an LED mounted to a brim portion of a baseball style hat. Generally, these hats have the LED mounted to direct light forwardly from the brim so that the LED axis is parallel with the fore-and-aft brim axis. With these hats if a wearer wishes to illuminate an object located at a specific location from the wearer, the wearer must move his entire head or hat to direct the brim and light emitted therefrom toward the particular object. If the object is located far away, then the wearer may direct the illumination by moving the hat so that the brim extends generally horizontally or parallel to the ground to provide a beam of light to illuminate the far off object or area. If the object is located nearby, close to, and below the wearer's face, then the wearer must move the hat brim downward to a declined position such that the hat provides a beam of light to illuminate the closer object. Oftentimes, moving the hat downward will require the wearer to bend his neck. This motion may be undesirable because it may be uncomfortable for some people.

For example, U.S. Pat. No. 5,741,060 to Johnson discloses a lighted hat with two lamps connected to a mounting plate secured to the outside lower surface of a brim of the hat. The light sources are both fixed so that they project light forwardly. If the wearer wishes to adjust the illumination to be directed in another direction, the wearer must still tilt his head or the hat itself in an upward, downward, left or right direction. These lamps also hang noticeably below the visor portion and include relatively large sockets which are soldered to the mounting plate. Both the mounting plate and the sockets are externally attached to the bottom of the visor portion and are readily visible to a third party viewer thereby creating an unaesthetic and non-natural appearance. The external arrangement of these large and bulky lamps and sockets also may be within the peripheral vision of the wearer, which may be distracting, and/or may even block or interfere with a wearer's vision. Furthermore, since these lamps are fixed, illumination is only available in the generally forward direction of the hat wearer.

In another example, U.S. Pat. No. 6,056,413 to Urso discloses a light connected to a visor of a baseball-style cap. The light of Urso is a light bulb received in a socket with the light being pivotally connected to the underside of the visor. The pivotal mounting allows the light to be pivoted in a downward or upward direction to provide light to a location the wearer chooses to illuminate. This configuration permits a wearer to focus the light in a forward direction to provide illumination directly in front of the wearer or rotate the light source in a downward direction to provide illumination at a location below the visor. Pivoting lights are undesirable as they introduce complexity and moving parts into the hat that can fail over repeated usage. While the light of Urso pivots, it still can only project light to one location or area at any one time. Similar to the hat of Johnson, the light of Urso is also bulky and hangs noticeably below the visor. The large profile of this light and mounting apparatus may similarly block or interfere with a wearer's vision as well as create an unaesthetic appearance to third parties viewing the lighted hat, especially when the light is pivoted downwardly. Furthermore, Urso mounts a power source and switch in a crown portion of the hat with wiring extending therebetween across a pivot joint of the light source. Over time, it is possible that the wiring extending across the pivot joint may fail due to repeated bending as the light is pivoted up and down.

In another example, U.S. Pat. No. 6,994,445 to Pomes describes a baseball cap having a light source inside a brim portion of the hat. In one embodiment, the light source is mounted within a recessed compartment of the brim so as to be oriented in a horizontal or parallel position relative to the fore-and-aft axis of the brim. A reflector is positioned in the compartment to reflect the light provided by the light source in a downward direction below the brim. Requiring the beam of illumination to be reflected only provides indirect illumination that is less precise and more difficult to control and direct than a beam of illumination directly emanating from a light source. In another example, Pomes discloses a light source that is mounted vertically orthogonal to the brim's fore-and-aft axis within the recess so that the light source is pointed in a vertically downward direction relative to the brim. To allow the light source to fit in the brim in this vertical orientation, Pomes teaches that the brim can have a thickened section to make space for receiving the light source. Since Pomes describes a light source mounted in a vertical orientation but still enclosed within the brim section, the profile of the brim may be thicker than desired so as not to have the typical streamlined and thin appearance of a traditional baseball hat. Moreover, the perpendicular orientation of the light source relative to the brim is likely to provide illumination in a downward direction that only illuminates an area directly underneath the visor. Neither configuration of Pomes is ideal for illuminating objects that may be located at a reading or viewing distance in front of the wearer. Moreover, projecting light directly underneath the visor as in Pomes can also cause glare or project light into the wearer's eyes.

SUMMARY OF THE INVENTION

In one aspect, lighted headgear is disclosed where a plurality of light sources are mounted to the headgear for providing outward illumination to at least two different areas or in at least two different directions from the headgear. In one form, the light sources are mounted to a brim of the headgear and oriented to provide outward illumination at different angles relative to each other. One light source can be one or more LEDs mounted to direct illumination forwardly of the brim and provide a beam of illumination to areas that are located at distances that are relatively far away from the hat. Another light source can be one or more LEDs mounted to the brim and oriented to direct a beam of illumination at a downward and transverse angle to the first beam of illumination thereby providing illumination to an area located more closely to the hat. Such lighted hats advantageously allow a wearer to illuminate areas at close working distances, such as at a reading distance in front of the wearer, or to areas at distances much farther away from the wearer at the same time and without the need of the hat wearer moving the hat or pivoting the light sources.

In another form, a light holder for being mounted to headgear as well as headgear with the light holder mounted thereto is disclosed. The light holder may be mounted to the brim of the headgear for fixing the light sources in a particular orientation. In one aspect, the light holder includes a mounting base and one or more light holding bezels or modules that extend in a downward and oblique angle of inclination away from the base. The holder portions or bezels are sized to receive the light sources and, in one approach, maintain multiple light sources at the same fixed oblique angle of inclination relative to the base. Thus, the light holder advantageously allows multiple light sources to be secured to headgear in a quick and easy manner where more than one light source are oriented in the same direction to provide illumination in a downward direction of inclination. In another aspect, the light module is relatively thin and compact. This allows the light holder to remain largely undetectable thereby allowing the hat to maintain a streamlined and natural appearance in contrast to the prior hats of Johnson, Urso, and Pomes that require bulky modules on the outside of the brim or a thick brim to house a recess large enough to hold a light source therein. In this regard, the low profile of the light holder allows it to be mounted either interiorly of brim structure such as between the brim insert and fabric cover or exteriorly to the fabric cover without detracting from the functionality or appearance of the headgear In one form, the light holder is attached to the lighted hat via a mounting patch portion or other mounting surface located on the headgear brim, such as along a portion of the covering material extending about the brim. Thus, by one approach, the light holder and the lights thereof, are secured to the mounting patch formed on the brim covering material rather than to the shape retentive insert of the brim. This mounting patch preferably has a thickness thereof that is greater than the thickness of the brim covering material to form a secure and preferably more rigid or stiffer mounting location for the light holder than the thinner brim covering material. The light holder is preferably secured to the covering material with adhesive, and the mounting patch advantageously maintains the outer surface of the brim covering material free of residual adhesive, which may otherwise tend to seep though the thinner covering material, such as fabric, commonly used for hat brims. In this manner, the mounting patch keeps blemishes or stains from forming on outer surfaces on the brim covering material by blocking adhesive from wicking and/or seeping through the brim covering material. In one example, the mounting patch may be of a non-wicking material that keeps the adhesive from seeping through the brim covering material. In another example, the mounting patch may be a thick layer of material that blocks the adhesive from leaking through the brim covering material. For instance, the mounting patch can be embroidered stitching which can be of non-wicking material and be sewn so as to extend through the brim fabric covering material to be thicker than the fabric covering material. To this end, the embroidered stitching provides the additional benefit of providing an excellent location for including indicia such as logos, brand names, etc. for promotional purposes that can be sewn therein.

In another form, a light holder includes a mounting base having an integral light holding bezel extending therefrom so as to be of a unitary construction therewith. The light holding bezel includes both a first cavity and a second cavity, with each cavity sized for receiving a light source therein. The first and second cavities have a common outer wall extending therearound and a dividing wall therebetween. The first cavity has a first angle of inclination relative to the mounting base so that the light source received therein can project light forwardly and downwardly, while the second cavity has a second angle of inclination relative to the mounting base that is greater than the first angle of inclination so that the that light source received therein can project light more downwardly than the first cavity light source. Having two distinct cavities within a single bezel allows these to be formed such that light can be directed at multiple predetermined angles of inclination from a single light holder.

In yet another form, a light holder includes a bezel having four or more distinct cavities within a common outer wall, with each cavity sized for receiving a light source therein. Two of the four cavities have a first angle of inclination relative to the mounting base of the light holder, and the other two cavities have a second angle of inclination relative to the mounting base that is greater than the first angle of inclination. The light sources mounted within the cavities having the first angle of inclination can project light in a first direction, and the light sources mounted within the cavities having the second angle of inclination can project light in a second direction different from the first direction. The light holder can be mounted to a brim of a hat, with the hat having a power source and a switch device. The switch device can be electrically connected to the four light sources for selectively activating any of the light sources. A second switch device can be electrically connected to a pair of the light sources, with the first switch device connected to the other pair so that select pairs of light sources can be activated separately from each other.

In another form, a lighted hat includes a light holder mounted to a brim portion using a snap fit connection. In one form, the brim portion includes a coupling member having undercut portions on opposite sides thereof. The light holder includes a pair of cam portions at opposite sides of a mounting base of the light holder. The undercut portions receive the cam portions to create the snap fit connection. In another form, the brim portion can include a plurality of connection members, such as posts, extending from the brim portion. The mounting base of the light holder has a plurality of connection member receptors that are configured to be snap fit onto the connection members to form the snap fit connection therewith. In either snap fit connection, the light holder can be quickly attached or detached without the need for adhesive or other time consuming fastening devices. Further, the brim portion can include a brim insert portion with covering material extending thereacross, and the light holder can be mounted externally to the covering material so that a portion of the covering material is between the mounting base of the light holder and the brim insert.

In yet another form, a light holder is externally mounted to a brim portion of a hat using an ultrasonic weld connection. The light holder has a mounting base of plastic material. The brim portion includes a brim insert and covering material extending thereacross. The light holder is mounted externally to the covering material so that a portion of the covering material extends between the mounting base of the light holder and the brim insert. The ultrasonic weld connection provides a relatively fast and clean method of mounting the plastic mounting base to the brim fabric without using adhesives or other fasteners.

In another form, a light holder is externally mounted to a brim portion of a hat using a threaded connection. The brim portion can include a recess therein sized to receive a threaded insert. A mounting base portion of the light holder includes openings therethrough so that fasteners can be inserted through the openings and secured to the threaded insert to mount the light holder to the brim portion. In another form, the brim portion can include a brim insert with covering material thereacross. The brim portion can further include a through opening and a threaded nut mounted to an upper surface of the brim insert to be fixed thereto and aligned with the through opening. The fastener can then extend through the opening of the mounting base, a corresponding opening in the brim lower covering material, and the through opening of the brim insert to engage the threaded nut to thereby mount the light holder to the brim portion. The threaded nut can includes prongs that clamp against or pierce the upper surface of the brim insert to thereby secure the light holder to the brim portion.

In another aspect, a light holder module for use with headgear includes a housing, a light source received within a bezel extending from the housing, a power source, and a switch device. The light source, power source, and switch device are each electrically connected within the housing, and the housing is adapted for mounting to a portion of the headgear. With the light source, the power source, and the switch device each received within the housing, the light holder module can be externally attached to the brim and easily removed therefrom at a later time. The module can be interchangeable with other versions, or it can be repaired or replaced if necessary, such as when the batteries need replacing or recharging. Furthermore, the light holder module can include a solar cell mounted thereto for charging and recharging a rechargeable battery within the housing.

In still another aspect, a lighted hat includes a crown portion and a brim portion extending therefrom, with a first light source mounted to a lower surface of the brim, and a second light source mounted to an upper surface of the brim. Preferably, the second light source and the brim portion upper surface have a hinge connection therebetween. Both the upper and lower light source are electrically connected to a power source and a switch device. The hinge connection allows for adjusting the orientation of the second light source for modifying the direction of the light beams.

In another form, the second light source can be received within a housing that is removably mounted to the upper surface of the brim. More particularly, the second light source housing can include a hinge base that is configured to slidingly engage a hinge base receptor or portion mounted to the upper surface of the brim. The hinge base receptor can include opposing wall portions that are configured to lockingly receive a flange portion of the hinge base. The hinge base can be slidably received in or removed from the hinge base receptor. In a further aspect, the hinge base and the hinge base receptor can include corresponding electrical contacts, so that an electrical connection is established between the hinge base and the hinge base receptor with the hinge base received therein, so that the second light source can be easily electrically connected to other electrical components mounted to the hat, such as switches, circuit boards, power sources, other light sources, or the like, via sliding of the hinge base on the hinge base receptor without using external wiring. The easy attachment and removal of the second light source allows the wearer of the hat to remove the upper light source when it is not in use to provide for a more streamlined appearance of the hat.

A light holder is also described herein that is of a transparent or translucent material. As such, light emitted from LEDs received therein will at least partially project through the walls of the light holder. This can advantageously be used to illuminate a design, such as a logo or pattern formed in the light holder, such as on a base portion or light holder portion thereof. The light holder can be configured to mount to the brim of a hat or to the headband of a stocking cap. In one form, the light holder is an external light holder configured to mount to an exterior surface of a hat brim. If desired, the external light holder can have portions thereof painted or coated with an opaque material to minimize any light that otherwise may shine into the eyes of a wearer. In another form, the light holder can be mounted between a brim covering material and a brim insert. As such, a light housing, light holding portion or bezel of the light holder extends through an opening in the brim covering material to project light below the brim. In order to block incident light, an opaque covering panel can also be mounted over the light holder to overlap portions thereof.

BRIEF DESCRIPTION OF THE DRAWINGS

FIG. 3 is a fragmentary side view of the brim of FIG. 2 showing the LED positioned at the perimeter edge of the brim providing illumination in a forward direction and the LED positioned underneath the brim at the intermediate position being canted at a downward angle relative to the brim;

FIG. 4A is a side perspective view of a lighted hat having a first LED at the perimeter edge of a brim to provide illumination in a forward direction and a second LED at the perimeter edge of the brim to provide illumination in a downward direction;

FIG. 43A is a perspective view of the light holder of FIG. 40;

FIG. 43B is a bottom perspective view of the light holder of FIG. 40 showing a common opening for the large and small cavities;

FIG. 46 is a front cross-sectional view of a light holder mounted to an external surface of a hat brim;

FIG. 47 is a bottom plan view of the externally mounted light holder of FIG. 46;

FIG. 48 is a top plan view of another externally mounted light holder;

FIG. 49A is a front cross-sectional view of the externally mounted light holder of FIG. 46 showing a threaded insert mounted to the brim;

FIG. 54 is a plan view showing the underside of a hat brim showing the connection members and a raised edge portion along the periphery of the hat brim;

FIG. 55 is a cross-sectional view of the raised edge portion taken along the line 55-55 of FIG. 54;

FIG. 56 is a side cross-sectional view of the snap fit connection of FIG. 52 showing the light holder mounted externally to a covering material of a brim insert;

FIG. 57 is a side cross-sectional view of the snap fit connection of FIG. 52 showing a covering material and a raised inner portion surrounding the snap fit connection;

FIG. 58 is front cross-sectional view of a light module having a housing, a power source mounted within the housing, a switch device mounted to the housing, and a pair of light holding bezels each having a light source mounted therein;

FIG. 59 is a top plan view of the light module of FIG. 58 showing the power source within a power source compartment of the housing;

FIG. 60A is a bottom plan view of the light module of FIG. 58 showing the switch device mounted to the housing and the pair of light holding bezels;

FIG. 61 is a side view of a lighted hat having a pivotably adjustable upper light device mounted to the brim and adjusted to direct light at a downward angle of inclination relative to a fore-and-aft axis of the brim;

FIG. 62 is side cross-sectional view of the lighted hat of FIG. 61 showing the upper light device mounted above the brim and a lower light source mounted below the brim, with the upper light device adjusted to direct light at an upward angle of inclination relative to brim axis;

FIG. 63A is a side cross-sectional view of a light housing assembly of the adjustable upper light device;

FIG. 64 is a perspective view of a hinge base that is a portion of the adjustable upper light source;

FIG. 65 is a perspective view of the light housing assembly of FIG. 63;

FIG. 66 is a side cross-sectional view of the hinge base of FIG. 64 mounted to the brim;

FIG. 67 is a side view of the adjustable light device of FIG. 61 pivoted downwardly so that the it contacts the brim of the hat;

FIG. 68 is a bottom perspective view of the hat of FIG. 61 showing electrical connections between the lower light source mounted to the brim, a switch mounted to the brim, a power source mounted to the crown portion of the hat, and a hole in the brim through which the electrical connections of the upper light source extend;

FIG. 69 is a top plan view of the hat of FIG. 68 showing an electrical wire extending through the hole and connected to the upper light source;

FIG. 78 is a perspective view of a hat having a packaging cover extending across the brim;

FIG. 79 is a side cross-sectional view showing a mounting configuration of the packaging cover of FIG. 78;

FIG. 86 is a perspective view of a lighted cap showing a light assembly including a lens portion disposed over light sources mounted to a backplate that is mounted to a hat band of the lighted cap;

FIG. 87 is a cross-sectional view of the light assembly of FIG. 85;

FIG. 89 is top plan view of a light module having a housing, a power source mounted within the housing, a switch device mounted to the housing, and a light holding bezel having a plurality of light sources mounted therein; and FIG. 90 is a front elevational view of the light module of FIG. 84 showing the module mounted to a brim portion of a hat.

DETAILED DESCRIPTION OF THE PREFERRED EMBODIMENTS

Figure 1:
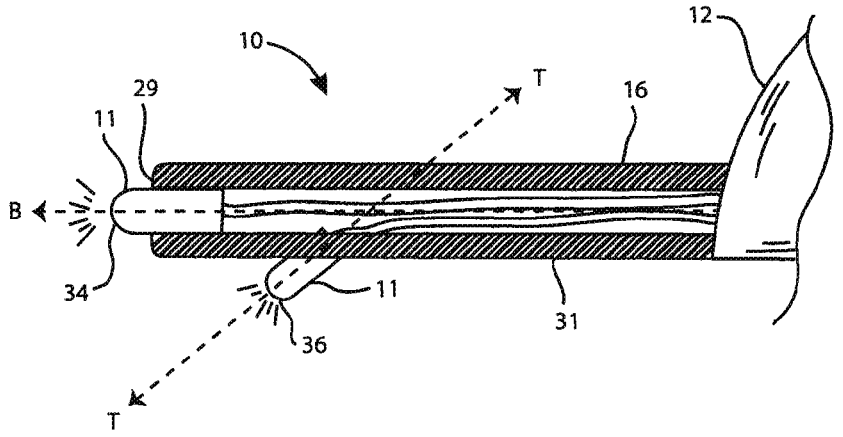
FIG. 1 is a side sectional view of the brim of a lighted hat having an LED mounted thereto to project a beam of light in a forward direction and an LED mounted thereto to provide illumination in a downward direction.

In general, the various aspects described herein relate to hands-free lighting, components thereof, and other accessories therefor. As further described below, the hands-free lighting may include lighted headgear such as hats, including baseball caps, hoods, visors, military or law enforcement helmets or headgear, bike helmets, or other lighted headgear having the lights positioned thereon to provide lighting in a forward and/or downward direction from the wearer.

In one aspect, the hands-free lighting is able to simultaneously provide illumination in multiple directions while maintaining a natural, streamlined configuration associated with traditional headgear. Multiple light sources may be positioned on a brim of the lighted headgear to project a beam of light in at least two different directions, thereby allowing a wearer to illuminate different areas, such as areas at different distances from the wearer, without the wearer needing to tilt or rotate his head. In another aspect, light sources may be mounted to a light holder or mounting member that is attached to the brim to provide illumination in different directions, while still allowing the brim of the headgear to maintain a low profile so as to have a thin and natural appearance. In one form, the light holder is advantageous because it provides an easy and convenient way to mount more than one light source canted in the same direction relative to the brim. In yet another aspect, the lighted hat may include a relatively thicker mounting portion or patch positioned on the brim to provide a more secure mounting location or surface for the light holder. In one example, the light holder may be attached to an inside surface of the brim via the mounting portion using adhesive, sewing, stitching, ultrasonic welding, Velcro, or other suitable fastening techniques so that the light holder is substantially concealed within the brim. In another example, the light holder is attached to the mounting portion on the inside of a covering material extending about the brim with adhesive, and the mounting portion functions as a barrier to minimize and, preferably, avoid leaking or seeping of the adhesive from passing through the covering material of the brim. The mounting portion, therefore, helps minimizes the appearance of residual adhesive on the outer surface of the brim covering, which can otherwise form an unsightly stain or other mark. Additional details are described below with reference to a baseball cap, but it will be appreciated this is only an example of one particular application. The hands-free lighting described herein may be incorporated in other types of headgear as well.

In general, the lighted hat and other headgear described herein include illumination sources, which are preferably LEDs, mounted at different locations on the hat. To energize these illumination sources, a variety of different power assemblies can also be used that employ varying mechanisms to generate energy. For instance, as disclosed in Applicant's U.S. application Ser. No. 11/941,558, which is incorporated herein by reference in its entirety, the mechanisms to generate energy may include power generators that use renewable energy, such as solar, wind, or kinetic energy, or various battery configurations in order to generate electrical power that ultimately energizes the variety of light sources that may be included on the described hats. For example, a laminate capacitor can be formed by the brim structure with outer layers of fabric being saturated with carbon nanotubes while the middle fabric layer is untreated. The two outer layers can be charged such as via a conventional power source or by a solar cell panel in the hat or brim portion thereof. While the following description and illustrations may describe a conventional battery power source, renewable power generators as described in the '558 application may also be included in the hat embodiments. In some instances, it may be desirable to include a charging port 805 in the hat such as along the outer edge of the brim. In addition, while the preferred headgear is a baseball-type hat or cap, the power assemblies and illumination sources may also be mounted to any suitable headgear, such as visors, helmets, headbands, hoods, or the like.

Figure 2:
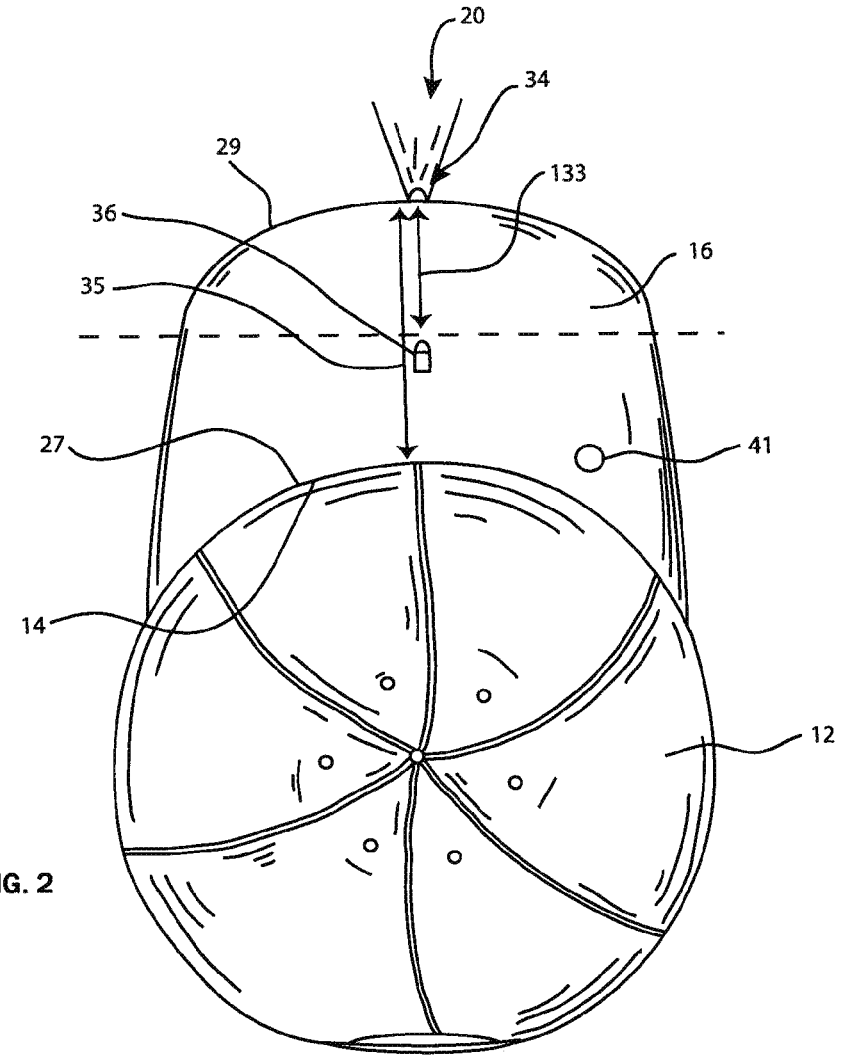
FIG. 2 is a bottom plan view of a brim of a lighted hat having an LED along the perimeter edge of the brim and an LED underneath the brim at an intermediate position along the fore-and-aft axis.

A first embodiment of hands-free lighting 10 having a light source 11 configured to direct light in multiple directions is generally illustrated in FIGS. 1-3. In this embodiment, the light source 11 may be mounted to a lighted hat and, in particular, to a brim portion 16 of the light hat. FIGS. 1-3 illustrate the brim portion 16 generally without an associated head or crown portion 12, but it will be appreciated that any common crown or other head fitting portion that does not cover the wearer's head such as with visors may be employed. Referring to FIG. 1, the light source 11 includes a plurality of light sources 34 and 36, preferably LEDs, to provide illumination in multiple directions. In this embodiment, the brim 16 of the lighted hat generally extends in a fore-and-aft direction along a brim axis B, and the lighted hat 10 has the light source 34 positioned to direct light generally along the brim axis B and the light source 36 mounted on the brim 16 and configured to direct light inclined relative to the brim axis B along an axis T that extends downward from and transverse or obliquely to the brim axis B.

By one approach, the light sources 34 and 36 are configured to illuminate objects in areas that are different distances away from the hat. For example, the light source 34 may be configured to emit light along the brim axis B to illuminate an object or a location at a distance relatively far away from the wearer, such as approximately four to approximately six feet from the wearer. The light source 36 may be configured to emit light at an angle to the brim axis B along the axis T to illuminate an object or a location at a distance closer to the wearer, such as at a reading distance of approximately 3 inches to approximately 30 inches. These two areas are illuminated without requiring the wearer to shift his head in any given direction. That is, this configuration allows multiple distances to be illuminated simultaneously or at alternating times to thereby allow a wearer to see both objects at a distance and objects at a closer distance, without requiring shifting of the hat, just the shifting of the wearer's eyes. This configuration can be valuable in the field of military or law enforcement, for example. The positioning of the light source 36 underneath the brim is substantially concealed below the brim, which provides a beam of illumination whose source of light is not as easily seen by a third party viewer.

Turning to more of the specifics, the forward light source 34 is mounted at or adjacent a perimeter edge 29 of the brim 16, and preferably along the centerline of the brim 16, as shown in FIG. 2. The light source 34 may be a high-beam light source, which may include a relatively narrow cone of light 20, having an approximately 15 degree to approximately 20 degree light cone for projecting illumination relatively far distances from the wearer. The second light source 36 may be a low beam or look down light source and be mounted to the hat brim 16 remote from the perimeter edge 29, such as on a lower major surface 31 of the brim 16 as best shown in FIGS. 1 and 3. To this end, the light source 36 may be mounted at the lower major surface 31 of the hat brim 16 and spaced intermediately between a forwardmost portion of the perimeter edge 29 and the lower forward edge portion of a head fitting portion of the headgear or the crown 14, such as a distance 33 approximately halfway, and preferably more than half the fore-and-aft distance 35 between the front edge 29 and a rear edge 27 of the hat brim 16, as shown in FIG. 2. This positioning of the light source 36 is advantageous because it directs light within a lower viewing field of the wearer to provide illumination to a reading or working distance but at the same time avoids directing light towards others who are near the hat wearer, which can disadvantageously shine into other's eyes. Moreover, this positioning of the light 36 can provide illumination while substantially concealing the source of light from a third party viewer as mentioned above.

By one approach and referring to FIG. 3, the low beam light source 36 mounted at the lower surface 31 of the brim 16 is canted at an angle θ1 relative to the brim axis B extending through the hat brim 16 so that the light cone 21 therefrom is directed downwardly and forwardly of the hat brim 16 to illuminate an area relatively close to the hat brim 116. The cant angle θ1 can vary such as between about 15 degrees to about 40 degrees and can be selected based upon the configuration of the hat and its intended use. In an example where the light source 36 is used for reading, the cant angle θ1 can be about 30 degrees. In another example where the light source 36 is used for running, the cant angle θ1 can be about 20 degrees so the light is directed out more forwardly of the user so they can see the path on which they are running. In yet another example, the cant angle θ1 may preferably be 25 degrees to provide a medium range distance. With respect to the LED power, the light source 36 is preferably a 10,000 MCD or higher powered light emitting diode, although other LED outputs may be acceptable. The light source 36 may have about a 20 degree to about a 40 degree light cone 21 to provide a wider and less focused beam of light than the narrower light cone 20 of the light source 34. By mounting the light source 36 away from the brim perimeter edge 29 to be spaced therefrom and canting the light downwardly and forwardly, the direction of the light beam 21 does not shine in the direction of other third party viewers near the person wearing the light hat and also directs light and glare away from the wearer's eyes.

The light source 34 is preferably positioned to extend from the perimeter edge 29 of the hat brim 16 to direct light forwardly of the wearer. By one approach, the light source 34 may also be slightly canted relative to the brim axis B at a cant angle θ2, but is canted over a smaller angle θ2 than the light 36. For example, the light 34 may be canted from 0 to about 15 degrees downwardly from the axis B, and more preferably, about 5 to about 15 degrees. In order to project light farther distances, the light 34 may be a 20,000 MCD light emitting diode having about a 15 to about a 20 degree light cone.

Preferably, the light sources 34 and 36 are spaced from each other by being mounted on different portions of the hat brim 16. For example and as mentioned above, the light source 34 is mounted to extend from the brim's outer perimeter edge 29, and the light source 36 is mounted to extend downwardly from the major surface 31 forming the brim's lower surface or underside. As a result of this configuration and positioning of the lights 34 and 36, the light cone 21 and the light cone 20 preferably do not intersect or overlap each other and provide separate, discrete cones of illumination for differing purposes (e.g., far illumination and close illumination). When both lights 34 and 36 are energized, the wearer will not need to redirect their head to focus light on close and far objects. The wearer simply needs to move their eyes without significant head movement as the hat already directs illumination in two different directions and orientations. Of course, the lights 34 and 36 can be energized together or separately as needed for particular situations. In other examples, it might be desirable to have a low beam light source 36 positioned closer to the beam of illumination 20 provided by the high beam LED 34 to provide some overlap in the light beams 20 and 21 at a distance spaced outwardly from the brim. In other situations, it may also be desirable to have the low beam LED 36 provide a beam of illumination at a smaller cant angle where the low beam light source 36 positioned underneath the brim 16 might have a beam of illumination 21 partially blocked by the underside of the brim 16 due to the small cant angle.

Referring again to FIG. 2, this form of the lighted hat 10 may also include a single or multi-function switch 41 positioned on the lower brim surface 31. In one aspect, the switch 41 may be a multi-position switch that includes one or more positions or modes, such as at least a 4-position switch to select varying modes of illumination. For example, the switch 41 can select either one of the high beam or low beam illumination or both at the same time, vary intensity of one or both light sources 34 and 36, vary color, and the like. The switch 41 may be a pushbutton switch, a slide switch, a rotary switch, or the like. The switch 41 can be located on the underside of the brim 16 as shown in FIG. 2 or may be located at the brim perimeter edge 29.

For energizing the light source, the lighted hat may include at least one, and preferably two battery packs mounted to the hat. In one configuration, both battery packs are electrically connected to both the low beam and high beam lights, but in another configuration, one battery pack is electrically connected to the low beam lights and the other battery pack is electrically connected to the high beam lights. In this situation, the battery configuration can be optimized for each set of lights. For instance, additional battery power can be provided for either the low or high beam lights as the case may be to provide power for additional illumination.

In another example, the lighted hat 10 may include multiple high beam or low beam light sources mounted adjacent or at the perimeter edge 29 on the hat brim 16 as shown in FIG. 4A. By one approach, the lighted hat 10 may include at least two light sources 40 and 42, preferably LEDs, that are spaced from each other on opposite sides of a centerline of the hat brim 16, such as provided in Applicant's U.S. Pat. No. 6,659,618, which is hereby incorporated herein in its entirety. By having two spaced LEDs on either side of the brim center line, the lighted hat 10 may provide enhanced illumination by doubling lighting of the viewing or working area of the wearer. By positioning the light source away from the hat's centerline and maintaining the spacing of the LEDs 40 and 42 from each other on the brim 16, the hats herein offer enhanced depth perception of an area to be illuminated because the illumination from the spaced LEDs 40 and 42 provide well defined shadows and texture to the object being illuminated. The LEDs 40 and 42 may each be high beams, low beams, or a combination thereof as described above and, thus, embody the various characteristics (i.e., cant angles, beam widths, and the like) for each type of LED, but each are positioned at or adjacent the perimeter edge 29.

In one example, the LED 40 may be a low beam light source (similar to LED 36) mounted at the perimeter edge 29 of the brim 16 and positioned in the brim 16 to provide a beam of illumination along an axis T that is approximately 15 degrees to approximately 40 degrees from the brim axis B described above. Because the LED 40 is disposed at the perimeter edge 29, the beam of illumination will illuminate an area slightly forwardly of the area relative to the low beam light source 36 described above so that the illuminated area does not include areas under the brim 16. In one example, the LED 40 may be positioned at a cant angle θ1 of approximately 15 degrees to approximately 40 degrees from the brim axis B while also being substantially recessed within the brim 16 to allow the hat 10 to maintain a natural and thin appearance. In this example, the LED 42 may be a high beam light source (similar to LED 34) also mounted at the perimeter edge 29 of the brim 16 and positioned in the brim 16 to provide a beam of illumination generally along the brim axis B. The LED 42 may provide a beam of illumination to further distances from the wearer, such as approximately 4 feet to approximately 6 feet. To maintain the natural and thin appearance of the hat, the LEDs 40 and 42 may be substantially recessed within the brim 16 such that outer ends thereof only project from the brim 16 a short distance or, alternatively, are flush with the brim perimeter edge 29.

Figure 4B:
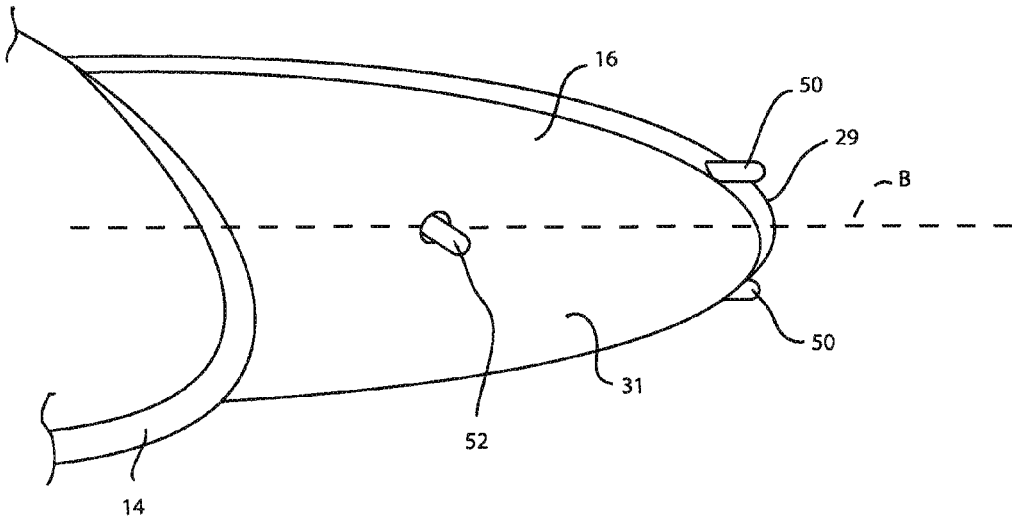
FIG. 4B is a bottom perspective of a lighted hat showing multiple LEDs along the perimeter edge of the brim and an LED underneath the brim at an intermediate positional along the fore-and-aft axis.
Figure 4C:
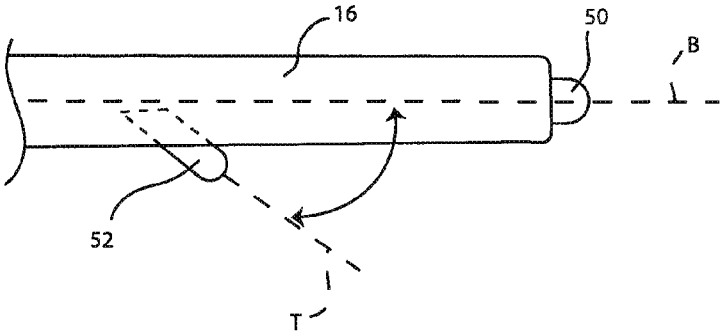
FIG. 4C is a fragmentary side view of the brim of FIG. 4B showing one of the multiple LEDs positioned at the perimeter edge of the brim for providing illumination in a generally forward direction and the LED positioned underneath the brim at the intermediate position being canted at a downward angle relative to the brim.

In another example, and shown in FIGS. 4B and 4C, the lighted hat 10 may include two or more light sources mounted adjacent to or at the perimeter edge 29 of the hat brim 16, as well as one or more light sources mounted at the lower surface 31 of the brim 16. By one approach, the lighted hat 10 may include at least two light sources 50, preferably LEDs, that are spaced from each other on opposite sides of a centerline of the brim 16, such as provided in Applicant's U.S. Pat. No. 6,659,618 which is hereby incorporated by reference herein in its entirety. The lighted hat 10 may also include at least one light source 52, preferably an LED, which is mounted at the lower major surface 31 of the brim 16 and spaced intermediately between a forwardmost portion of the perimeter edge 29 and the lower forward edge portion of the head fitting portion of the crown 14. The light source 52 may be configured to emit light inclined relative to the brim axis B along the axis T that extends downward from and transversely or obliquely to the brim axis B. As described above, having two spaced LEDs on either side of the brim center line provides enhanced illumination and depth perception. Alternatively, the LEDs 50 can be mounted adjacent each other for more focused illumination. Having an LED mounted underneath the brim 16 provides illumination at a distance closer to the wearer, such as at a reading distance, without requiring the wearer to shift his head. The LEDs 50 and 52 may each be high beams, low beams, or a combination thereof as described above and, thus, embody the various characteristics (i.e., cant angles, beam widths, and the like) for each type of LED, but the LEDs 50 are positioned at the perimeter edge 29 and the LED 52 mounted to the lower major surface 31 of the brim 16 and positioned underneath the brim.

In one example, the LEDs 50 may be high beam light sources (similar to LED 34 or 42 as described above) mounted at the perimeter edge 29 of the brim 16 and disposed at least partially between the upper and lower surfaces of the brim to provide a beam of illumination generally along the brim axis B. The LEDs 50 may provide a beam of illumination to further distances from the wearer, such as approximately 4 feet to approximately 6 feet. To maintain the natural and thin appearance of the hat, the LEDs 50 may be substantially recessed within the brim 16 such that outer ends thereof only project from the brim 16 a short distance or, alternatively, are flush with the brim perimeter edge 29. The high beam LEDs 50 may also include a relatively small cant relative to the brim axis B (similar to the cant angle of light source 40 but to a smaller degree) for projecting the high beam illumination at a slight downward angle relative to the brim, such as less than 10 degrees, while still operating primarily as a high beam light source.

Continuing with the approach of FIG. 4B, the LED 52 may be a low beam light source (similar to LED 36) mounted at the lower major surface 31 of the brim 16 and spaced intermediately between a forward most portion of the perimeter edge 29 and the lower forward edge portion of the head fitting portion of the crown 14 to provide a beam of illumination along an axis T that is approximately 15 degrees to approximately 40 degrees from the brim axis B described above. Because the LED 52 is disposed rearward of the perimeter edge 29, the beam of illumination will illuminate an area slightly rearwardly of the area relative to the low beam light source 40 described above so that the illuminated area includes areas under the brim 16, similar to light source 36.

Referring now to FIGS. 5-14, another exemplary lighted hat 110 is illustrated that embodies light sources configured to illuminate in multiple areas or directions. The hat 110 is illustrated as a baseball-type cap 112 having a crown 114 and a brim 116 projecting forwardly from a lower, forward edge portion of the crown 114 although other types of headgear are also contemplated. In this embodiment, the hat 110 is designed to provide illumination from the light sources, which are generally configured to focus illumination at a variety of different distances from the hat 110. By one approach, the hat 110 has the light sources mounted on the brim 116 to project cones of light along different axes.

In particular, the lighted hat 110 includes a first or high-beam light source 130 at or near a perimeter edge 129 of the brim 116. The high beam light 130 may be similar to the previously described high beam light 34. The hat 110 also includes a second or low-beam light source 132 that is remote from the brim perimeter edge 129 and preferably mounted intermediately along a lower major surface 131 of the brim underside. Light 132 may be similar to the previously described low beam or look down light 36.

Figure 5:
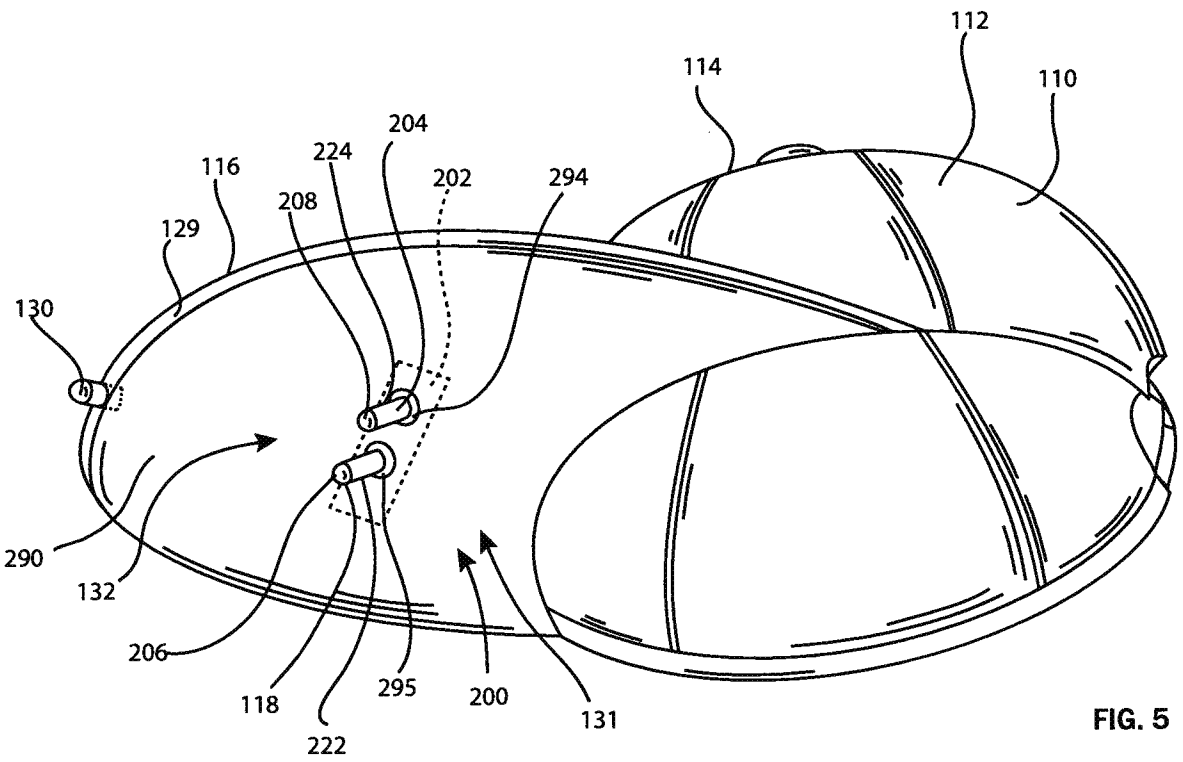
FIG. 5 is a bottom perspective view of a lighted hat showing a light holder for mounting LEDs to a bottom portion of the brim and an LED at the perimeter edge of the brim.
Figure 6:
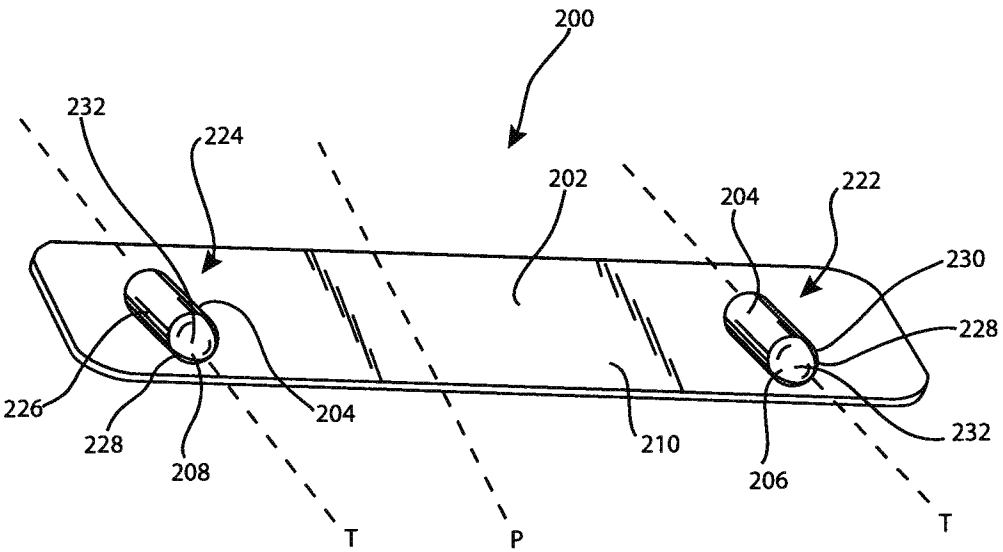
FIG. 6 is a perspective view of the light holder having a thin mounting base including two annular housing portions spaced from one another along the base and configured to receive LEDs in a fixed orientation therein to provide illumination in a transverse direction to the plane of the base.
Figure 7:
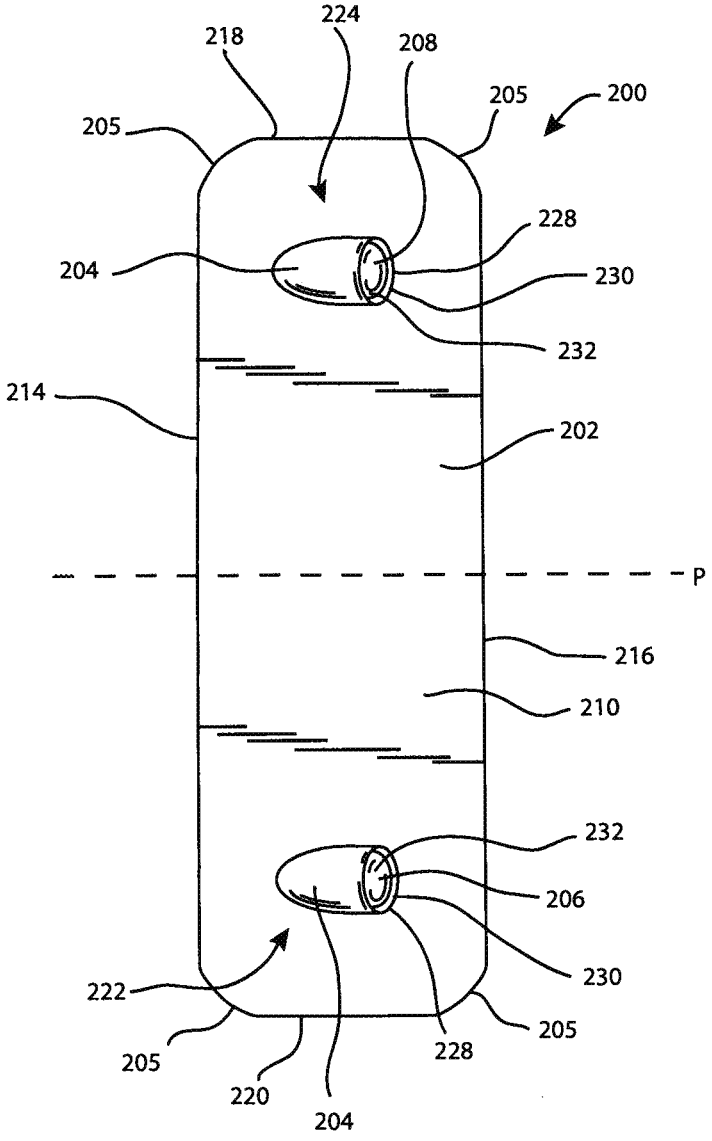
FIG. 7 is a bottom view of a light holder.
Figure 8:
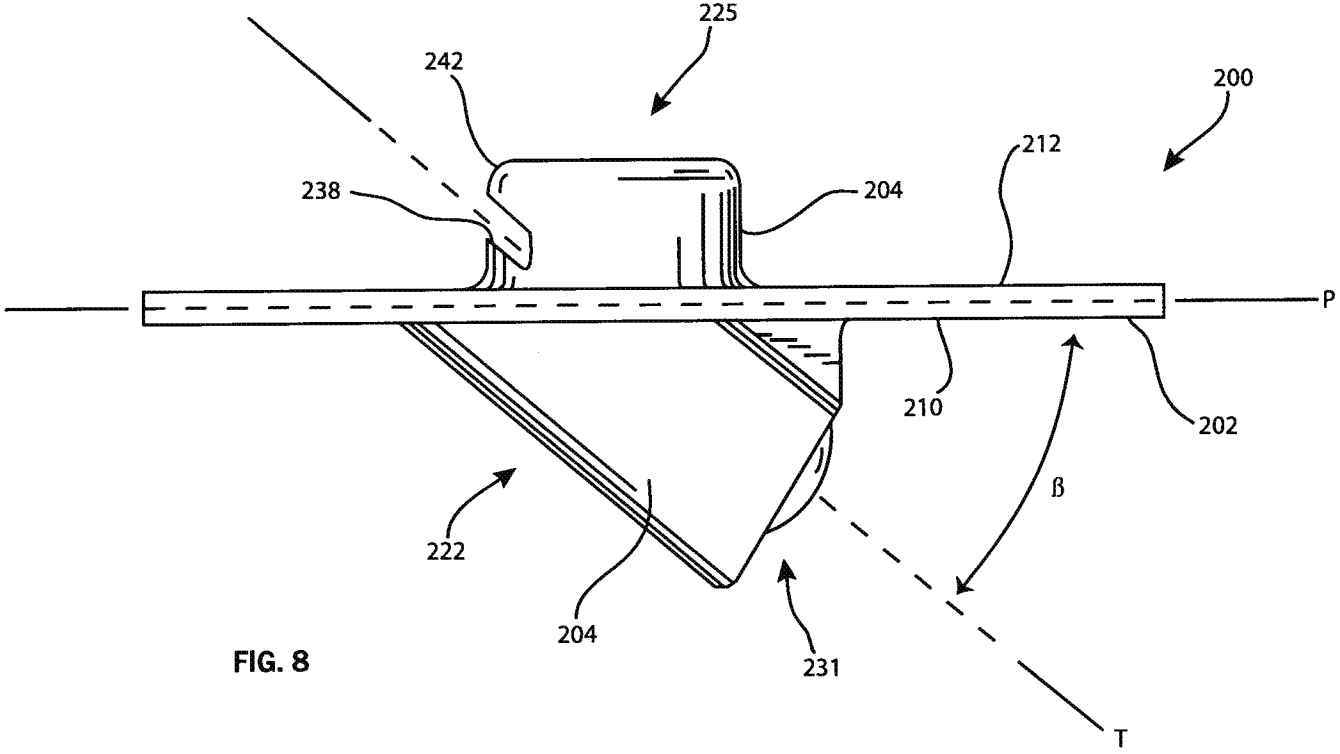
FIG. 8 is a side view of a light holder showing the thin mounting base and one of the annular housing portions extending below the mounting base to receive a LED therein, and a protrusion extending above the mounting base to receive at least an end portion of the LED.
Figure 9:
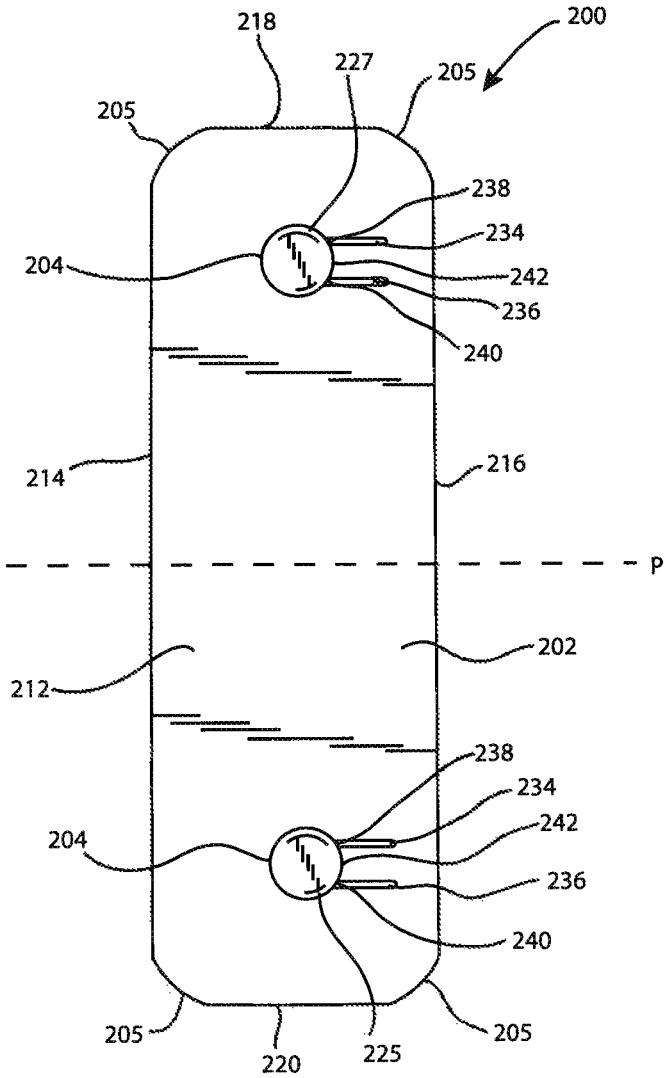
FIG. 9 is a top view of the light holder showing the two protrusions spaced from one another along the mounting base.

Referring to FIG. 5, the lighted hat 110 includes a light holder or hat lighting assembly, light mounting assembly, or hat lighting assembly 200 for securing the light source 132 to the lower major surface 131 of the brim 116. By one approach, the light holder 200 is used to secure two spaced light sources 206 and 208 in a fixed position relative to the brim 116 to illuminate an area below the brim 116. As shown in FIG. 5, the light holder 200 may be secured to the brim 116 of the lighted hat 110 and positioned to allow the light sources 206 and 208 to direct illumination in a direction downwardly and forwardly away from the lower major surface 131 of the brim 116 and to a close viewing distance of the wearer. The light source 130, on the other hand, may direct illumination in a direction generally along the brim axis B as described above.

Referring to FIGS. 6-9, one form of the light holder or hat lighting assembly 200 is shown in more detail. By one approach, the light holder 200 includes an elongate mounting base or member 202 and light holder or housing portions or light modules 204 sized to receive the light sources 206 and 208. Preferably, the mounting base 202 has a plate-like body that is thin and flat so as to have a minimal thickness thereby allowing the light holder 200 to be attached adjacent or to the brim 116 while maintaining the traditional thin and natural appearance of the brim 116. The elongate mounting base 202 includes an elongate lower surface 210 and opposite, upper surface 212 as best shown in the side view of FIG. 8. The lower surface 210 is generally flat and, by one approach, includes a lower section of the light holder portions 204 extending below the lower surface 210. The opposite, upper surface 212 is also generally flat and includes an upper section or rear projection of the light holder portions 204. The light holder 200 and, in particular the mounting base 202 thereof, may be made from a flexible and/or resilient material, such as a plastic or rubber material, so that the base 202 is sufficiently flexible to conform and bend to curvature typically found in the brims of baseball style hats. Other similar flexible and conforming materials may be used for the light holder 200 including a paperboard or rubber-like material or other resilient material. In addition, the light holder 200 can be of an aluminum or other heat dissipating material which can be particularly useful for higher power LEDs.

By one approach, the mounting base 202 has a generally thin, rectangular shape including rounded corners 205 connecting opposite front and back edges 214 and 216 (extending lengthwise generally parallel to one another) with opposite side edges 218 and 220 (extending parallel to one another and generally perpendicular to the longitudinal edges 214 and 216). A base lateral or fore-and-aft axis P extends along and from the plane of the mounting base 202 and generally parallel to the opposite side edges 218 and 220 and generally perpendicular to opposite the front and back edges 214 and 216.

The light holder portions 204 are connected to the mounting base 202 and configured to receive the light sources 206 and 208 therein. By one approach the light holder portions 204 may be seamlessly integrated with the mounting base 202 to provide a one piece light holder 200 and thereby permit secure attachment of the light sources 206 and 208 to the light holder 200 and hat 110. In one example, the light holder portion 204 includes spaced housing portions or bezels 222 and 224 on one side of the base 202 and corresponding spaced protrusions 225 and 227 on the other side of the base 202. The lower housings 222 and 224 may be spaced apart from one another and joined to the lower surface 210 of the mounting base in an integral construction to provide the one piece light holder 200. As discussed more below, the housings 222 and 224 have an opening or cavity therein sized to receive the light sources 206 and 208 at least partially therein. The housings 22 and 224 fix the light sources 206 and 208 in an orientation for providing beams of illumination in a direction away from the lower surface 210 of the mounting plate at an angle generally transverse to the brim axis B wherein the light holder 200 is mounted to the brim. To this end, the housings 222 and 224 can have a side wedge configuration so as to extend in a downward direction from the base surface 210 at an oblique angle of inclination relative to the base axis P of the mounting base 202. The housings 222 and 224 each have an axis T that extends transversely to and at a downward inclination β (FIG. 8) to the plate axis P of the mounting base 202. The housing axis T extends along a fore-aft axis generally defining a body of each housing 222 and 224. In one example, the housing axis T is angled approximately 15 degrees to approximately 40 degrees from the plate axis P, thereby fixing the light sources 206 and 208 respectively at the oblique angle of approximately 15 degrees to approximately 40 degrees from the plate axis P.

By one approach, each lower section of the light housings or housing portions 222 and 224 may have a generally cylindrical and hollow body 226 that extends from the lower surface 210 of the mounting base 202 to a distal end 228 thereof. Each hollow body 226 has a pocket or socket 231 capable of receiving and housing light sources 206 and 208, such as LEDs in the fixed configuration described above.

Referring to FIGS. 10-13A, the housing bodies 226 are shown in more detail. By one approach, the housing body 226 includes an annular wall 250 extending about the axis T. The annular wall 250 may extend from the base surface 210 in a direction generally transverse thereto. The distal end 228 has a generally circular outer end surface 230 that forms an opening to the pocket or cavity 231 to receive the light source therein. Thus, the light source may be securely mounted in the cavity 231 and surrounded by the wall 250 to orient the light in a direction to provide illumination generally along the axis T of the housing. The light holder 200 therefore provides an easy and convenient way to mount two separate light sources 206 and 208 on the underside of a hat brim and cant both light sources at the same time and in the same predetermined downward angle of inclination.

Figure 10:
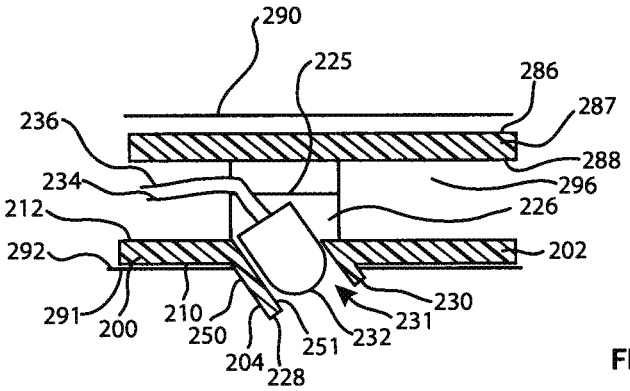
FIG. 10 is a side fragmentary cross-sectional view of the brim showing the light holder mounted to brim covering material with an LED received in the housing portion such that an outermost end of the LED does not extend past an outermost edge of the housing portion.
Figure 11:
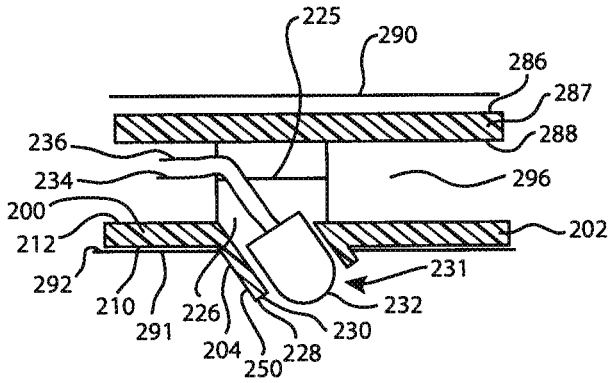
FIG. 11 is a side cross-sectional view of the brim showing an alternate light holder mounted to brim covering material with an LED received in a housing portion such that an outermost end of the LED extends past the outermost edge of the housing portion.

In one approach, the light sources 206 and 208 may be LEDs secured in the cavity 231 of the hollow body 226 of each housing 222 and 224. The LED may have a cylindrical lens body portion with an outermost cap portion 232 configured to emanate a beam of illumination from a chip located within the lens portion. In one example, the LED is positioned such that the wall 250 surrounds the LED body while the lens outermost cap 232 projects past the outer surface 230 of the annular housing body 226 as shown in FIG. 11. Preferably, the wall 250 still extends axially beyond the illumination chip. The configuration of FIG. 11 allows the LED to provide direct illumination to a location with a wider light cone because there is little or no interference therewith or reflection from an inside portion of the hollow body 226. In another embodiment, such as that of FIGS. 10, 12, and 13A, the LED may be secured within the cavity 231 such that the lens outermost cap 232 of the light source is fully housed within the hollow body 226 and is flush or otherwise does not extend past the outer surface 230 of the housing 226. In this configuration the illumination chip is recessed further back in the cavity 231. This allows an inside portion 251 of the housing wall 250 to provide a more focused narrow light beam and/or to be a blinder device to block incident or stray light while also providing the benefit of having the wall 250 to protect the lens of the LED from damage if the lighted hat is dropped.

Referring back to FIG. 9, the light holder portions 204 also include the rear protrusions 225 and 227 that extend above the upper surface 212 of the mounting base 202. The protrusions 225 and 227 provide a socket or base to seat the light sources 206 and 208. For example, each protrusion 225, 227 may be substantially hollow so that the cavity 231 of the housings 222 and 224, respectively, also extends into the corresponding protrusions so as to allow the protrusions to at least partially receive the light sources 206 and 208 therein. In one example, the light sources 206 and 208 are LEDs and each has two leads 234 and 236 that extend generally upward through the annular housings 222 and 224 and into the protrusions 225 and 227. The protrusions 225 and 227 each have an outer surface 242 in which two spaced openings 238 and 240 are located. These openings are configured to extend through the outer surface 242 to the cavity 231. Each of the light sources 206 and 208 are positioned at the cavity 231 such that the two leads 234 and 236 of each of the light sources 206 and 208 extend through the openings 238 and 240 to securely mount the lights 206 and 208 in the housings 226 and position the leads for connection to various electrical components of the hat.

In this manner, the light holder 200 serves as a mounting frame for the LED light sources 206 and 208 so that after the light holder 200 is attached to the brim 116, assembly of the LEDs 206 and 208 to the brim, and of the wiring harness to the LEDs 206 and 208 can be done in a relatively straightforward and simple manner. To this end, after the light holder 200 is secured to the brim 116, the LEDs 206 and 208 are fit into the cavities 231 of the housing portions 222 and 224 and protrusions 225 and 227 so that their leads 234 and 236 extend out through the rear openings 238 and 240 for being connected to the wiring from a switch and power source, such as a battery pack carried in the crown portion along the lower sweatband thereof.

In one embodiment and referring to FIGS. 10-13A, the light holder 200 may be attached to the brim 116 of the lighted hat and fixed to provide illumination in a direction forwardly and below the brim. Alternatively, the light holder 200 may be fixed to provide illumination in other directions below the brim including away from the wearer, a backward direction toward the wearer, a side direction, or a combination thereof. The brim 116 may include a shape retentive brim member or insert 287 having an upper major surface 286 and a lower major surface 288 with an upper brim covering material 290 extending over the upper brim major surface 286 and a lower brim covering material 291 extending over the lower brim major surface 288. In the example of FIGS. 10 and 11, the light holder 200 can be attached to the lower brim covering material 291 in a fixed orientation so as to provide illumination forwardly and downwardly from below the brim 116 while still remaining largely undetectable and unnoticeable by individuals viewing the hat 110 because it is mounted to be substantially covered by the brim covering material 291 between the lower surface 288 of the insert 287 and the covering material 291. Alternatively, the light holder 200 may be fixed to different locations at the brim to provide a variety of different configurations for providing illumination.

In the illustrated example of FIGS. 10 and 11, the light holder 200 is attached to an inside surface section 292 of the lower brim covering material 291 and is positioned in a space 296 between the lower major surface 288 of the brim and the lower covering material 291 created the offsets, standoffs, or protrusions 225 and 227 spacing the material 291 from the more rigid insert 287. To this end, the brim covering material 291 has spaced openings 294 and 295 (FIG. 5) to receive each of the spaced housings 226 extending therethrough. The lower surface 210 of the mounting base 202 may be secured to the inside 292 of the lower brim covering material 291 by adhesive, staples, Velcro, sewing, stitching, ultrasonic welding, or other fastening mechanisms. So configured, the light holder 200 is positioned on the inside section 292 of the lower brim covering material 291 such that the annular housings 222 and 224 and the light sources 206 and 208 at least partially extend through the openings 294 and 295, respectively, to provide illumination in a generally forward and downward direction away from the brim lower major surface 288 to illuminate an area that is at a relatively close distance from the wearer as described above.

By mounting the light holder 200 to the inside surface 292 of the lower brim covering material 291 as discussed above, the natural thickness of the brim 116 is substantially maintained and thereby allows the brim 116 to maintain its natural and streamlined appearance of a typical baseball type cap. The housings 222 and 224 and light sources 206 and 208 may extend only a short distance through the openings 294 and 295 so as to adequately provide illumination while still remaining substantially concealed to third party viewers and not interfering or blocking the line of vision of the wearer. In this configuration, the lens outermost curved cap portion 232 of the LED light sources 206 and 208 are only minimally exposed at the exterior of the brim 116 to allow for a direct beam of illumination to illuminate an area below the brim 116. This configuration allows for direct illumination to be provided without the use of any reflectors or diffusers.

The protrusions 225 and 227 extending from the upper surface 212 of the light holder 200 contact portions of the lower major surface 288 of the insert 287 of the brim 116 to form the brim space 296 located between the lower brim covering material 291 and the lower major surface 288 of the brim insert 287. By using the light holder 200 to form and/or maintain the brim space 296, the hat 110 advantageously includes a space sized to allow wires, electrical connections, circuit boards, and other conductive paths and electronic components to be housed within the space 296. For example, the interior brim space 296 can be used to connect a power source to the switch or switches and/or light sources and at the same time be concealed from view. In one example, leads 234 and 236 of the light sources may extend out of the protrusion 225 and be connected by a conductive path to a switch that is disposed to the brim 116 or a battery or power source disposed in the brim or elsewhere on the light hat 110, such as within a sweatband of the hat 110. The height of the annular protrusions 225 and 227 are short enough (e.g., approximately 1 mm) to provide a relatively small brim space 296 with just enough room to house all the necessary electrical connections to provide proper functioning of the light sources while still maintaining the streamlined appearance of the hat 110 and, at the same time, not substantially altering the natural thickness of the brim 116. In this regard, since hat brims are typically curved upwardly toward their lateral center if the light holder 200 is centered under the hat brim, the space added to be brim thickness by space 296 will be insignificant as the brim still will have portions thereof that extend below the bottom of the brim space 296 particularly along the brim outer side portions, and thus will not be very noticeable at all to third parties.

Figure 12:
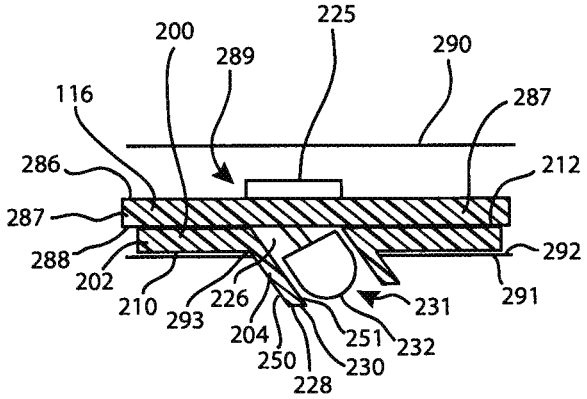
FIG. 12 is a side cross-sectional view of the brim showing the light holder mounted to a lower major surface of the brim insert with an LED received in the housing portion to provide illumination in a direction below the brim.

In another example and referring to FIG. 12, the light holder 200 may also be attached directly to the lower major surface 288 of the brim insert member 287 rather than the inside surface 292 of the lower brim covering material 291. With this approach, the shape-retentive brim member 287 may have an opening 289 creating a passageway or slot to receive the projections 225 and 227 so that the base 202 and an upper surface 212 thereof may sit flush against the lower surface 288 of the brim 116. In this instance, the standoff projections 225 and 227 would engage the upper brim covering material 290 to create a space between the material 290 and the insert 287 for receipt of electrical components, such as wiring, therein. In this example, the light holder 200 may be attached to the lower major surface 288 of the brim 116 by adhesive, sewing, stitching, staples, ultrasonic welding, heat welding, or other fastening mechanisms.

Figure 13A:
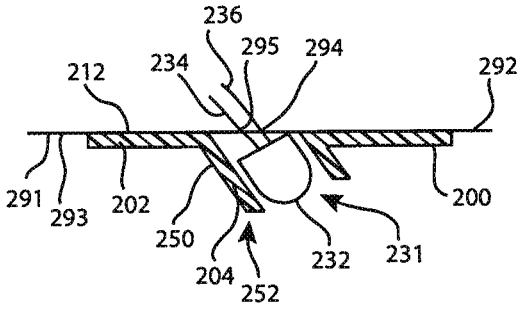
FIG. 13A is a side cross-sectional view of the brim showing the light holder mounted to an outside section of the brim covering material with an LED received in the housing portion to provide illumination in a downward direction.

In another example and referring to FIG. 13A, the light holder 200 may be attached to an outside surface 293 of the lower brim covering material 291 rather than the inner surface 292. By using this approach, the upper surface 212 of the mounting plate may be attached to the brim covering material 291 by an adhesive, staples, Velcro, sewing, stitching, ultrasonic welding, or other fastening mechanisms. The brim covering material 291 may have the openings 294 and 295 that provide a passageway from a location underneath the brim 116 to a location above the brim covering material 290 for receipt of the protrusions 225 and 227. The protrusions or standoffs 225 and 227 function much the same way as previously described to create space between the brim insert 297 and the lower covering material 291 for the wiring harness and, if desired, other electrical components, such as a switch. When the light source 206 or 208 is an LED, the leads 234 and 236 thereof may extend through the openings 294 and 295 respectively to contact the electrical connections and other conductors that are located above the lower brim covering material 291.

Figure 13B:
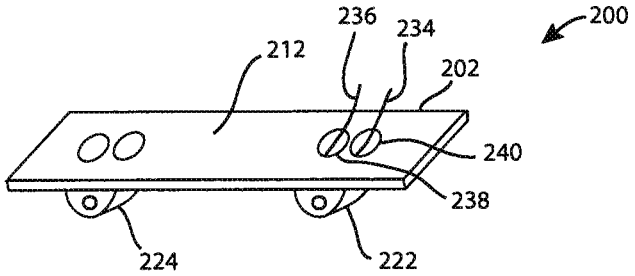
FIG. 13B is a perspective view of an alternative light holder.
Figure 13C:
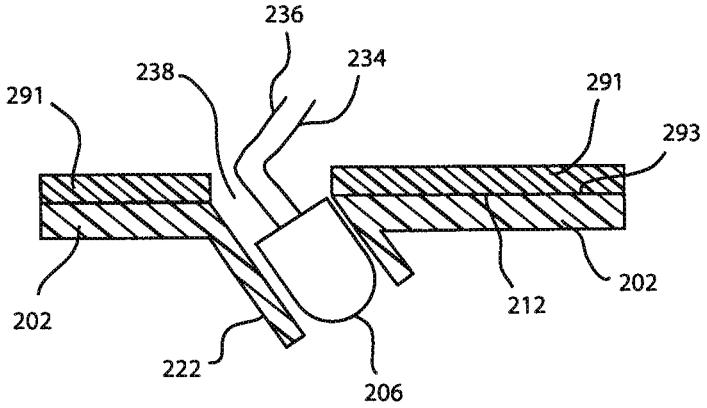
FIG. 13C is a side cross-sectional view of the light holder of FIG. 13B externally mounted to the brim covering material with a portion of the brim covering material extending between the light holder and a brim insert.
Figure 13D:
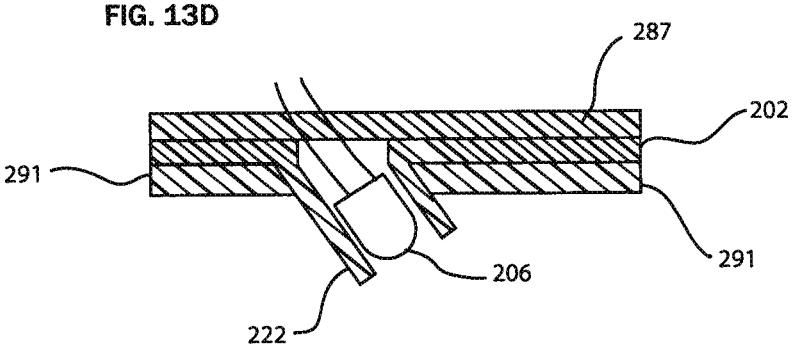
FIG. 13D is a side cross-sectional view of the light holder of FIG. 13B internally mounted between the brim covering material and the brim insert.

In another embodiment and with reference to FIGS. 13B-13D, the upper surface 212 of the mounting base 202 can be free of the protrusions or standoffs 225 and 227 and instead have a flat configuration. In this form, the openings 238 and 240 for the leads 234 and 236 may be formed in the upper surface 212 of the mounting base 202. A single opening for the leads 234 and 236 can also be utilized. Thus, the mounting base 202 can be installed relatively flush to the outside surface 293 of the brim covering material 291. The leads 234 and 236 can extend through the openings 294 and 295 in the covering material 291 to contact the electrical connections and other conductors that are located above the lower brim covering material 291.

Alternatively, this embodiment of the light holder may be installed as described above, with the mounting base 202 between the covering material 291 and the brim insert member 287. In such form, the upper surface 212 of the mounting base can sit flush against the brim insert member 287 without the opening 289 in the brim insert member 287 for receiving the protrusions 225 and 227.

Figure 14:
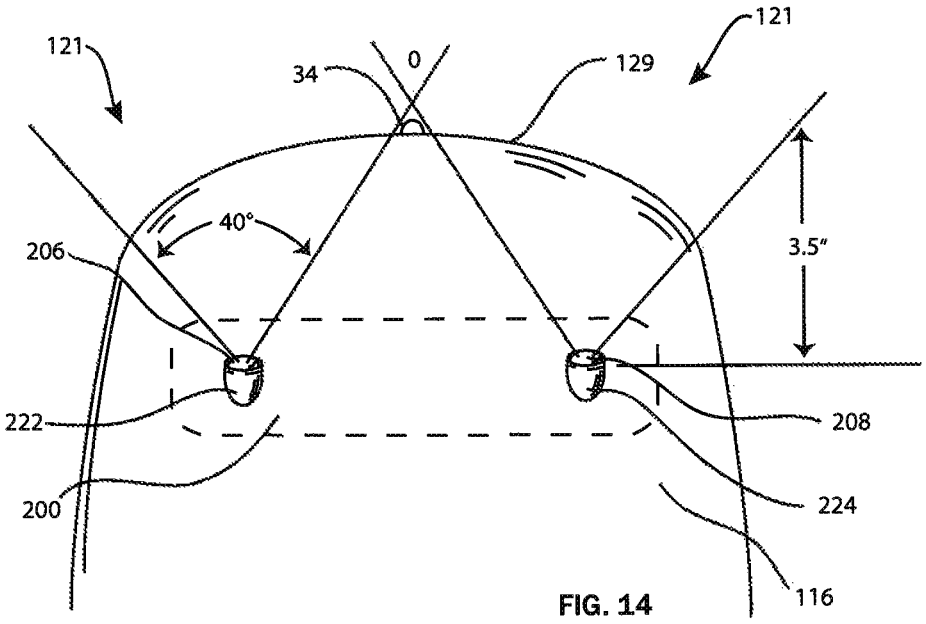
FIG. 14 is a bottom plan view of the brim having LEDs received in the light holder that is attached to brim covering material to provide illumination in a downward direction and having an LED mounted to the perimeter edge of the brim to provide illumination in a forward direction.

To provide illumination to a reading distance, the light holder 200 may be attached to the brim 116 and, in particular, the lower brim covering material 291 at a variety of locations relative to the brim perimeter edge 129. In one embodiment and referring to FIG. 14, the light holder 200 is remotely spaced from the perimeter edge 129 of the brim 116. In this example, the light holder 200 may be positioned on the brim 116 at an approximately a central position relative to a length and width of the brim 116. In another example, the length of the brim may be approximately 80 millimeters between the rear edge 27 and the front edge 129 along the brim's fore-and-aft axis B and the light holder 200 is positioned such that the light sources are spaced approximately 25 millimeters to approximately 28 millimeters from the front perimeter edge 129. The housings 222 and 224 holding the light sources 206 and 208 may be spaced a distance of approximately 35 millimeters to approximately 65 millimeters from one another and canted downward at an angle of approximately 15 degrees to approximately 40 degrees from the plate axis P of the mounting base 202. In this example, the light sources 206 and 208 are preferably LEDs each having a light cone 121 of approximately 20 degrees to approximately 40 degrees. In one example and still referring to FIG. 14, the light sources are spaced a distance of 65 millimeters and have light cones of 40 degrees. This configuration will provide optimal illumination at a distance of about 3 inches to about 30 inches from the light sources which is a distance just past the perimeter edge 129 of the brim 116 to a normal reading distance of a wearer. As shown in FIG. 14, the 40 degree light cones will generally overlap at a point O that is about 3 inches to about 8 inches from the light sources. At a distance less than about 3 inches from the light sources, dark shadows or dark, unlit areas are present between the light cones 121 that cause portions of objects viewed within that distance to be generally un-illuminated. It will be appreciated that the above dimensions and distances are only exemplary and can be varied as needed for particular applications. In addition, the light holder 200 could be configured to carry only one light source or more than two light sources.

Referring again to FIGS. 5 and 14, the high beam light source 34, 130 as described above may be attached adjacent to or at the perimeter edge 129 and be used in combination with the light sources 206 and 208 received in the light holder 200. The high beam light source 34, 130 may be positioned to extend from the perimeter edge 129 of the hat brim 116 to direct light forwardly of the wearer. By one approach, the high beam light source 34 may also be canted relative to the brim axis B at a cant angle θ2, but is canted over a smaller angle θ2 than the light sources 206 and 208 carried by the light holder 200. For example, the high beam light 34, 130 may be canted 0 degrees to about 15 degrees downwardly from the axis B, and preferably about 5 degrees to about 15 degrees. By one approach, the LED 34, 130 is positioned at the centerline of the brim 116. More specifically, the high beam light 34 may be a 20,000 MCD light emitting diode having about a 15 degree to about a 20 degree light cone that is canted downwardly from the brim fore-and-aft central axis B by about 5 degrees. Together, the high beam light source 34, 130 and the light sources 206 and 208 received in the light holder 200 may project illumination to different distances in a similar manner as described above.

Figure 15A:
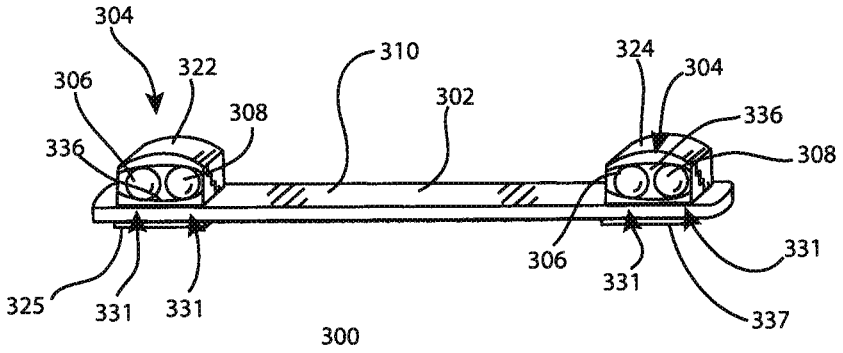
FIG. 15A is a perspective view of an alternative light holder having two housing portions each sized to receive two LEDs therein.
Figure 15B:
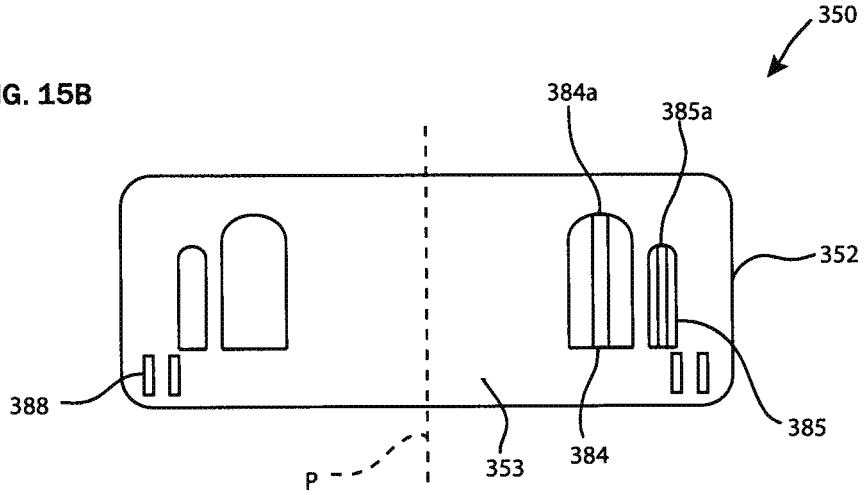
FIG. 15B is a top plan view of an alternative light holder having two housing portions each sized to receive two different sized LEDs therein.
Figure 15C:
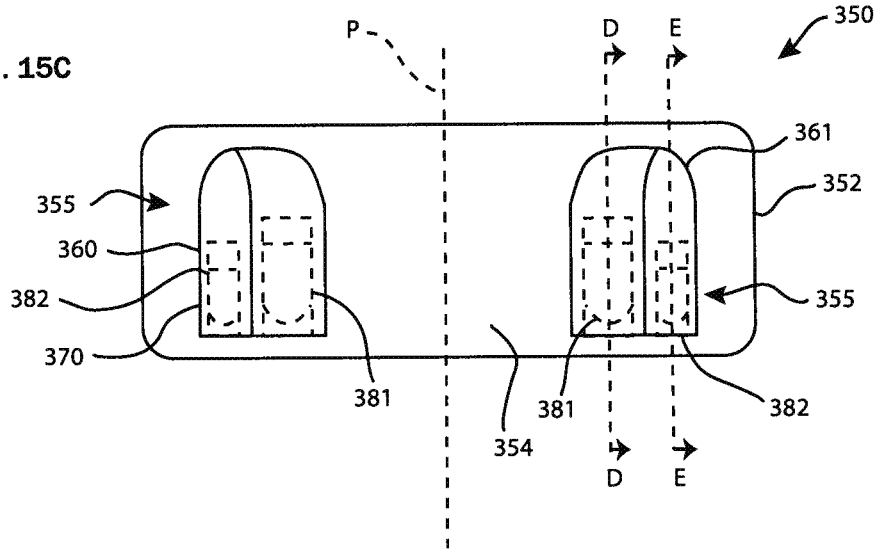
FIG. 15C is a bottom plan view of the light holder of FIG. 15B.

In another embodiment and referring now to FIG. 15A, an alternative light holder 300 is shown that includes a mounting base 302, similar to the mounting base 202 described above, with two holder portions 304. The holder portions 304 may include stand offs or protrusions 325 and 327 on one side of the mounting base 302 and housings or modules 322 and 324 on an opposite side of the mounting base 302 extending from a lower surface 310 of the mounting plate, similar to the holder 200 described above. The protrusions 325 and 327 and housings 322 and 324 are preferably laterally spaced from one another. The housings 322 and 324 may each have a body 336 having an interior sized to each hold and receive two separate light sources 306 and 308, where the light sources are preferably LEDs. By one approach, each body interior includes two cavities 331 that are each sized to receive one LED. Also, similar to the light holder 200 described above, each of the protrusions 325, 327 includes two openings (not shown) for each LED, so that a total of four openings extend through the housing 322 and 324 to the cavity 331, to receive the leads of the LEDs 306 and 308. The four openings will be configured to each receive a lead from the two LEDs 306 and 308 that are received in each housing 322, 324. The leads pass through the openings to an area that is exterior of the light holder 300 where the leads can then be electrically connected to a switch, circuit board, power source or other component by an electrical connection therebetween, such as wiring, traces, or other electrical paths. This configuration allows the housings 322, 324 to each receive and hold two or more LEDs in an orientation to direct beams of illumination in a forward and/or downward direction below the brim 116. Each housing portion 322 and 324 can fixedly hold one LED oriented to be the high beam light source such as at a small cant angle relative to the brim axis B, e.g. 10 degrees, with the other LED being fixedly held so that it is oriented to be the low beam or look down light source, e.g. at a 25 degrees cant angle to the brim axis B. In this manner, the low beam and high beam create a stereo effect for providing enhanced depth perception due to their spacing from each other across the base 302 in the spaced housing portions 322 and 324. Alternatively, each housing portion 322 and 324 can be configured so that they hold the LEDs in only one orientation, i.e., either high beam or low beam, both housing portions can be configured so that they all hold their respective LEDs therein at the same orientation such as in the low beam orientation, or the housing portions 322 and 324 can be configured so that each LED directs light along a different axis with respect to the brim axis B.

In another embodiment and referring now to FIGS. 15B-15J, an alternative light holder 350 is shown that is similar to the light holder 300 described above. The light holder 350 includes a mounting base 352 similar to the mounting base 302 described above having an upper surface 353 and a lower surface 354 and a fore-and-aft axis P. Two holder portions 355 extend downwardly from the lower surface 354. The holder portions 355 may include housings or bezels 360 and 361 spaced from each other and extending from the lower surface 354 of the mounting base 352. The bezels 360 and 361 may each have a body 370 with a neck portion 371 that extends away from the mounting base 352 and an angle thereto to space at least a portion of the body 370 from the mounting base 352 and create an undercut between the neck portion 371 and the mounting base 352. The body 370 is sized to receive and hold two separate light sources 372 and 373, where the light sources 372 and 373 are preferably LEDs. As previously described, the LEDs can project a cone of light along an axis. In one form, the LED 372 can be a 5 mm LED for projecting an approximately 10-15 degree cone of light, having an energy level of approximately 20,000 MCD, and the LED 373 can be a 3 mm LED for projecting an approximately 40 degree cone of light having an energy level of approximately 10,000 MCD; however, other LED sizes can also be used. The body 370 can include two distinct cavities 381 and 382 that are each sized to receive a LED with a dividing wall 383 separating the cavities 381 and 382. The cavities 381 and 382 have a common outer wall **370*a* extending therearound. The common outer wall 370*a*** includes a first cavity annular wall portion 381*a* extending about the first cavity 381 and second cavity annular wall portion 382*a* extending about the second cavity 382. As mentioned previously with respect to other light holder embodiments, the LEDs can be recessed within the cavities 381 and 382 to block incident light from the LED.

Figure 15D:
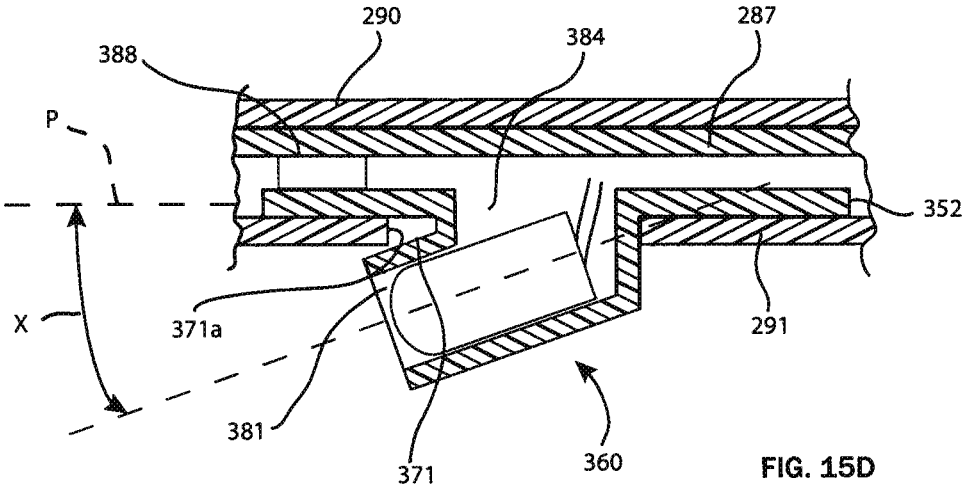
FIG. 15D is a side cross-sectional view taken along the line D-D of FIG. 15C showing a first cavity and a first angle of inclination of the first cavity relative to a fore-and-aft axis of the a mounting base of the light holder.
Figure 15E:
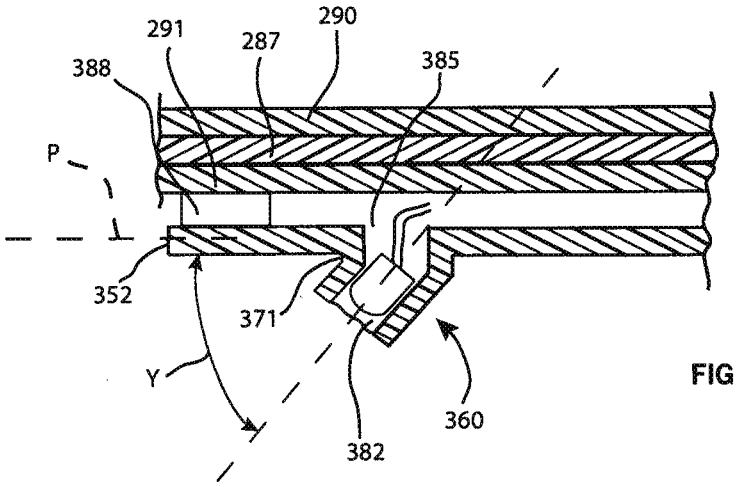
FIG. 15E is a side cross-sectional view taken along the line E-E of FIG. 15C showing a second cavity and a second angle of inclination of the second cavity relative to the mounting base axis.

In one form, the first cavity annular wall portion 381*a* has an inner diameter that is larger than the inner diameter of the second cavity annular wall portion 382*a*. In one form, the inner diameter of the first cavity inner wall portion 381*a* is about 5 mm, and the inner diameter of the second cavity inner wall portion is about 3 mm; however, other diameters could also be used. As previously mentioned above, in one form, the cavity 381 and LED therein for the high beam illumination is larger than the cavity 382 and LED therein for the low beam illumination. This larger size allows for generally brighter illumination as well as illuminating farther distances from the light holder 350 when compared to a smaller LED. For instance, the large LED can be a 20,000 MCD light source, with the small LED being a 10,000 MCD light source; however other LED energy levels could also be used. Furthermore, the smaller LED is both thinner and shorter than the larger LED. The shorter length allows the smaller LED, which is canted at a greater angle relative to the mounting base axis P than the larger LED, to be received within the body 370 of the bezels 360 and 361 while allowing the body 370 to have a streamlined appearance. The openings 384 and 385 corresponding to the larger and smaller cavities 381 and 382 can also be larger and smaller, respectively. For example, the larger and smaller cavities 381 and 382 can have a substantially constant diameter. In another form, the cavities 381 and 382 can have substantially the same diameter as the LEDs received therein (FIGS. 15I and 15J).

The cavities 381 and 382 of each of the bezels 360 and 361 can have different angles of inclination relative to the fore-and-aft axis P of the mounting base 352. For example, one cavity 381 can fixedly hold one LED oriented to be the high beam light source, while the other cavity 382 can fixedly hold one LED oriented to be the low beam light source so that the bezel 360 projects two cones of light from the LEDs at different angles of inclination relative to the axis P, as described above.

Figure 15F:
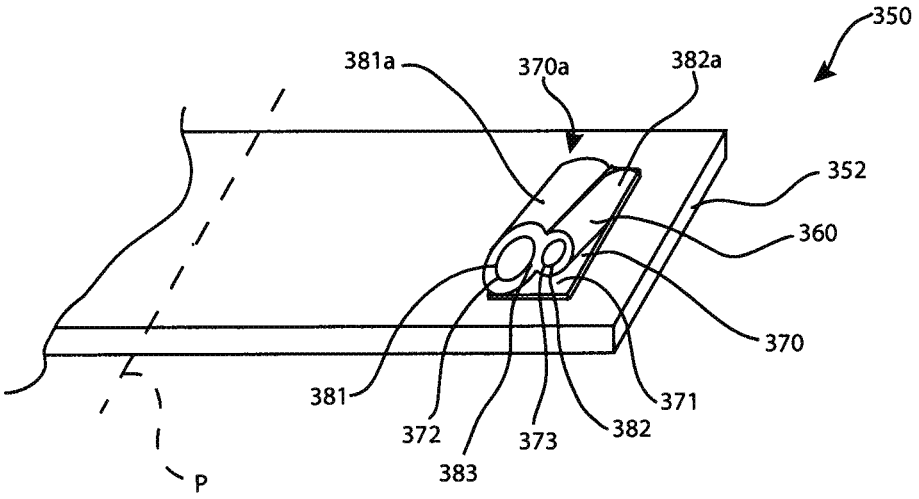
FIG. 15F is a partial perspective view of the alternative light holder of FIG. 15B showing the housing body and the different sized LEDs.
Figure 15G:
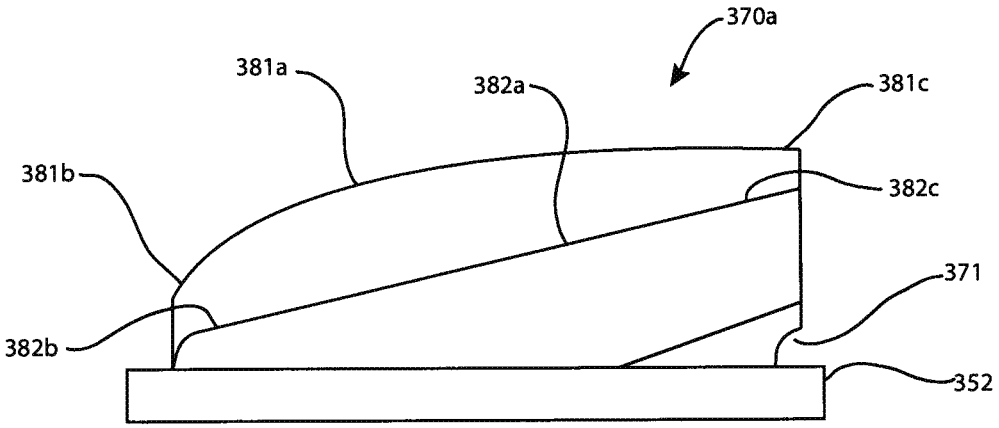
FIG. 15G is a side view of the alternate light holder of FIG. 15B showing the housing body.
Figure 15H:
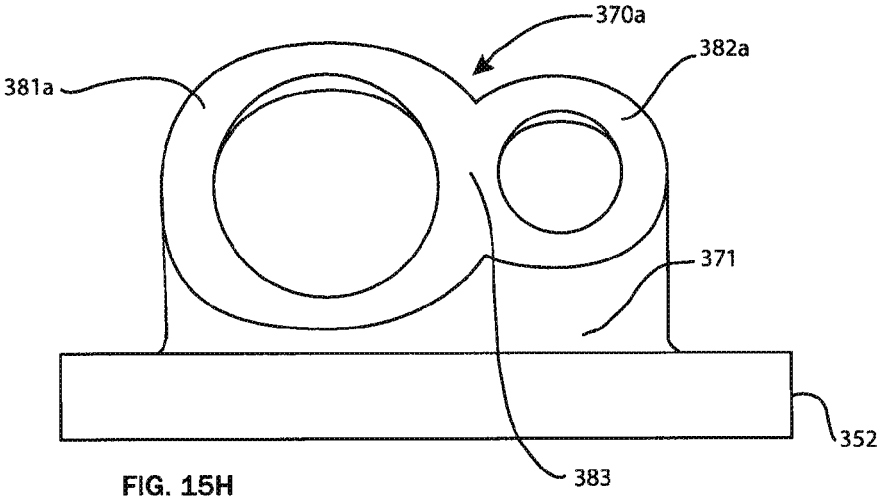
FIG. 15H is a front view of one of the housings of the light holder of FIG. 15B showing the housing body and the different sized LEDs within different sized cavities.
Figure 15I:
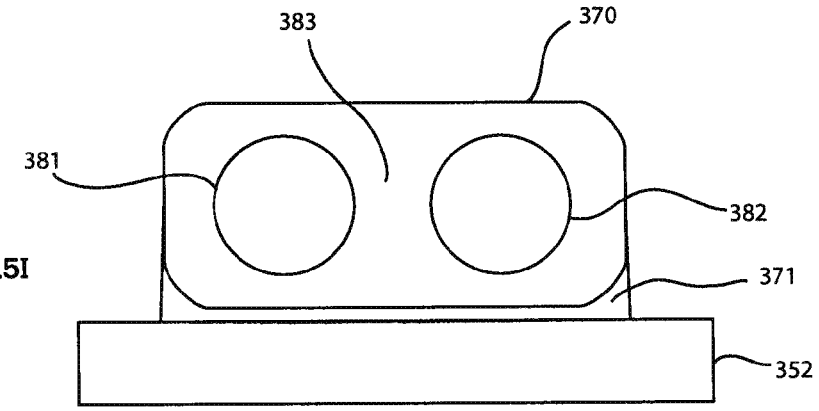
FIG. 15I is a front view of an alternate body configuration of one of the housings of the light holder of FIG. 15B.
Figure 15J:
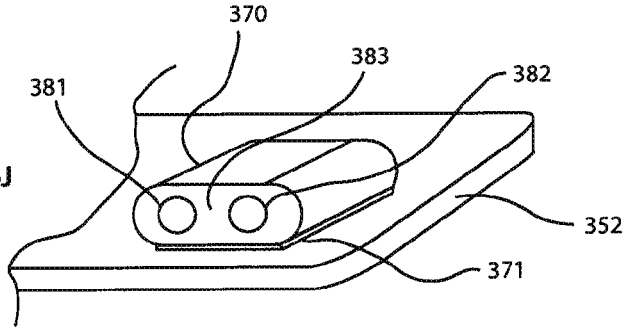
FIG. 15J is a perspective view of the housing of FIG. 15I.
Figure 16:
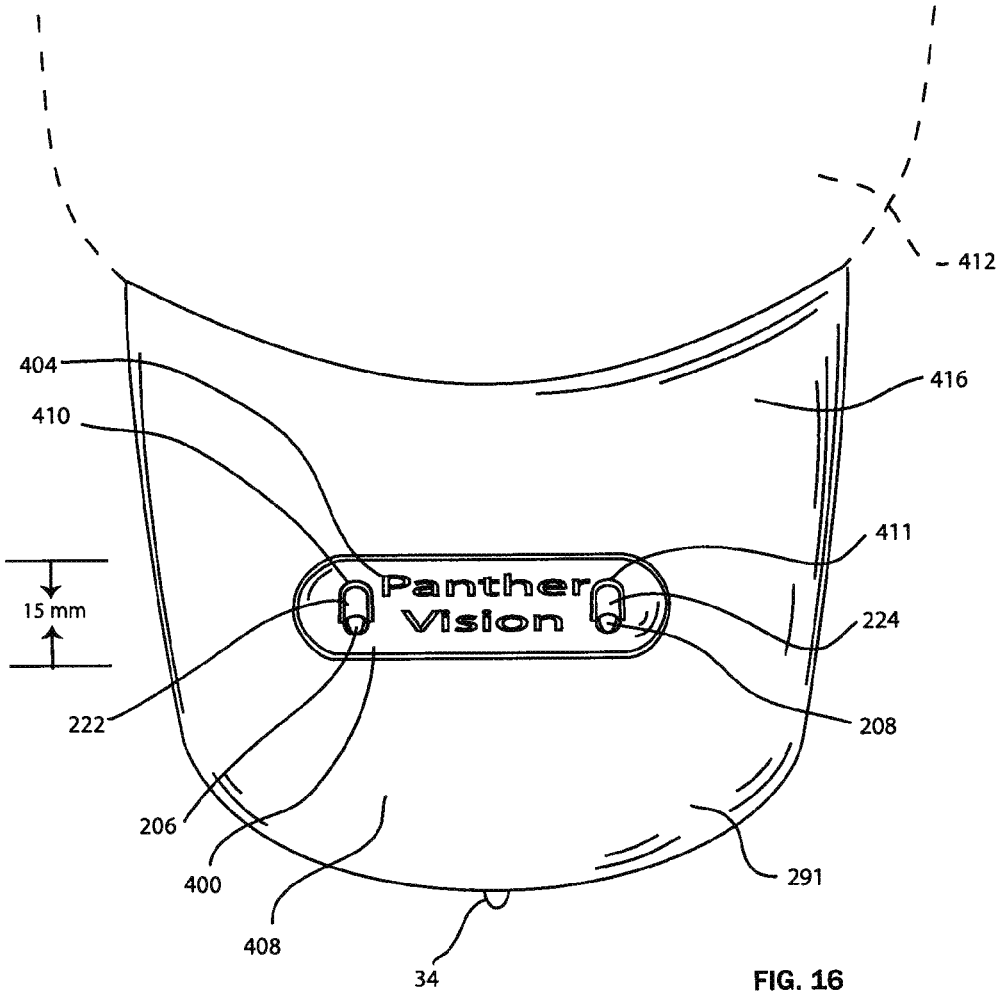
FIG. 16 is a bottom plan view of a mounting patch at the bottom of the brim with the annular housing portions of the light holder partially protruding through openings in the mounting patch.

As shown in FIGS. 15F and 15G, the first and second cavity annular wall portions 381*a* and 382*a* can have different the outer profiles. The first and second cavity annular wall portions 381*a* and 382*a* have rearward ends 381*b* and 382*b* and forward ends 381*c* and 382*c*. In the illustrated form, the second cavity annular wall portion 382*a* projects away from the mounting base 352 at a generally constant angle of inclination so that the wall portion 382*a* has a varying predetermined height from the mounting base 352, and the first cavity annular wall portion 381*a* has a curved profile at the rearward end 381*b* and a generally constant height extending from the from the rearward end 381*b* to the forward end 381*c*. As such, more of the first cavity annular wall portion 381*a* projects beyond the second cavity annular wall portion 382*a* at or adjacent the rearward ends 381*b* and 382*b* than at the forward ends 381*a* and 382*c*. The annular wall portions 381*a* and 382*a* have heights relative to the mounting base 352 that generally conform to the angles of inclination of the first and second cavities 381 and 382.

In another form, the annular wall portions 381*a* and 382*a* can have the same outer profiles, so that the common outer wall 370*a* has a consistent outer profile. In this form, the cavities 381 and 382 can each have the same inner diameter for receiving the same sized LED, while maintaining different angles of inclination as described above. In another form, the cavities 381 and 382 can be oriented to have the same angle of inclination.

In one form, the two bezels 360 and 361 extend from the mounting base 352 having a generally mirrored configuration such that the smaller and more downward oriented cavities 382 and the LEDS therein are located outboard of the larger cavities 381 and the LEDs therein. However, the smaller LEDs could also be inboard of the larger LEDs. Furthermore, the larger LEDs could be configured to be the low beam LEDs with the smaller LEDs configured to be the high beam LEDs. Thus, when the two bezels 360 and 361 extend from the mounting base 352, the light holder 350 has four total LEDs for providing illumination to areas both near and far. By way of a non-limiting example, the high beam LED 372 can be oriented to have an angle of inclination X of about 7-7.5 degrees from the mounting base axis P, while the low beam LED 373 can be oriented to have an angle of inclination Y of about 25-40 degrees from the mounting base axis P. These angles of inclination are merely illustrative and not limiting; other angles of inclination could also be used. By having both the high beam and low beam LEDs received within the light holder 350, the brim 116 can be free of LEDs mounted at the perimeter edge or upper surface thereof, thereby providing for a more concealed and streamlined appearance of the hat.

In another form, the light holder 350 can include a single bezel 360 mounted along the mounting base axis P. The bezel 360 can include two cavities 382, each canted and sized to receive a low beam LED 373 similar to the above, so that the bezel 360 can project two cones of light downwardly at approximately 25 degrees relative to the mounting base axis P. Of course, other angles of inclination could also be used. In other forms, the single bezel 360 can be used with the various approaches mentioned above having different cavity sizes, angles of inclination, or combinations thereof. The mounting base 352 could also include more than two bezels.

The bezels 360 and 361 each include two distinct openings 384 and 385 in the upper surface 353 of the mounting base 352 that each correspond to the two distinct cavities 381 and 382 of each of the bezels 360 and 361. The two openings 384 and 385 are configured to receive the leads from each of the two LEDs that are received in the cavities 381 and 382 of each of the bezels 360 and 361. The leads pass through the openings 384 and 385 to an area exterior to the light holder 350 where they can be electrically connected to a switch, circuit board, power source or other component by an electrical connection therebetween, such as via wiring. The openings 384 and 385 may each include a dividing rib 384*a* and 385*a* therein that bisects each of the cavities 381 and 382 adjacent the corresponding opening 384 or 385 for keeping the leads of the LED within the cavity 381 or 382 separate to provide for easier coupling to the wiring of the electrical components. The upper surface 353 of the mounting base 352 is generally flat so that the upper surface 353 can sit relatively flush to the brim insert 287 or the covering material 291, depending on whether the light holder 350 is installed on the outside of the covering material 291 or the inside of the covering material 291.

Alternatively, the mounting base 352 can also include a plurality of standoff ribs 388 extending from the upper surface 353 of the mounting base 350. These ribs 388 can aid in spacing the upper surface 353 of the light holder 350 from the surface of the brim 116 to which the light holder 350 is mounted. By spacing the light holder 350 from the mounting surface of the brim 116, the leads from the LEDs and any electrical connections thereto can run along the upper surface 353 of the mounting base 352 between the light holder 350 and the brim 116. The ribs 388 can be relatively the same height as the electrical wires that connect to the light holder 350; however, the ribs 388 can also have greater heights to create larger spacing for accommodating additional adhesives or other materials between the light holder 350 and the brim 116. The generally flat surface configuration of the upper surface 353 of the mounting base 350 and/or the standoff ribs 388 are not limited to the embodiment of light holder 350 and can be applied to other light holder embodiments described herein.

The features and configuration of the light holder 350 described above may be used in combination with other light holder embodiments described herein. Furthermore, the light holder 350 may be mounted to the brim 116 in the variety of ways described herein with respect to other light holder embodiments, such as internally with the mounting base 352 between the covering material 291 and the brim insert 287 (FIG. 15D) or externally with the covering material 291 between the mounting base 352 and the brim insert 287 (FIG. 15E). As shown in FIG. 15D, when the mounting base 352 is mounted between the covering material 291 and the brim insert 287, the covering material 291 includes at least one opening 371*a* sized to receive the body 370 and neck portion 371 therethrough. The covering material 291 can include multiple openings 371*a* to accommodate a light holder 350 with multiple bezels 360 or 361.

In another example and referring to FIGS. 16-20, a lighted hat 412 is shown having a brim 416 with a covering portion or mounting patch 400 extending along a section of the brim 416 to provide a discrete surface to which the light holder 200 can be mounted. The mounting patch 400, therefore, may be provided on the lower brim covering material 291. The mounting patch 400 may be slightly larger than the footprint of the light holder 200 described above to provide a surface on which the entire mounting base 202 can be received. In one example, the mounting patch 400 may be an elongate area having a racetrack configuration of embroidered stitching, one or more additional fabric layers, or one or more fabric layers having an elongate embroidered portion thereon. Preferably, the mounting patch 400 is embroidered stitching extending through the covering material 291 to form the covering patch portion 400 on both sides of the lower brim covering material 291. In another example, the patch 400 may be silk screen paint, an ironed on patch, a double layered fabric or paper material, or any other material creating a larger, rougher, or stiffer portion of the brim 416. The patch 400 may be stitched to the fabric material 291 to form a thicker portion of the brim 416, but still be in a thin or flat configuration thereby allowing the lighted hat 412 and specifically the brim 416 of the hat 412 to maintain its natural streamlined appearance. For example, the thickness of the lower layer 291 of fabric material can be approximately less than 0.5 mm and the thickness of the embroidered patch portion 400 can be approximately 1 mm.

Figure 17:
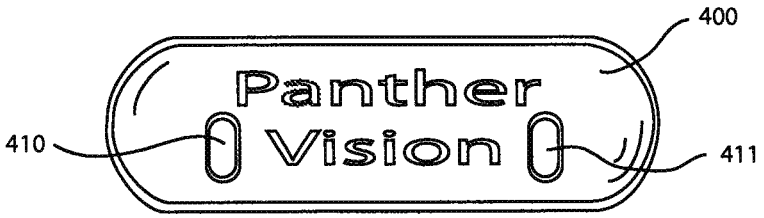
FIG. 17 is a bottom plan view of an embroidered mounting patch portion of the brim showing indicia sewn in its lower surface.

Preferably and as shown in FIG. 17, the mounting patch 400 is formed of embroidered stitching that forms an outer surface 404 with a stiffened, textured, or roughened surface characteristics formed via a plurality of adjacent and tightly packed stitches, needlework, other stitching to form the patch 400 thereof of yarn or thread. The outer surface 404 can include alphanumeric or graphical content, such as a logo or insignia to mark the name of a company or producer of the product. The stitching of the embroidery preferably extends through the fabric 291; thus, the mounting patch 400 also has an embroidered inner surface 406 that can include similar tightly packed stitches, needlework, or other stitching to form an inner stiffened, textured, or roughened surface consistent with the characteristics of embroidery or other needlework or stitching techniques. The inner surface 406 sits below and spaced from a lower major surface 408 of the brim 416 and provides an enhanced mounting surface for receipt of the light holder 200 described above. The textured inner surface 406 may provide more stability for attaching the mounting base 202 of the light holder 200 thereby creating a more secured attachment to the covering material 291 of the brim (which is preferably fabric) to prevent against any unwanted shifting or sliding of the light holder 200 during operation. By way of example, the embroidered stitching can have a stitch density of approximately 1800 stitches per square inch with threads that are approximately 0.005 inch thick.

Figure 18:
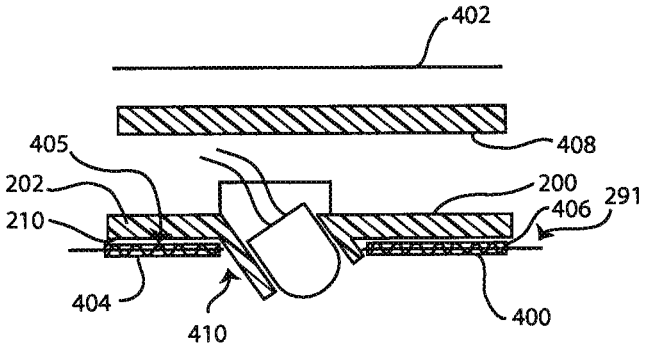
FIG. 18 is a side cross-sectional view of the brim having an embroidered portion of non-wicking material with the light holder adhered thereto.

The light holder 200 may be attached to the inner or inward oriented surface 406 of the mounting patch 400 by adhesive, sewing, stitching, ultrasonic welding, heat welding, or other fastening mechanisms. In one example, the light holder 200 is attached by adhesive 405, such as a hot melt glue or cyanoacrylate, placed between the lower surface 210 of the mounting base 202 and the inner surface 406 of the mounting patch 400 to provide a secure attachment between the light holder 200 and the preferable fabric material covering the brim, as best shown in FIG. 18. Commonly, material used for the brim covering material 291 in baseball style hats is a fabric that tends to have wicking properties that transfer liquids or fluid through the material by the process of capillary action. Thus, if liquid adhesive is used to mount the light holder 200 directly to the fabric, the adhesive (which may be heated to a generally liquid state for fastening the light holder 200 to the brim covering material 291) will also wick through the brim covering material 291 and transfer by capillary action through the material 291 to an outer section of the brim covering material 291 that generally corresponds to the area that the light holder 200 is attached to. This may result in an undesirable stain or blemish on an outside section of the brim covering material 291.

The mounting patch 400, on the other hand, provides a surface to mount the light holder 200 that is configured so that the adhesive will generally not wick therethrough or is thick enough so that the adhesive cures or solidifies before is reaches the outer surface 404 thereof. In one example, the mounting patch 400 may be a non-wicking thread, yarn, paper, or other fabric material, such as the tightly stitched embroidered patch, which is effective to keep the outer surface 404 generally free of the adhesive such that there are no stains or blemishes on the outer surface 404 or another outside section of the brim covering material 291. The patch 400 may also be thicker than the brim covering material 291 or have multiple layers so as to block the liquid adhesive from passing through the material 291 to the outer surface 404. If the surface 400 is thicker than the brim material 291, as mentioned above, the adhesive may harden and cure before it has time to reach the outer surface 404. Moreover, in the example where the light holder 200 is sewn or stitched to the brim, use of the mounting patch 400 may adequately conceal the sewing marks or stitching on the outer surface 404 due to its increased thickness thereby presenting a more aesthetic appearance.

The mounting patch 400 also has openings 410 and 411 sized and arranged to allow the housings 222 and 224 of the light holder 200 to pass therethrough to a location below the brim 416. The light holder 200 may be attached to the patch 400 where the lower surface 210 of the mounting base 202 engages with the inner surface 406 of the patch 400 and is attached thereto by the thin layer adhesive 405 described above (FIG. 18) so as to allow the brim 416 to maintain a thin and natural appearance. The openings 410 and 411 may be aligned with brim covering openings 294 and 295 thereby providing a complete passageway from an area located in the brim 416 (from the brim space 296) to an area located exterior and below the brim 416. This configuration allows the annular housings 222 and 224 to pass at least partially through both the openings 294 and 295 and the openings 410 and 411 so as to allow illumination to be provided from the light sources 206 and 208 secured in the annular housing 222 and 224.

Figure 20:
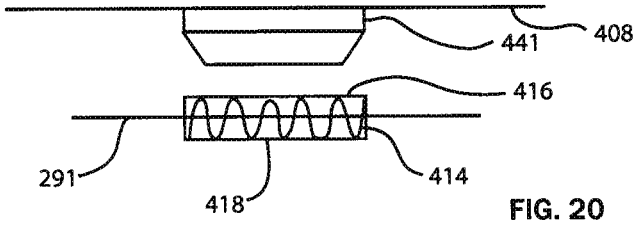
FIG. 20 is a fragmentary, side cross-sectional view of the embroidered portion covering the activation switch of FIG. 19.
Figure 19:
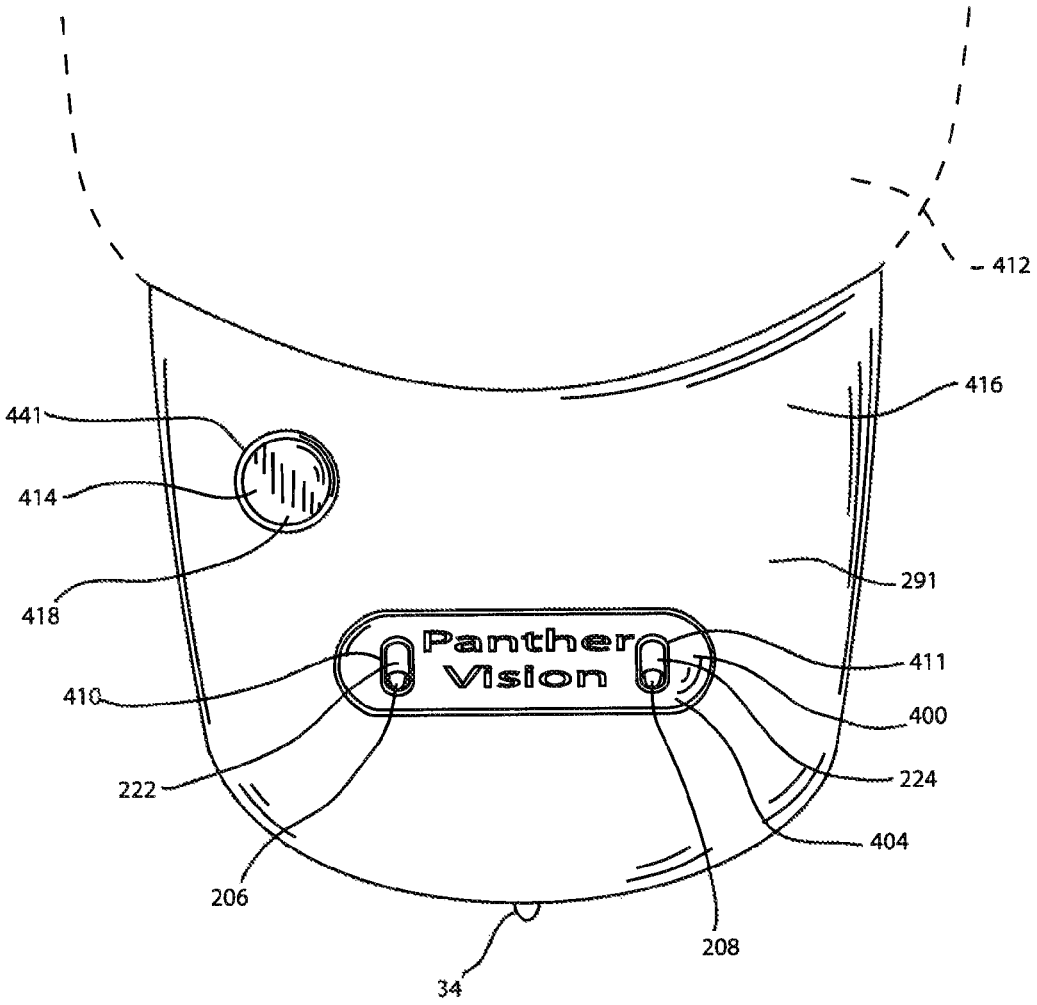
FIG. 19 is a bottom plan view of the brim including the embroidered mounting patch portion and another embroidered portion on the bottom of the brim identifying the location of an activation switch therein.

Referring to FIGS. 19 and 20, the brim 416 may also include an activation switch 441 mounted thereto. The brim covering material 291 may also include a switch covering portion 414 that may include features and characteristics similar to the mounting patch 400 discussed above. By one approach, the switch covering 414 may be generally circular and sized to overlap the activation switch 441 contained within the brim and covered by the brim fabric 291. The switch covering 414 may be formed by embroidered stitching that extends through the brim material 291 to form an inner surface 417 and an outer surface 418 (on opposite sides of the lower brim cover material 291) that both have textured or roughened surfaces similar to those discussed above with the patch 400. In this example, the activation switch 441 may be a pushbutton switch having an actuator in the form of a plunger capable of being depressed to activate at least one light source to an illuminated state. The plunger may be depressed again to deactivate a light source that is currently in the illuminated state or to change the state of any other light source that is in electrical communication with the components of the lighted hat 412. The activation switch 441 may be located between the brim covering material 291 and a lower major surface 408 of the brim insert. Without the switch covering 414, a user may have difficulty finding the location of the activation switch 441 and the plunger thereof when the switch 441 is covered by the brim covering material 291. This can cause a user to push on a portion of the brim covering material 291 that is not in general alignment with the plunger of the activation switch 441. In addition, a user may push the brim covering material 402 so as to contact the plunger of the activation switch 441, however, the brim covering material 402 will slide across the plunger without actually causing the plunger to be depressed since the area of the brim being pushed is not generally aligned with the switch plunger. With the greater rigidity provided by the thicker, embroidered switch cover 414, perfect alignment with the switch plunger is less important as long as the user pushes on the switch cover 414 to shift it toward the brim insert since the more rigid switch cover 414 will still depress the switch plunger.

The outer surface 418 of the switch cover 414 may have a similar textured surface as described when discussing the outer surface 404 of the mounting patch 400. The texture of the outer surface 418 provides the user with an indication of the location of the plunger of the activation switch 441 by finger touch. In one example, a user only needs to run a finger along the relatively smooth brim covering material 291 until it runs across the textured outer surface 418 thereby indicating to the user where the activation switch 441 is located. Moreover, the texture of the outer surface 418 provides more traction for a user's finger making it more difficult for the finger to slip off or shift from the outer surface 418 while attempting to depress the activation switch 441. Likewise, the inner surface 416 has a similar texture as described when discussing the inner surface 406 of the mounting patch 400. In one example, the plunger of the activation switch 441 is mounted in the brim 416, such as to the insert, to be spaced from the inner surface 417 in the brim 416. As a user presses on the outer surface 418, the brim covering material 291 moves to contact the plunger of the activation switch 441. The texture of the inner surface 417 provides a roughened surface to contact the plunger thereby allowing the plunger to be more easily depressed while keeping the plunger from sliding or shifting away from the brim covering material 291.

Figure 21:
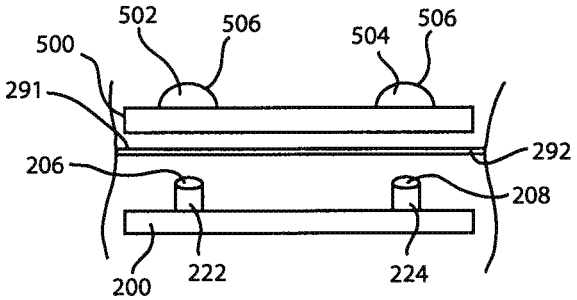
FIG. 21 is an elevational view of a light holder cover having a base plate including two projections spaced from one another for receiving the two housing portions of a light holder and for being fastened through brim covering material to the light holder.
Figure 22:
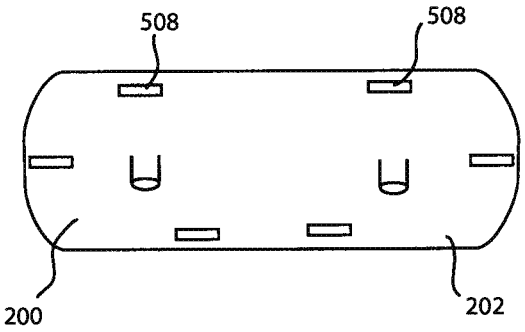
FIG. 22 is a plan view of the light holder capable of being received by the light holder cover of FIG. 21 having slots configured to accept staples to secure the light holder to the light holder cover through the brim covering material.

Turning to an additional example and referring to FIGS. 21 and 22, a light holder cover 500 may be used to help secure and/or conceal the light holder 200 to the brim fabric 291. The light holder cover 500 may be made of a flexible plastic or rubber material and include projections or hoods 502 and 504 positioned to receive the housings 222 and 224, respectively, of the light holder 200. Each projection 502 and 504 includes an opening 506 to allow illumination from the light sources 206 and 208 to illuminate a distance below the brim 116 and near the wearer. The light holder cover 500 could also be of aluminum or other heat dissipating material.

The light holder cover 500 will preferably be fastened to an outside section of the brim covering material 291, but may be fastened to the light holder 200 or the housings 222 and 224 thereof. For example, the light holder 200 may have slots 508 located on the mounting base 202 and configured to receive staples. In this example, staples may be inserted through portions of the light holder cover 500, the brim covering material 291, and be received securely through the slots 508 of the light holder 200 in a sandwich assembly. Such construction securely fastens the light holder 200 to the cover 500 with the brim covering material 291 in a sandwiched configuration between the light holder 200 disposed at the inside surface 292 of the brim covering material 291 and the light holder cover 500 disposed at the outside surface of the brim covering material 291.

In another example, the light holder 200 may be connected to the light holder cover 500 by sewing or stitching the light holder 200 to the light holder cover 500 with the brim covering material 291 sandwiched therebetween. In still another example, the light holder 200 may be attached to an outside section of the brim covering material 291, and the light holder cover 500 may then be attached directly to the light holder 200 or cover 291 via an adhesive, glue, sewing, stitching, ultrasonic welding, staples or other fastening mechanisms. The rubber or flexible material of the cover 500 helps provide a strong and flexible housing for the light holder 200 and helps protect the light sources contained therein from damage caused by any contact while still allowing the light sources to provide illumination at a location forwardly and below the brim 116.

Figure 23:
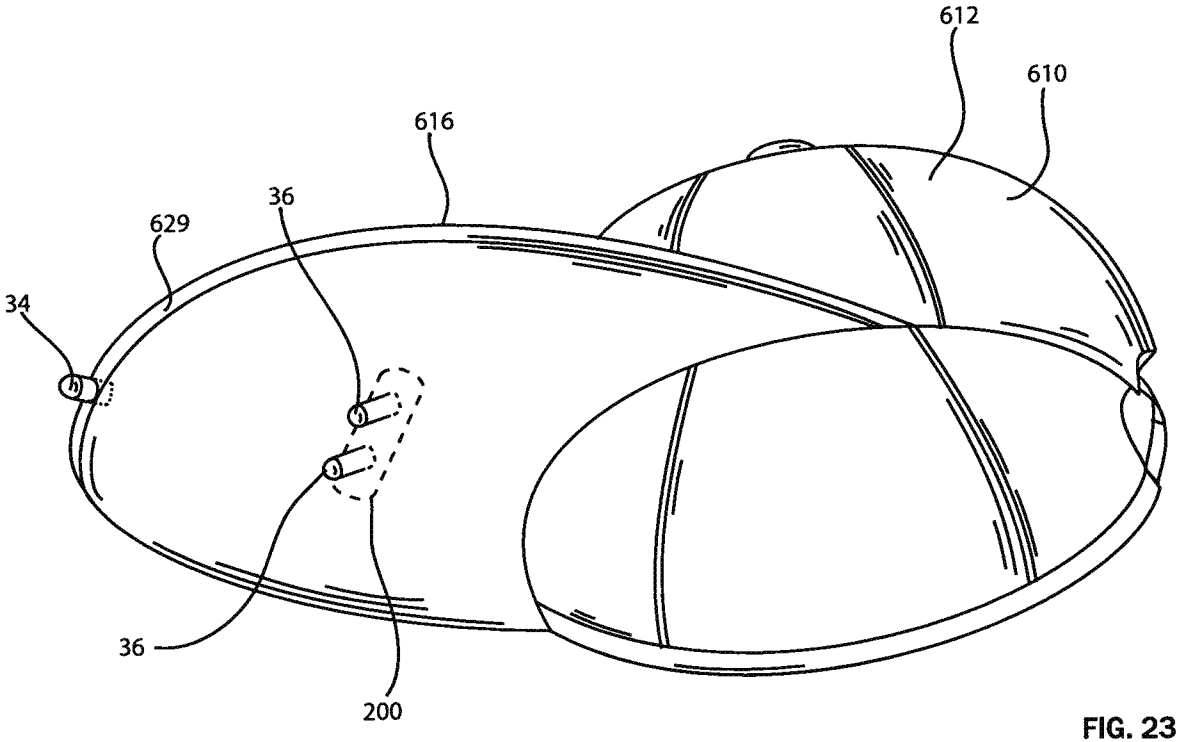
FIG. 23 is a bottom perspective view of a lighted baseball hat having a brim and a light holder integrally attached thereto as a one-piece body and configured to provide illumination in a direction below the brim.

Referring now to FIG. 23, another embodiment of a lighted headgear 610 is shown having a crown 612 and a brim portion 616 having light sources configured to provide illumination in a generally forward direction. The brim portion 616 may contain a high beam light source 34 disposed at a perimeter edge 629 thereof configured to provide illumination in a generally forward direction. The high beam light source 34, is preferably an LED configured to be at least partially recessed in the brim portion 616, as described above, so as to be substantially concealed and thereby maintain the natural and streamlined appearance of the lighted headgear 610. A low beam light source 36 may be disposed at a location underneath the brim 616 to provide illumination in a direction forwardly and below the brim 616 as described above. The low beam light source 36 may be LEDs received in the light holder 200 as generally described above. In this embodiment, the brim portion 616 and the light holder 200 thereon may be constructed of a substantially one piece body where the holder 200 is integrally attached or molded to the brim portion 616. A common method of manufacturing that could be used to provide this configuration may be an injection molding manufacturing process. This configuration generally provides an integral and strong light holder 200 fused below the brim portion 616 to provide illumination in a direction below the brim portion 616. In another example, the entire lighted hat 610 may be a one piece body that includes the light holder 200 and the high beam light source 34. This may provide added stability to the entire hat thereby making it more durable for a variety of different activities.

Referring to FIGS. 24-30, another exemplary form of lighted headgear 700 is illustrated including one or more light sources 702 configured to illuminate in multiple directions. The headgear 700, in the form of a baseball-type hat, is illustrated having a crown 704 and a brim 706 projecting forwardly from a lower, forward edge portion 708 of the crown 704. In this embodiment, the hat 700 is designed to provide illumination from the light sources 702 mounted to the brim 706, which are generally configured to direct illumination to at least two different directions and/or distances from the hat 700. The light sources 702 can have light cones with a range of about 15 degrees to about 40 degrees, as discussed above.

Similar to the light sources discussed with the previous embodiments, the plurality of light sources 702, which are preferably LEDs, can be configured and disposed on the lighted hat 700 to provide illumination in multiple directions. In the illustrated form, the brim 706 of the lighted hat 700 generally extends in a fore-and-aft direction along a brim axis B. The lighted hat 700 has at least one light source 703 positioned to direct light generally along the brim fore-and-aft axis B and at least one light source 705 mounted on the brim 706 to direct light at an angle relative to the brim axis B, such as along the axis T that extends downward from and transversely or obliquely to the brim axis B. In these embodiments, the light sources 702 are configured to illuminate objects in areas that are different distances away from the hat 700. For example, the light source 703 configured to emit light along the brim axis B will provide illumination upon an object or a location at a distance relatively far away from the wearer, such as approximately four feet to approximately six feet from the wearer, and the light source 705 configured to emit light at an angle to the brim axis B along the axis T will provide illumination upon an object or a location at a distance closer to the wearer, such as at a reading or working distance of approximately 3 inches to approximately 30 inches, without requiring the wearer to shift his head in any given direction. This configuration allows multiple distances to be illuminated simultaneously or at alternating times to thereby allow a wearer to see both objects at a distance and objects at a closer distance without substantial tilting or movements of the head or of the lighted hat 700 worn thereon.

In this form, the hat 700 includes an externally mounted light holder or hat lighting assembly 710 to house and/or receive at least one lower light source 705, and preferably two lower light sources 705, in a fixed orientation to direct light along the axis T to an area forwardly and below the brim 706. The external light holder 710 mounts to or adjacent an outer lower major surface 714 of the brim 706, so that the light sources 705 direct light generally away from the lower major surface 714 of the brim 706. The light holder 710 and components thereof may be made from a resilient and/or flexible material such as a rubber or plastic material so that the light holder 710 can conform and bend with the brim 706. The material used to make the light holder 710 may further be opaque such that light emitted from the light sources 705 substantially cannot pass therethrough to prevent stray light from getting into the eyes of a wearer of causing a glare in eyeglasses worn by a wearer.

Figure 24:
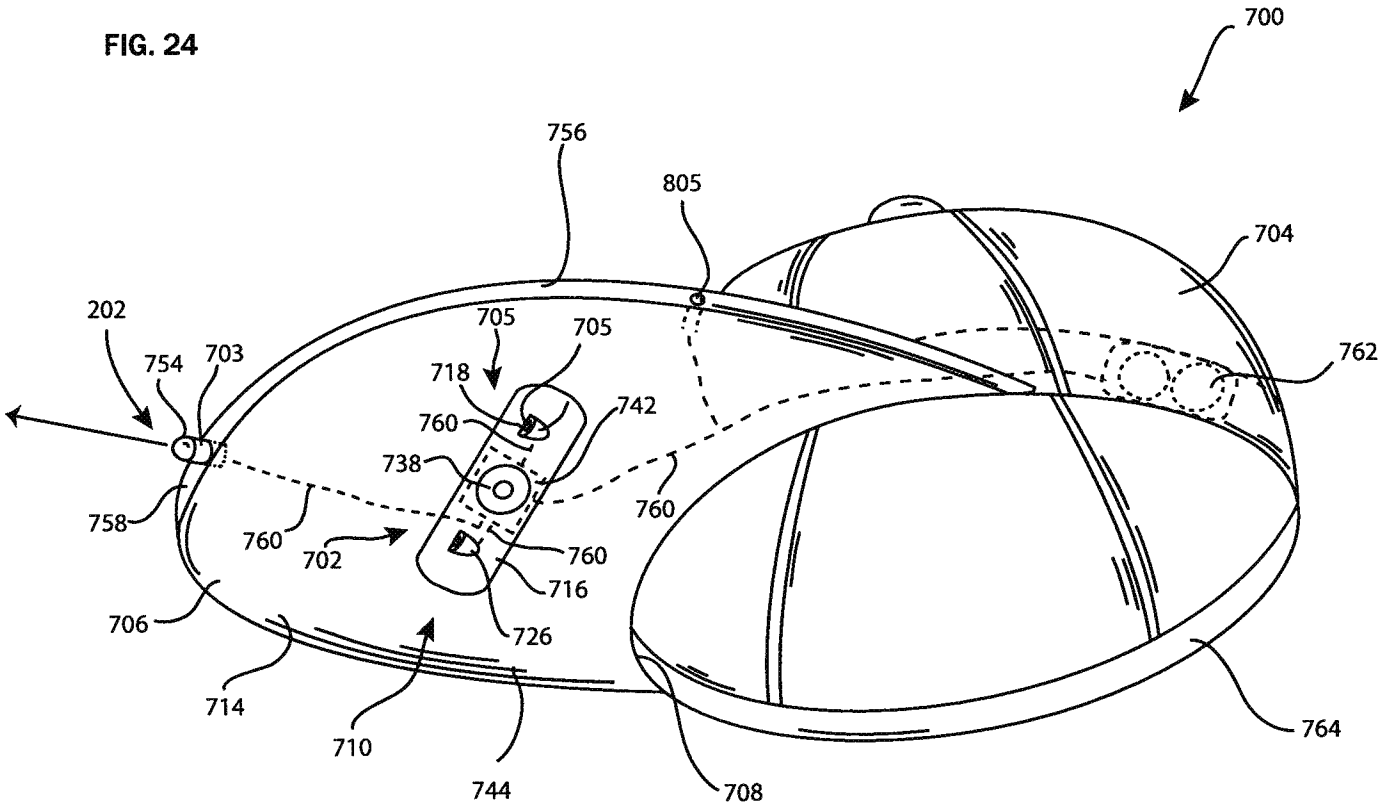
FIG. 24 is a bottom perspective view of a lighted hat showing a light holder housing LEDs at a bottom portion of the brim and an LED at a perimeter edge of the brim.
Figure 25:
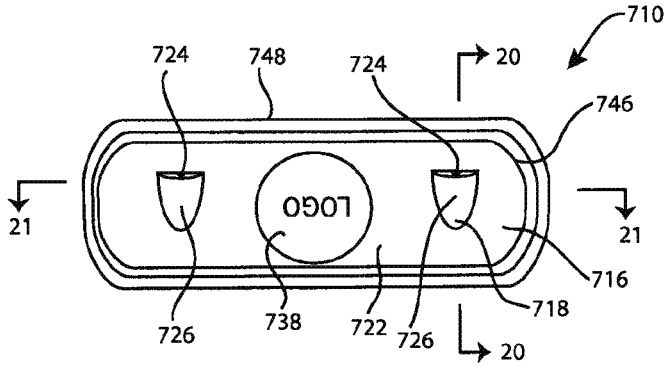
FIG. 25 is a bottom plan view of the light holder having two projections spaced from one another for receiving light sources, and a switch cover portion of the light holder.
Figure 26:
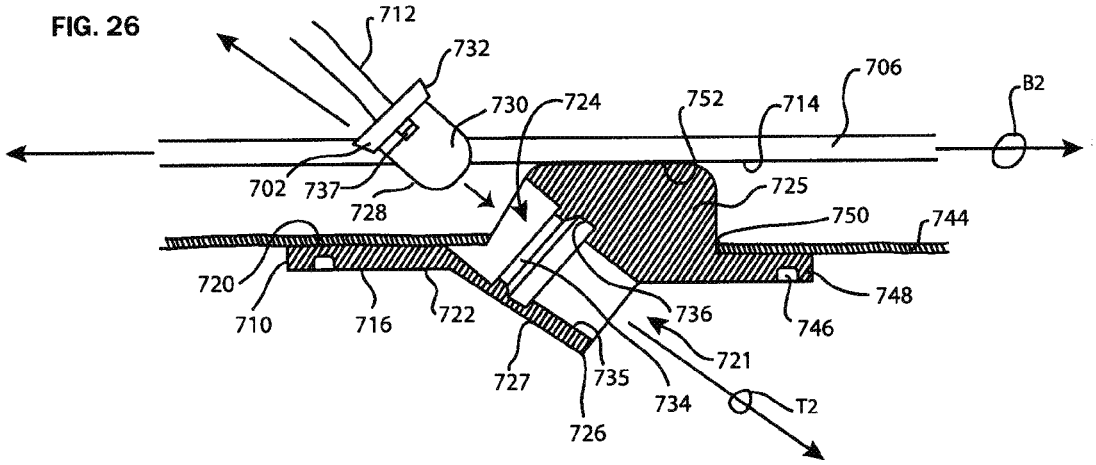
FIG. 26 is a side sectional view of the light holder of FIG. 25 showing the light holder attached to a hat brim with an offset to space the mounting base of the holder from the brim insert.

Referring to FIGS. 24-25, the external light holder 710 includes a mounting base 716 with an integral light holder portion 718. The mounting base 716 preferably has a generally thin and flat configuration, e.g. approximately 1 mm thick, to minimize the thickness of the mounting base 716 so that the brim 706, with the light holder 710 thereon, maintains a generally natural streamlined and thin appearance similar to a traditional brim. The mounting base 716 also includes an upper surface 720 configured to be positioned adjacent the outer lower major surface 714 of the brim 706 and a lower surface 722 configured to face an area below the brim 706. As discussed in more detail below, the upper surface 720 is attached to the outside of the covering material extending across the lower surface of the brim. By one approach, the upper and lower surface portions 720, 722 are generally rectangular with rounded ends to have a generally flat, racetrack configuration.

In the illustrated form, the holder portion 718 includes standoffs, offsets or ribs 725 projecting from the upper surface portion 720 (FIG. 26) and lighting housing portions or bezels 726 projecting from the opposite, lower surface portion 722, such as along the axis T discussed above. In one approach, the bezels 726 are in the form of a tubular housing having a cavity 724 therein for the light sources 705 with the axis T extending centrally therethrough. In one example, the axis T can meet the brim axis B at an angle in the range of about 15 degrees to about 40 degrees. The bezels 726 are configured to at least partially receive and support at least a bottom surface 728 of the light sources 705. As illustrated, the housing portions 726 project along the axis T to minimize the material projecting downward from the lower major surface 714 of the brim 706 to minimize interference with a wearer's field of view. Preferably, an inner surface of each cavity 724 is sized and has a profile to substantially match the shape of the light sources 705 such as the lenses of the LED's so that the light sources 705 are tightly held in a fixed orientation therein. By one approach, the bezels 726 are more rigid than adjacent portions of the mounting base 716.

In one form, the light sources 705 are LEDs with a lens portion 730 and a radially projecting annular flange 732 positioned rearwardly from the lens portion 730. The cavities 724 can include an annular projection 734 followed longitudinally by an annular groove 736 sized to receive and hold the flange 732 of the light source 705. The projection 734 is configured to flex to allow the flange 732 past during installation of the light source 705 in the cavity 724 and thereafter to return to shape to rearwardly support the flange 732.

By one approach, the bezels 726 may have a longitudinal length such that a wall 727 forming the bezels extends beyond the lens portions 730 of the light sources 705. In this configuration, the light cone of the light source 705 may partially intersect with an inside surface 735 of the cavity 724. This allows the cavity 724 to protect the light source 705 from damage if the lighted hat 700 is dropped. Additionally, this configuration provides more focused light from the LED and keeps stray light from reaching the wearer's eyes and interfering with the gaze of the wearer because a distal end 721 of the cavity provides a blinder or blinder device positioned between the LED 705 and the wearer's eyes. If the wearer has glasses on, such stray light reaching the lenses of the glasses can caused undesirable glare when the lights are turned on. Alternatively, the bezels 726 may have a longitudinal length that extends axially beyond an illumination generating component, such as a light chip 737 of the light source 705, but not beyond the lens portion 730. This configuration allows the light source 705 to provide a portion of more direct illumination to a location below the brim without substantial interference or reflection from the cavity 724 and also provides the blinder function as described above.

Figure 27:
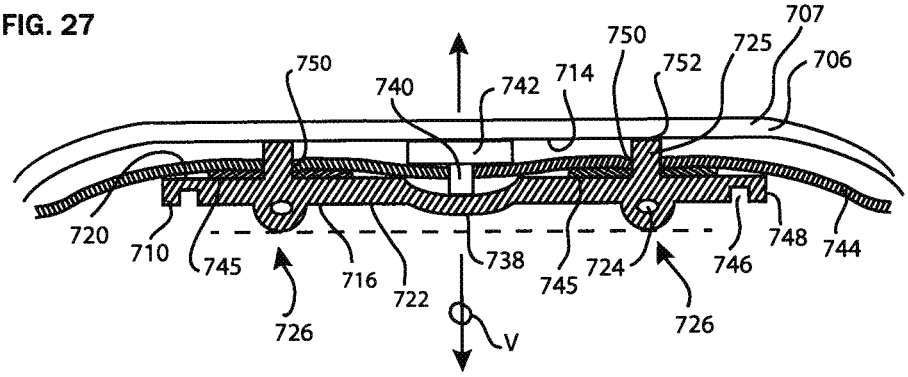
FIG. 27 is a front sectional view of the light holder of FIG. 25 showing a pair of offsets spacing the holder mounting base from the brim insert and including an arcuate configuration for the switch cover portion positioned adjacent a switch actuator.
Figure 30:
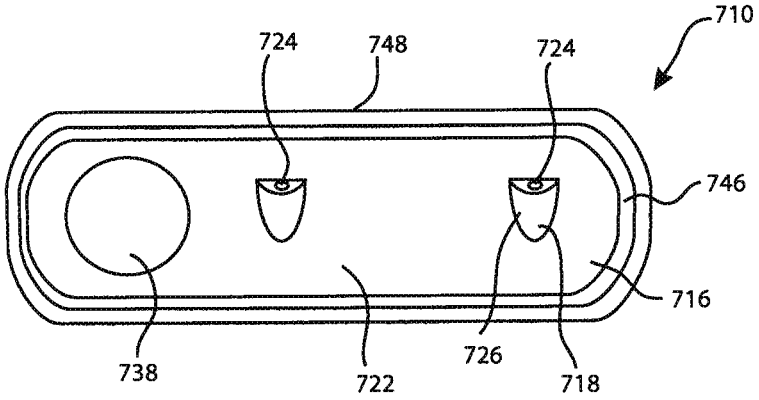
FIG. 30 is a top plan view of an alternative light holder having a different arrangement of the upwardly projecting offsets for receiving lights sources therein and the switch cover portion.
Figure 29:
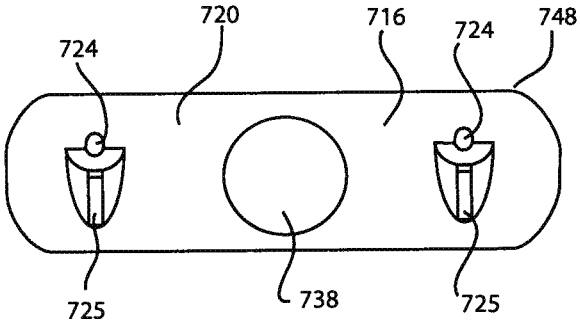
FIG. 29 is a top plan view of another light holder having a mounting base including two projections for receiving light sources and a switch cover portion with the projections including ribs as additional offsets.

The light holder 710 further includes a switch covering portion 738 (FIG. 25). The switch covering portion 738 can be positioned intermediate of the housing portions 726 along the base 716 as illustrated in FIGS. 25, 27, and 29, to one side of the housing portions 726 on the base 716 as illustrated in FIG. 30, or other suitable locations, such as generally in front or back of the housing portions 726. The switch covering portion 738 can be a portion of flexible outwardly curved or convex material, which can be utilized to identify the location of the hat switch 742 and/or to provide a space into which a pushbutton actuator 740 of the switch 742 can be located as shown in FIG. 27. The switch 742 then electrically connects to the light sources 705 to control power thereto. Preferably, the bezels 726 extend further down a vertical axis V that extends generally perpendicular to the brim axis B than the switch covering portion 738. Thus, the bezels 726 act as a switch guard to block in some cases, unintended activation of the switch because the bezel may stop an adjacent surface (such as a nested hat brim for example) from engaging the switch 742. This may also provide protection on sides of the switch 742 adjacent to the housing portions 726, such as against unwanted actuation of the switch 742 or damage to the switch 742 from dropping the hat or the like. Alternatively, the switch 742 can be spaced from the light holder 710, such as discussed above.

As previously mentioned, the external light holder 710 can be of rubber or elastomeric material. As such, the light holder 710 can be formed by molding which allows for indicia, such as a company brand or product name, to be readily molded into the lower surface 722 thereof. To this end, the switch covering portion 738 may further include alphanumeric and/or graphical content, such as a company trademark.

The light sources 705 disposed in the light holder 710 may be high intensity LEDs that output high intensity cones of light. In such an instance, the light holder 710 may further include a heat sink 745 therein, such as composed of aluminum, tin, or other conductive material to spread out the heat generated by the LEDs. The heat sink 745 may be in thermal communication with the LEDs and positioned around the cavities 724, sandwiched between the holder and brim, extending through portions of the mounting base 716, or in other appropriate locations in the hat brim.

Figure 28:
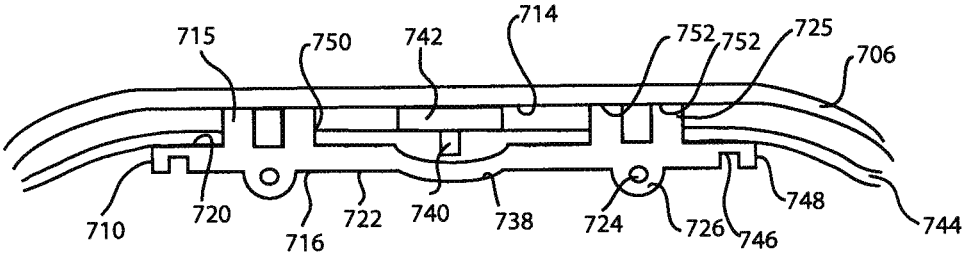
FIG. 28 is a front sectional view of an alternative light holder showing each offset in the form of a pair of rib projections to space the holder mounting base from the brim insert.

In this embodiment, the light holder 710 is attached to the outside of the lower major surface 714 of the brim 706, such as by stitching, staples, adhesive, welding, or the like, and more preferably to a outer covering material 744 disposed on the lower major surface 714 of the brim 706 as best shown in FIGS. 24, 26, 27, and 28. To this end, the light holder 710 may include a groove or channel 746 adjacent a perimeter edge 748 of the light holder 710. The groove 746 advantageously provides a thinner cross section through which a needle or staple may pass to secure the holder to the brim or, alternatively, substantially conceals threading, staples, or other mechanical fastening element from view because such fastener is received within the groove 746. Additionally, openings 750 (FIGS. 26, 27, and 28) may be provided in the covering material 744 through which the offsets or ribs 725 can extend so that the holder 710 (and in particular the holder base 716 thereof) can be mounted flush to the brim. Beneficially, the offsets 725 can include an upper shoulder 752 configured to abut or contact the lower major surface 714 of the brim 707, such as to space the mounting base 716 from the lower major surface 714 of the brim 707. The switch 742, discussed above, can then be positioned within this small space provided by the offsets 725 in alignment with the switch covering portion 738, as illustrated in FIGS. 27 and 28. FIG. 28 provides an alternative form in which the offsets include a pair of spaced ribs 725, which provides a more stable engagement of the holder 716 to the lower surface of the brim 706. FIG. 29 provides yet another alternative form of the offsets or ribs 725 where an upper portion of the bezels 726 extend through the base 716 and project beyond the upper surface 720. In this form, the ribs 725 are mounted to rear portions of the bezels 726.

Referring back to FIG. 24, the lighted hat 700 further includes at least one upper light source 754 mounted to a perimeter edge 756 of the brim 706, and preferably a front edge 758 of the brim 706, which may include a relatively narrow cone of light, such as about a 15 degree to a about 20 degree light cone. The upper light source 754 is positioned to extend from the perimeter edge 756 of the hat brim 706 to direct light forwardly of the wearer. The upper LED can be received in a central, forward notch of the brim 707 and be tightly engaged thereabove and therebelow by the upper and lower fabric covering material to be captured therebetween. By one approach, the upper light source 754 extends generally parallel to the brim axis B. By another approach, the upper light source 754 can be canted relative to the brim axis B from 0 degrees to about 15 degrees downwardly from the brim axis B, and preferably 5 to 15 degrees. More particularly, the upper light source 754 may be a 20,000 MCD light emitting diode having a 20 degree light cone that is canted downwardly from the brim axis B extending through the hat brim 706 by about 5 degrees. Together the upper light source 754 and the downward light sources 705 received in the light holder 710 may illuminate multiple distances.

As illustrated in FIG. 24, electrical connections 760 extend between the switch 742, the lower light sources 705, the upper light source 754, and a power source 762, such as batteries mounted to the crown 704 and specifically the sweatband 764 thereof, or other electrical generation mechanisms. The electrical connections 760, such wiring, may be disposed adjacent the brim 706 or within grooves provided in the brim 706 and specifically in the brim insert 287 or simply captured between the insert and fabric covering. So configured, the switch 742 can be actuated to light the light sources 705, 754 sequentially independently from each other or simultaneously so a wearer of the lighted hat can illuminate areas at different distances. As shown, the power source is in the hat crown, but this is only exemplary as the power source may be located anywhere on the hat.

Referring now to FIGS. 31-39, alternative configurations of lighting on a hat brim 800 to project light to at least two different areas and/or directions are provided. In general, these embodiments are described with the brim 800 having an upper major surface 802 and a lower major surface 804, which may have an upper fabric covering portion 806 and/or a lower fabric covering portion 808 disposed thereon, respectively. The below embodiments are described with respect to the positioning of one or more light sources 810 and different brim configurations. It is to be understood that the light sources 810 can be electrically coupled to a power source disposed on or within the brim 800 or other portion of the hat, such as a crown portion. The configurations may further include a switch electrically coupled to the light sources 810 and the power source to control power to the light sources 810. The switch may be disposed on the brim 800 or other portions of the hat, such as the crown. Each of the embodiments of FIGS. 31-39 can be used individually, in any combination, or combined with any of the previously described embodiments.

Figure 31:
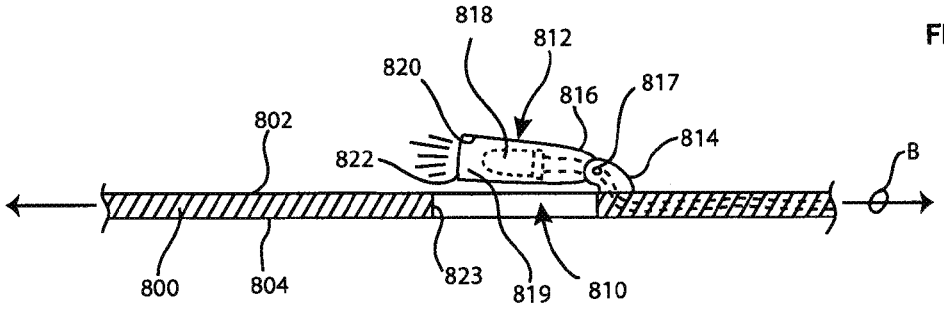
FIG. 31 is a side sectional view of a pivoting light module mounted to a brim of a hat showing the light module pivoted to a forward facing configuration.
Figure 32:
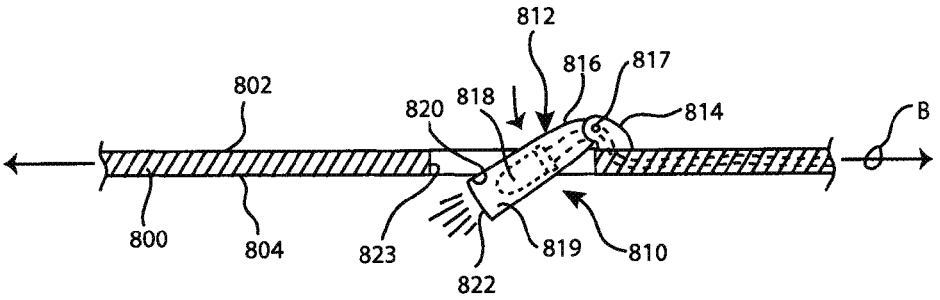
FIG. 32 is a side sectional view of the pivoting light module of FIG. 31 showing the light module pivoted to a downwardly and forwardly facing configuration.

In the embodiment of FIGS. 31 and 32, a pivoting module 812 is mounted to or adjacent the upper major surface 802 of the brim 800, may be contained within a cavity formed in the brim 800, or mounted about the brim 800. The pivoting module 812 includes a pivot base 814 mounted to the brim 800, and is preferably secured to or through the upper fabric covering portion 806 by adhesive, stitching, hardware, welding, or the like. The base 814 rotatably or pivotably attaches to a light module 816 through a pivot point 817 extending generally transverse to the brim axis B. The light module 816 includes a cavity 819 therein configured to receive at least one light source 818 such that the light source 818 projects light forwardly of the module 816. In one approach, an inner surface 820 of the module cavity 819 includes a reflective coating, material, or layer so that portions of a light cone projected from the light source 818 contacting the inner surface 820 are reflected back into the forwardly projecting light beam to project out of an opening 822 in the front of the projection portion 816. The opening 822 may have a transparent or translucent covering or window disposed thereacross to provide further protection for the light source 818. To facilitate pivoting, the brim 800 may also include an opening or cut-out 823 sized to allow the module 816 to pivot downwardly therethrough, as shown in FIG. 32. So configured, the light module 812 can be manipulated by a wearer to pivot up and down between a forwardly directing position, as shown in FIG. 31 above the brim, and a downwardly directing position, such as shown in FIG. 32 extending through and below the brim. Preferably, the light module 812 is configured to maintain positioning at any desired angle, such as by pressure fitting the pivot point 817, tightening the pivot point 817, having a plurality of notches or grooves cooperating with ridges between the base 814 and the module 816, or the like.

Figure 33:
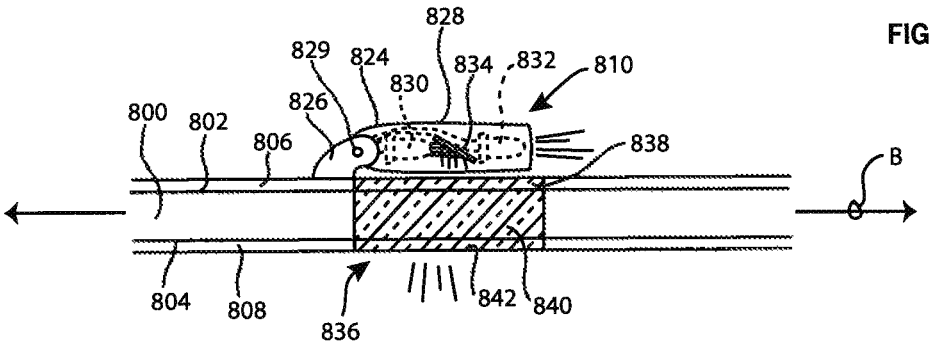
FIG. 33 is a side sectional view of a light module mounted to a brim with a transparent portion showing the light module projecting light in forward and downward directions through use of a light redirecting member.

In FIG. 33, another embodiment of a light module 824 is shown mounted to or adjacent the upper major surface 802 of the brim 800. The light module 824 includes a pivot base 826 mounted to the upper major surface 802, such as to or through the upper fabric covering portion 806 by adhesive, stitching, hardware, welding, or the like. The base 826 rotatably or pivotably attaches to a projection module 828 through a pivot point 829 extending generally transverse to the brim axis B. The projection module 828 is sized to receive one or more light sources 810, and preferably two light sources 810 therein. Preferably, the module 828 includes the two light sources both facing in the forward direction, but one is configured as a downward light source 830 and the other is configured as a forwardly directing light source 832. In one form, the downwardly projecting light source 830 can be secured within the projection module 828 to direct light in a generally downward direction and the forwardly projecting light source 832 can be secured within the projection module 828 to direct light in a generally forward direction along the brim axis B. Both light sources 830 and 832 can be oriented along the brim axis B with a light redirecting mechanism 834 (i.e. prism, mirror, and the like) positioned in front of the downward light 830 to redirect light emitted from the downwardly projecting light source 830 generally downwardly and transverse to the axis B. That is, both lights 830 and 832 project light along the brim axis B, but the light redirecting mechanism 834 redirects the light beam from the light source 830 to be projected at an oblique angle to the brim axis B. In one form, the light redirecting mechanism 834 is adjustable to allow a wearer of the hat to alter the direction of illumination to a variety of distances below and/or forwardly of the brim 800. The brim 800 further includes a window 836 of transparent or translucent material positioned adjacent the projection module 828, and preferably along the path of downward light projection to allow the downwardly projected light from the light source 830 and light redirecting mechanism 834 to pass through the window 836 to an area below the brim 800. As illustrated, the window 836 extends through the brim 800 and may includes an upper brim window portion 838, a middle brim window portion 840, and a lower brim window portion 842, where each portion is transparent or translucent. Alternatively, the window 836 could be a single piece secured to the brim 800 and the fabric covering portions 806, 808 or an opening could be provided through the brim 800 and/or the fabric covering portions 806, 808 to at least partially allow the light cone projected by the downwardly directed light source 830 to pass therethrough.

Figure 34:
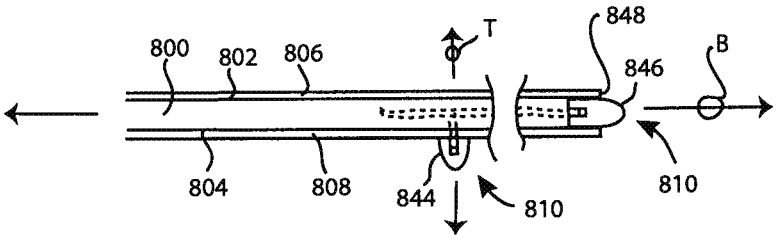
FIG. 34 is a side sectional view of a brim for a hat having a forwardly facing LED mounted to a perimeter of the brim and a downwardly facing LED mounted to an underside of the brim through a brim fabric covering.
Figure 35:
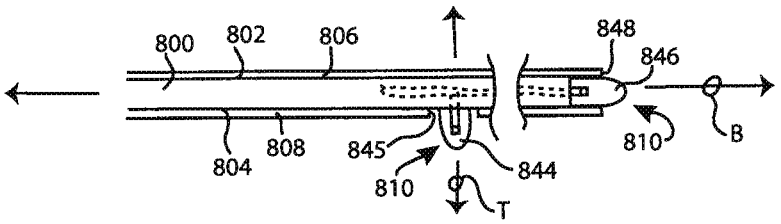
FIG. 35 is a side sectional view of a brim for a hat having a forwardly facing LED mounted to a perimeter of the brim and a downwardly facing LED mounted to an underside of the brim within an opening in a brim fabric covering.

Next, FIGS. 34 and 35 illustrated yet another embodiment of a lighted hat to project illumination in multiple directions. In this embodiment, the brim 800 includes at least two light sources 810 to direct light in two different areas. Specifically, a lower light source 844 is mounted to the lower major surface 804 of the brim 800, such as through the lower fabric covering portion 808, as illustrated in FIG. 34. Alternatively, the lower light source 844 may extend through an opening 845 provided in the lower fabric covering portion 808, as illustrated in FIG. 35. The lower light source 844 can be mounted generally perpendicular to the brim axis B to direct illumination along the axis T as shown, or can be mounted at an angle to the brim axis B to direct light to a more forwardly position, as discussed above. The brim 800 further includes an upper light source 846 mounted to a perimeter 848 of the brim 800 generally along the brim axis B. The upper light source 846, however, may be slightly angled with respect to the brim axis B, as discussed above. So configured, the upper and the lower light sources 846, 844 are mounted to the brim 800 to provide light to different directions and/or areas and in particular illumination in directions that are perpendicular to each other.

Figure 36:
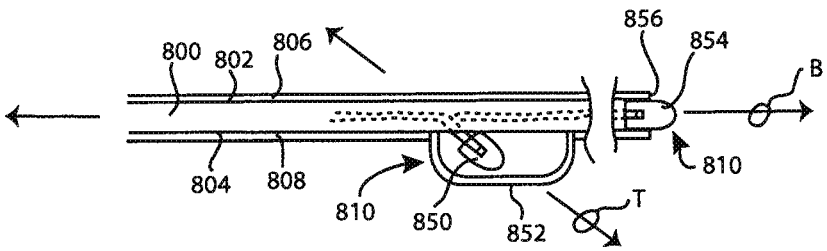
FIG. 36 is a side sectional view of a brim for a hat having a forwardly facing LED mounted to a perimeter of the brim and a downwardly facing LED mounted to an underside of the brim within a canopy portion of the brim underside covering the downwardly facing LED.

Yet another embodiment is illustrated in FIG. 36. In this embodiment, the brim 800 again includes at least two light sources 810 to direct light in two different areas or along two different axes. Specifically, a lower light source 850 is mounted to the lower major surface 804 of the brim 800. In this embodiment, the brim 800 and/or the lower fabric covering portion 808 thereof includes a downwardly projecting canopy or enclosure 852 that houses the lower light source 850 underneath the brim 800. The canopy 852 is preferably transparent or translucent or has a transparent or translucent window portions thereof so that light projected from the lower light source 850 can pass therethrough to illuminate an area below the brim 800. Alternatively, the lower fabric covering portion 808 itself may be sufficiently transparent or translucent so that the light from the light source 850 can project therethrough. As illustrated, the lower light source 850 is canted with respect to the brim axis B to extend along the axis T; however, other angles can be utilized as discussed above. In one form, the canopy 852 can be formed of a generally stiff material to provide protection for the lower light source 850 from damage, such as when the hat is dropped or stacked. In another form, the canopy 852 can be formed of a generally flexible material, so that a wearer can manipulate the canting of the lower light source 850. This embodiment further includes an upper light source 854 mounted to a perimeter 856 of the brim 800 generally along the brim axis B. The upper light source 854, however, may also be slightly angled with respect to the brim axis B, as discussed above.

Figure 37:
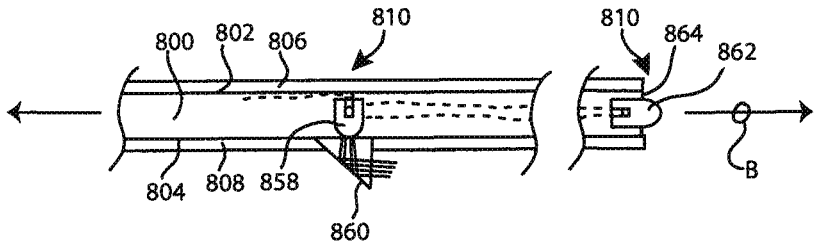
FIG. 37 is a side sectional view of a brim for a hat having a forwardly facing LED mounted to a perimeter of the brim and a downwardly facing LED mounted at least partially within the brim and configured to project light to a redirecting member mounted to an underside of the brim.

Turning to FIG. 37, another embodiment is illustrated with the brim 800 having at least two light sources 810 to direct light in two different areas or directions. A lower light source 858 is received within the brim 800 such as in a cavity or other space therein and is substantially concealed from view. The lower light source 858 is preferably secured in a downward direction transverse, and in some approaches perpendicular, to the brim axis B, as illustrated in FIG. 37. A light redirecting mechanism 860 (i.e. prism, mirror, and the like) is mounted to the lower major surface 804 of the brim 800 in a position below the lower light source 858 so that the mechanism 860 redirects light projected downwardly from the lower light source 858 to a more forward direction, such as along the brim axis B. In one form, the mechanism 860 can pivot relative to the brim axis B so that a user may also redirect light from the light source 858 to a range of areas by altering the angle of the mechanism 860 so that the lower light source 858 can project light into the reading or viewing area discussed with the previous embodiments. An upper light source 862 can additionally be mounted to a perimeter 864 of the brim 800 generally along the brim axis B. The upper light source 862, however, may also be slightly angled with respect to the brim axis B, as discussed above.

Figure 38:
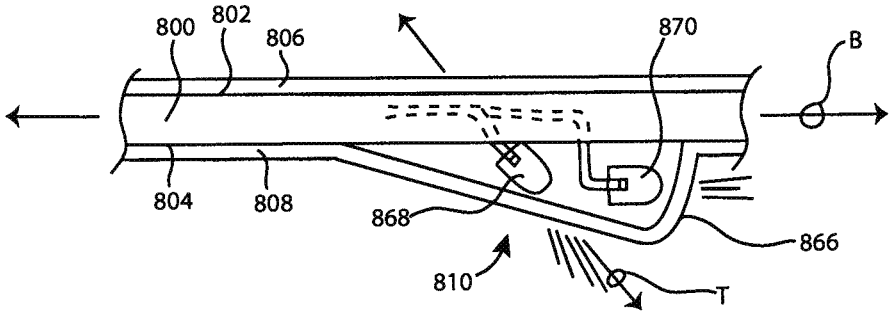
FIG. 38 is a side sectional view of a brim for a hat having a forwardly facing LED and a downwardly facing LED both mounted to an underside of the brim and within a canopy portion of the brim underside.

In FIG. 38, the brim 800 includes at least two light sources 810 mounted to the lower major surface 804 to direct light to different areas or in different directions. The brim 800 and/or the lower fabric covering portion 808 includes a downwardly extending canopy or enclosure 866 that encloses both light sources 810 therein between the lower major surface 804 of the brim 800 and the canopy 866. Preferably, the canopy 866 may be generally wedge shaped and formed from transparent or translucent materials and/or includes one or more transparent or translucent windows adjacent each light source. In this form, the canopy includes the light sources 810 with a downwardly directed light source 868 that extends and projects illumination along the axis T and a forwardly directed light source 870 that projects illumination along the brim axis B, as discussed above. The light source 870 can alternatively be angled with respect to the brim axis B, as discussed above. In one form, the canopy 866 can be formed of a generally stiff material to provide protection for the light sources 868, 870 from damage, such as when the hat is dropped or stacked. In another form, the canopy 866 can be formed of a generally flexible material, so that a wearer can manipulate the canting of the light sources 868, 870 as desired. As shown, the canopy 866 is a wedge-like enclosure depending below the brim lower surface 804 to minimize the thickness of the brim.

Figure 39:
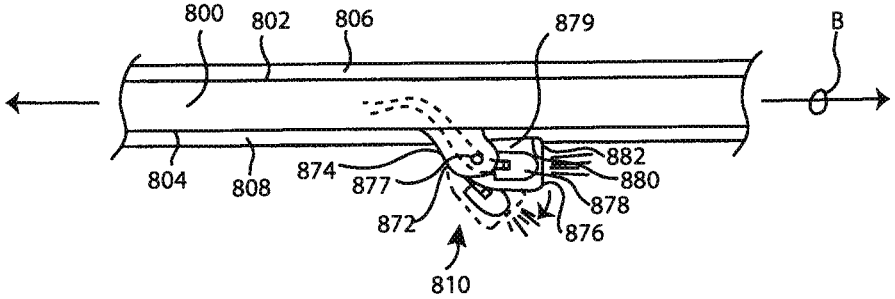
FIG. 39 is a side sectional view of a brim for a hat having a rotatable lamp mounted to an underside of the brim showing the lamp rotating between a forwardly facing position and a downwardly facing position.
Figure 40:
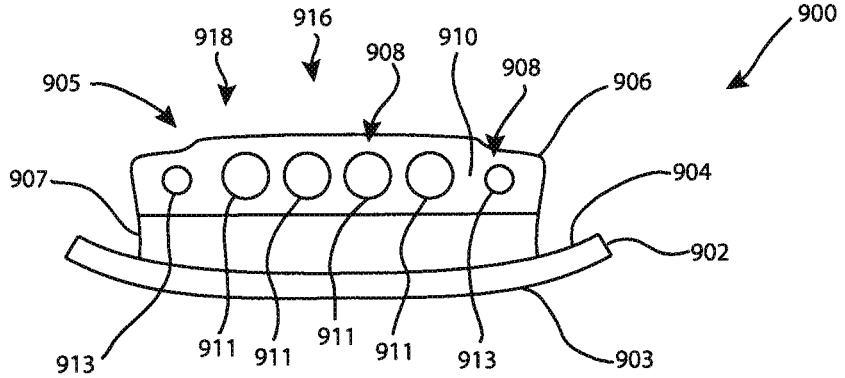
FIG. 40 is a front view of a light holder having multiple large and small cavities each sized to receive large and small LEDs at different angles of inclination relative to a fore-and-aft axis of a mounting base of the light holder.
Figure 41:
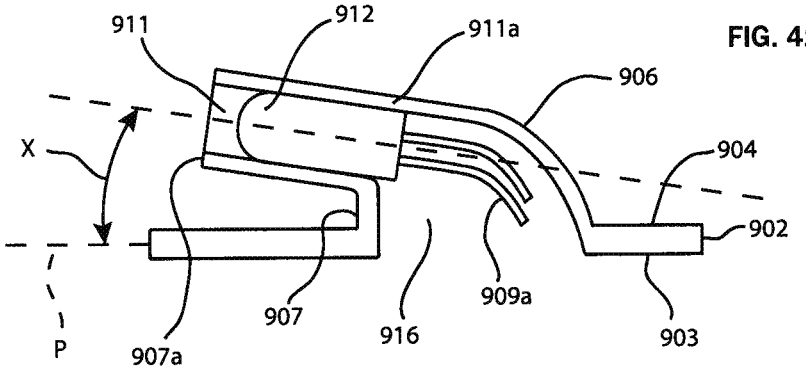
FIG. 41 is a side cross-sectional view of one of the large cavities of the light holder of FIG. 40 showing the large LED received in the large cavity to project light along an axis having a first angle of inclination relative to the mounting base axis.
Figure 42:
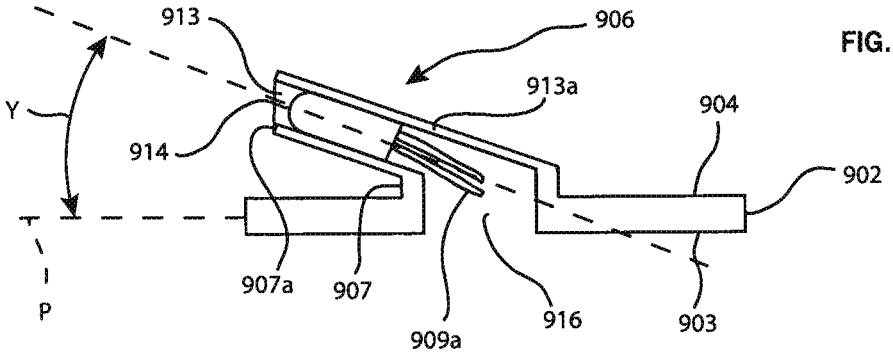
FIG. 42 is a side cross-sectional view of one of the small cavities of the light holder of FIG. 40 showing the small LED received in the small cavity to project light along an axis having a second angle of inclination relative to the mounting base axis.
Figure 43C:
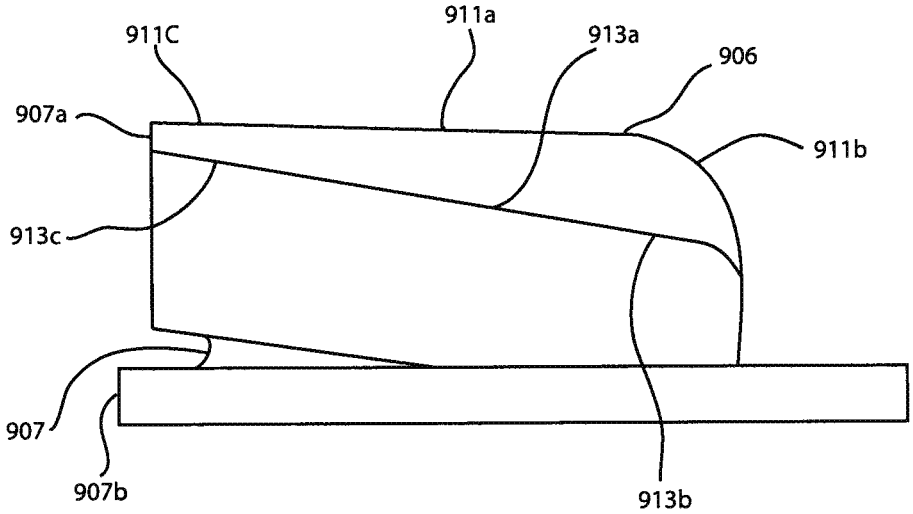
FIG. 43C is a side view of the light holder of FIG. 40.
Figure 43D:
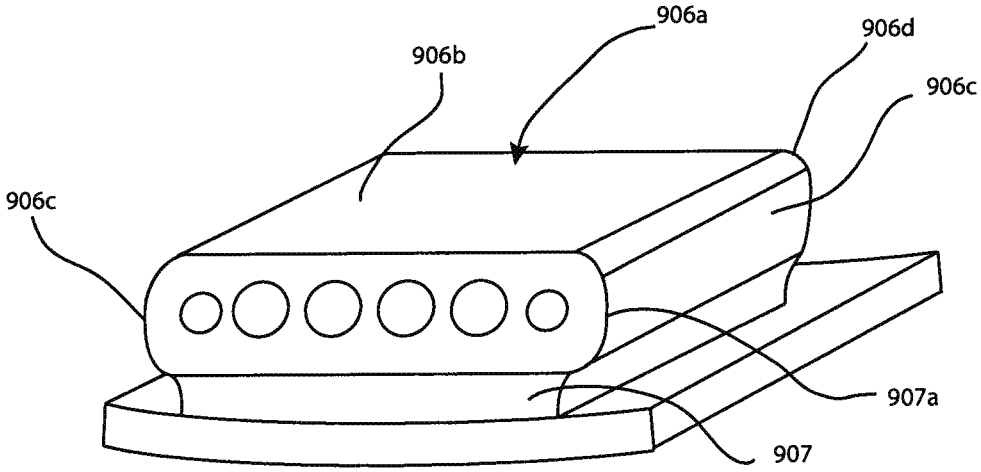
FIG. 43D is a perspective view of an alternate housing of the light holder of FIG. 40.
Figure 43E:
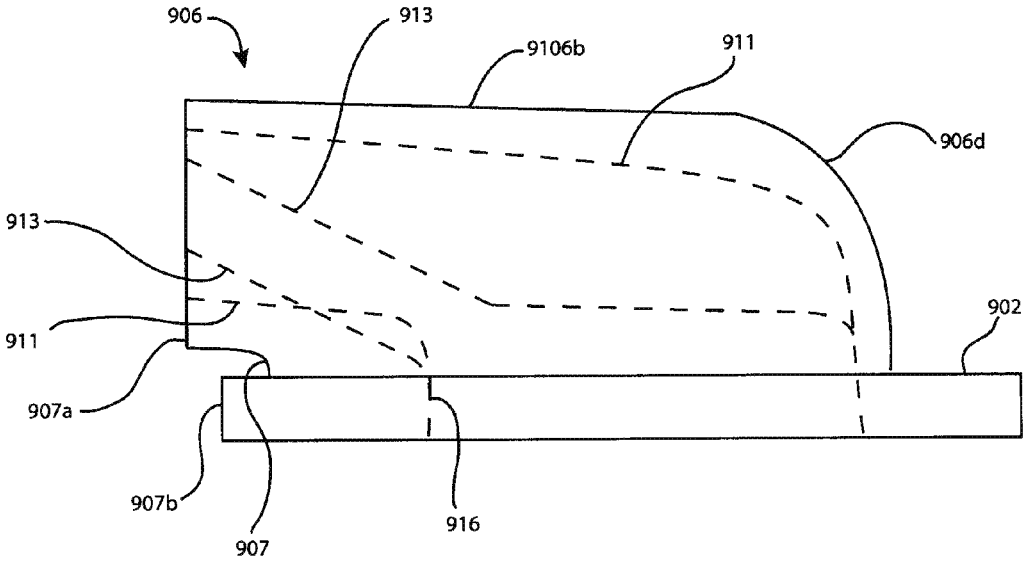
FIG. 43E is a side view of the alternate housing of FIG. 43D.
Figure 44:
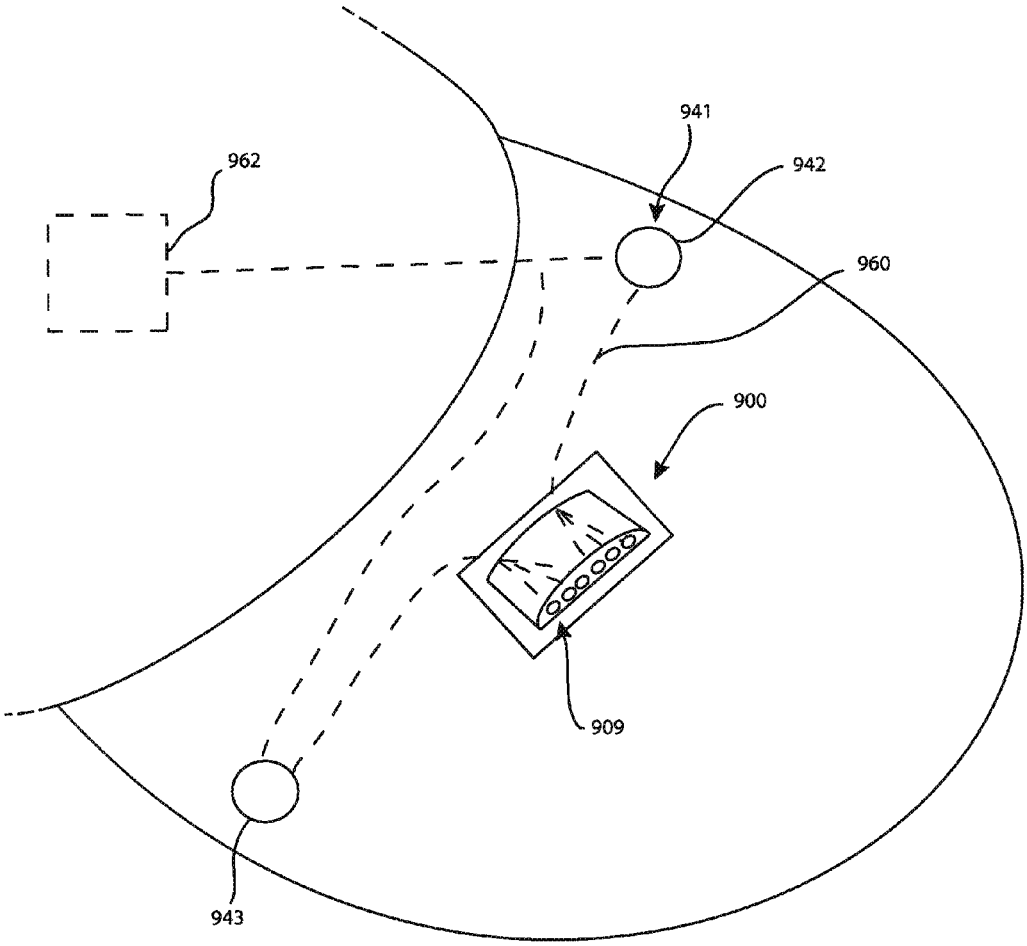
FIG. 44 is a bottom perspective view of a hat having the light holder of FIG. 40 mounted to the brim with two switches for actuating selected LEDs of the light holder.

In FIG. 39 a pivoting light module 872 is mounted to the lower major surface 804 of the brim 800, such as to or through the lower fabric covering portion 808. The light module 872 includes a pivot base 874 mounted to the lower major surface, such as by adhesive, stitching, hardware, welding, or the like. The light module 872 further includes a projection module 876 rotatably or pivotably attached to the base 874 through a pivot point 877 generally transverse to the brim axis B. The projection module 876 includes a hollow interior forming a cavity 879 sized to receive at least one light source 878 therein. By one approach, an interior surface 880 of the module cavity 879 may include a reflective coating, layer, or materials disposed at least partially thereon so that portions of a light cone emitted from the light source 878 that contact the interior surface 880 are reflected to project out of an opening 882 of the projection module 876. The opening 882 may further include a transparent or translucent window or covering thereacross to provide further protection for the light source 878. So configured, the projection module 876 can be manipulated to a range of positions between a first position to direct light generally forwardly and along the brim axis B to a second position directing light perpendicular to the brim axis B as well as an infinite number of positions therebetween. This allows a wearer of the lighted hat to alter the illumination direction of the light source 878. This can be achieved, for example by pressure fitting the pivot point 877, tightening the pivot point 877, having a plurality of notches or grooves cooperating with ridges between the base 874 and the module 876, or the like.

In another embodiment shown in FIGS. 40-45, a light holder 900 includes a mounting base 902 having an upper surface 903, a lower surface 904, and a fore-and-aft centerline axis P. The light holder 900 further includes a holder portion or bezel 905 that extends away from the lower surface 904 of the base 902. The bezel 905 includes a body portion 906 having a curved profile, such as generally banana or gun shaped. The body portion 906 includes a neck portion 907 that spaces at least a front end 907*a* of the body portion 906 from the mounting base 902. In the illustrated form, the front end 907*a* projects beyond a front end 907*b* of the mounting base. Alternatively, the mounting base front end 907*b* can project beyond the body front end 907*a*. The body 906 includes a plurality of cavities 908 therein for receiving a plurality of light sources 909, which are preferably LEDs. The cavities 908 are separate from each other with dividing walls 910 therebetween so that each cavity 908 can receive one of the plurality of LEDs 909 therein. The cavities 908 can be of different diameters, so that a first or relatively large cavity 911 can receive a relatively large LED 912 therein, and a second or relatively small cavity 913 can receive a relatively small LED 914 therein. The large LED 912 can be a 5 mm 20,000 MCD LED and the small LED 914 can be a 3 mm 10,000 MCD LED; however, other sizes and energy levels can also be used. In one form, the diameter of the first cavity 911 is about 5 mm, and the diameter of the second cavity 913 is about 3 mm; however, other diameters corresponding to larger or smaller LEDs could also be used.

As previously mentioned with respect to other light holder embodiments, the LEDs can be recessed within the cavities 908 to block incident light.

In one form, the large LED 912 is the high beam light source (similar to light source 372 described above) and the small LED 914 is the low beam light source (similar to light source 373 described above). More particularly, the first or large cavities 911 have a first angle of inclination relative to the mounting base axis P, and the second or small cavities 913 have a second angle of inclination relative to the mounting base axis P that is greater than the first angle of inclination of the first cavity 911. Thus, the LEDs received in the second cavities 913 will direct light in a more downward direction relative to the LEDs received in the first cavities.

By one approach, the bezel 905 includes a common opening 916 in the upper surface 903 of the mounting base 902 that is in communication with each of the plurality of cavities 908 of the body 906. The cavities 908 are configured to receive the LEDs 909 with the leads 909*a* extending upwardly therefrom so that the leads 909*a* of the LEDs 909 extend upwardly from their respective cavities 908 and through the common opening 916 to an area exterior of the mounting base 902. The leads 909*a* can be connected to a switch device, circuit board, power source, or other electrical component via an electrical connection such as, for example, electrical wiring, traces, or the like. The mounting base 902 can have a generally curved profile that is generally complementary to the curved shape of the brim 116.

In one form, the body 906 has a common outer wall 906*a* extending therearound. The common outer wall 906*a* includes a first wall portion 911*a* extending about the first cavities 911 and two second annular wall portions 913*a* extending about the second cavities 913 and disposed on lateral sides of the first wall portion 911*a*.

The first wall portion 911*a* and the second annular wall portions 913*a* have rearward ends 911*b* and 913*b* and forward ends 911*c* and 913*c*. The second annular wall portions 913*a* project from the mounting base at a generally constant angle thereto so that the wall portions 913*a* have a varying predetermined height from the mounting base 902. The first wall portion 911*a* has an upstanding curved profile at the rear end 911*a* thereof and a slightly downwardly tapering profile extending from the rear end 911*a* to the forward end 911*c* thereof. As such, more of the first wall portion 911*a* projects beyond the second cavity annular wall portion 913*a* at or adjacent the rearward ends 911*b* and 913*b* than at the forward ends 911*c* and 913*c*. The wall portions 911*a* and 913*a* have heights relative to the mounting base 902 that generally conform to the angles of inclination of the first and second cavities 911 and 913.

In another approach (FIGS. 43C and 43D), the common outer wall portion 906*a* has a generally flat surface portion 906*b* extending between two generally flat parallel side portions 906*c* of the body 906, with the body having a curved rear portion 906*d*. The cavities 911 and 913 can be formed as bores through the body 906 at different angles of inclination relative to the mounting base axis P joining at the common opening 916 as previously described above. The bores 911 and 913 can alternatively have separates openings at the mounting base 902. The body 906 and mounting base 902 can be of a unitary construction, so that the cavities 911 and 913 being bored through the body results in the body 906 being thicker at areas rearward of the smaller cavity 913 than at areas rearward of the larger cavity 911.

In one approach, the bezel 905 includes six cavities 908 with four being the large cavities 911 and two being the small cavities 913. Each of the six cavities 908 has a LED 909 received therein, with the large cavities 911 receiving the large LED 912, and the small cavities 913 receiving the small LED 914. Two of the four large cavities 911 are on one side of the mounting base axis P, with the other two large cavities 911 on the opposite side of the mounting base axis P; however, other configurations are also possible. The four large cavities 911 are adjacent each other to create a "four-in-a-row" configuration or bank 916 of four large LEDs 912 that is generally centered in the body 906. The two small cavities 913 are located on opposite sides of the bank 916 so that the small LEDs 914 are spaced from each other at approximately the same distance from the mounting base axis P. Thus, in this configuration, the bank 916 of four large LEDs 912 is sandwiched between the two small LEDs 914 to create a six LED bank 918. Similar to the light holder 350 described above, the small cavities 913 receiving the small LEDs 914 therein have an angle of inclination Y relative to mounting base axis P to project the low beam illumination at a downward angle from the mounting base axis P, and the large cavities 911 receiving the large LEDs 912 therein have an angle of inclination X that is less than the angle Y of the small cavity 913, so the large LEDs 912 will project the high beam illumination more forwardly than the small LEDs 914. The angles of inclination X and Y can vary as desired. In one form, the angle X can be about 7-7.5 degrees, and the angle Y can be about 25-40 degrees.

In another approach, the bezel 905 can include four cavities 908, with two of the cavities being the large cavities 911 and two of the cavities being the small cavities 913, with the small cavities 913 being outboard of the large cavities 911 similar to the above description. In this approach, one large cavity 911 and one small cavity 913 are on one side of the mounting base axis P, with the other large cavity 911 and the other small cavity 913 on the opposite side of the mounting base. In other approaches, the bezel 905 could include five, eight, ten, or some other total number of cavities 908. For instance, the bezel 905 could include two cavities each having a light source similar to light holder 350. In another form, the bezel 905 could include cavities that are all of the same size. It will be understood that ability of the bezel 905 to accommodate one or more cavity sizes and/or one or more cavities allows for various combinations of cavity quantities and cavity sizes, or combinations thereof. Moreover, the bezels 905 can orient the LEDs therein to direct light along a variety of angles of inclination with respect to the brim portion, including three, four, or more different angles, in symmetrical and non-symmetrical configurations.

The light holder 900 can be mounted to the brim 116 in the variety of ways described herein with respect to the other light holder embodiments. In one form, the mounting base 902 is mounted to the outside surface 293 of the lower brim covering material 291 with the brim covering material 291 extending between the mounting base 902 and the brim insert 287. In another form, the mounting base 902 is mounted between the brim insert 287 and the lower brim covering material 291, with the covering material 291 extending over the mounting base 902, and the body 906 and neck portion 907 extending through an opening 920 in the covering material 291. The opening 920 is sized to receive the body 906 and neck portion 907 therethrough when the light holder 900 is mounted in the manner. The mounting base 902 can be made of a plastic material and curved to conform to the generally curved shape of the brim 116, or it could have a generally flat shape. However, other materials and shapes of the mounting base 902 can also be used as previously described with respect to light holder 200.

As described above, the LEDs 909 each have leads 909*a* extending therefrom for connecting to various electrical components. In one form, the light holder 900 is coupled to a power source 962 mounted to the crown portion of a hat and a switch 941 mounted to the brim 116. The power source 962 is electrically connected to the switch 941, which are both electrically connected to the LEDs 909 via an electrical connection 960, such as wiring, traces, circuit boards, or the like. The LEDs 909 can be connected in series or parallel, or a combination of both, depending on the desired illumination capability of the light holder 900. For instance, the switch 941 may be configured to alternate between a full "on" state and a full "off" state. In such configuration, all six LEDs 909 are connected in series or parallel and feed off a single wire coming from the switch. In another configuration, the switch may be configured to sequentially illuminate the smaller LEDs 914 only, both the small LEDs 914 and large LEDs 912, and then the large LEDs 912 only. In such a configuration, the small LEDs 914 and large LEDs 912 are separately connected to the switch 941, and the switch 941 is configured to activate the desired LEDs 909 upon sequential actuations of the switch. Other configurations are also possible, such as each LED 909 being separately connected to the switch 941 and/or a different order of activation when sequentially actuating the switch 941.

In one embodiment, the light holder 900 is coupled to two switch devices 942 and 943 mounted to the brim 116. One switch device 942 is mounted to one side of the brim 116 with the other switch device 943 mounted to the other side of the brim 116. The switches 942 and 943 may be mounted to the lower surface 288 of the brim insert 287, with the brim covering material 291 covering the switches 942 and 943 in a manner similar to that shown in FIGS. 19 and 20. The covering material 291 may include stitching at the location of each switch device 942 and 943 for indicating their location. One switch 942 can be electrically coupled to three of the six LEDs 909 of the light holder 900, with the other switch 943 coupled to the remaining three LEDs of the light holder 900. Thus, in this configuration, the user can selectively activate or cycle through one set of three LEDs 909 by actuating the connected switch 942. The user can similarly activate the other LEDs 909 by actuating the other switch 943. Further alterations to the two switch configuration are also possible. For instance, one switch 942 could be coupled to all of the large LEDs 912 for illuminating relatively far distances via the high beam, while the other switch 943 could be coupled to all of the small LEDs 914 for illuminating relatively close distances via the low beam.

In one form, the LEDs 909 connected to the switch 942 can be red LEDs for producing a generally red illumination, with the LEDs 909 connected to the switch 943 being white LEDs for producing a generally white illumination. In this configuration, the red LEDs 909 can be two of the large LEDs 912 mounted adjacent each other on one side of the mounting base axis P and the small LED 914 mounted on the same side. The remaining three white LEDs are the LEDs 909 on the opposite side of the mounting base axis P. Thus, for instance, a user can choose to use only red light at night to preserve the user's night vision after deactivating the illumination of the red LEDs, or the user may choose to activate the white light for a fuller light spectrum.

Other configurations of the order of the red and white LEDs 909 are also possible, such as alternating red and white from one end of the bezel 905 to the other. Furthermore, more than two switches 941 could be attached to the brim 116 for providing additional control of the multiple LEDs or a single switch 941 could be used to cycle through the various color or illumination states as desired. While the above description refers to red and white LEDs, other colors or color combinations could also be used. For example, another color LED could be used to preserve night vision and another color could be used for a fuller light spectrum. In another form, the LEDs can be configured to project ultraviolet illumination. Ultraviolet illumination can be useful in crime scenes or for blood tracking while hunting, or for producing "black light."

The various embodiments of light holders described herein can be mounted to the brim 116 in a variety of ways. For purposes of discussion, the light holder 200 will be referenced, but other embodiments can be installed similarly, such as light holder 300, 350, 900, etc. described above. As previously described, the light holder 200 can be mounted to the brim 116 as illustrated and described with reference to FIGS. 10-13D, such as mounting between the brim insert 287 and the lower brim covering material 291 or mounting externally to the outside surface 293 of the lower brim covering material 291. The light holder 200 can also be mounted externally in a variety of ways. As previously described, the upper surface 212 of the mounting base 202 can be attached to the outside surface 293 of the brim covering material 291 by adhesive, staples, Velcro, sewing, stitching, ultrasonic welding, or other fastening mechanisms. When the light holder 200, or other light holder embodiments described herein, is mounted externally and on top of the covering material 291, the covering material 291 can include an opening therethrough that is generally covered by the mounting base 202 so that the electrical connections of the various light holders can run between the covering material 291 and the brim insert 287 for connecting to various electrical components such as switches, power sources, or the like. Alternatively, electrical connections from the mounting base 202 can be inserted through the covering material 291.

When the light holder 200 is mounted via ultrasonic welding, the mounting base 202 can be made from a plastic material suitable for being ultrasonically welded. The plastic material of the mounting base is melted according to known ultrasonic welding methods to create an ultrasonic weld connection between the mounting base 202 and the outside surface 293 similar to the configuration shown in FIG. 13A. In another form, the upper surface 212 of the mounting base 202 can be ultrasonically welded to the lower major surface 288 of the brim insert 287 similar to the configuration shown in FIG. 12. In yet another form, the lower surface 210 can be ultrasonically welded to the inside surface 292 of the lower brim covering material 291 similar to the configuration shown in FIGS. 10-11. Alternatively, the brim portion 116 may be free of a covering material across the lower major surface 288 with the upper surface 212 of the mounting base 291 ultrasonically welded directly thereto. The ultrasonic weld is created using high frequency vibrations. In one form, the vibrations are applied across the mounting base 202 so that the majority of the upper surface 212 is vibrated to create an ultrasonic weld connection and bond between the majority of the upper surface 212 and the mounting surface of the brim, such as the outside surface 293 of the covering material 291 or the lower surface 288 of the brim insert 287. Similarly, the majority of the lower surface 210 can ultrasonically welded to the inside surface 292 of the covering material 291. In another form, the periphery of the mounting base 202 can be vibrated to create an ultrasonic weld bond about the periphery of the mounting base 202. The mounting base 202 can be similarly attached or mounted to the upper major surface of the brim.

Another light holder 1100 and associated optional applique 1102 is shown in FIGS. 45A-45E. The light holder 1100 of this form is made of a transparent or translucent material, such as a clear or semi-transparent plastic or the like. As such, when light sources 1101 are disposed or mounted therein, light emitted from the light sources 1101 will pass through the walls of the light holder 1100. This can be utilized to illuminate desired walls of the light holder 1100 and direct emitted light exteriorly thereof, e.g. the close and far distances discussed herein.

As illustrated, the light holder 1100 includes a base portion 1104 having an upper surface 1106, a lower surface 1108, and a fore-and-aft centerline axis P. The light holder 1100 further includes a light holding portion or bezel 1110 that extends away from the lower surface 1108 of the base 1104 and receives the light sources 1101 therein to orient the light source 1101 along desired projection axes. The light holding portion 1110 includes an outer wall 1112 that extends therearound and a distal end wall 1114, through which the light sources 1101 project light. In the illustrated form, the light holding portion 1110 has a bent configuration with a racetrack shaped cross-section in order to receive several of the light sources 1101 therein arranged side-to-side in a lateral row. In other configurations, circular or rectangular cross-sections can also be utilized, as well as stacked or arrayed light sources.

In contrast to other embodiments described herein, the distal end wall 1114 of the light holding portion 1110 does not need to include distal end openings therein to allow light emitted from the light sources 1101 to project to desired areas because of the light transmissive nature of the light holder 1100. In this regard, the end wall 1114 can extend over and across the light source to act as a cover therefor. The absence of openings in the end wall 1114 can therefore advantageously prevent debris from entering the light holder 1100.

Figure 45A:
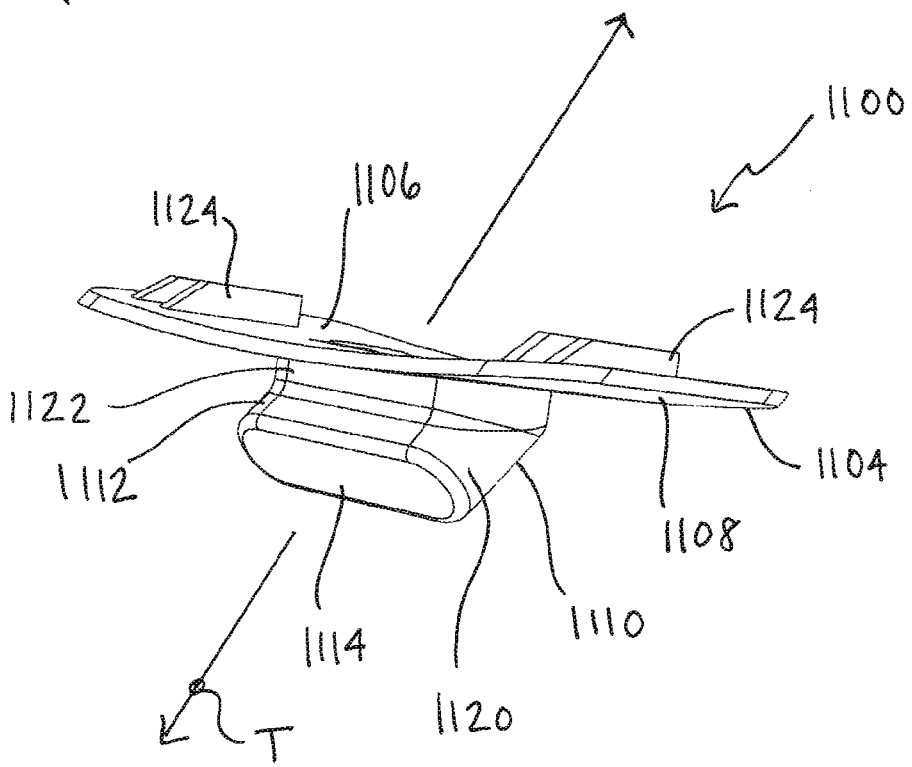
FIG. 45A is a bottom perspective view of a transparent or translucent light holder having a light holding portion and a base portion.
Figure 45B:
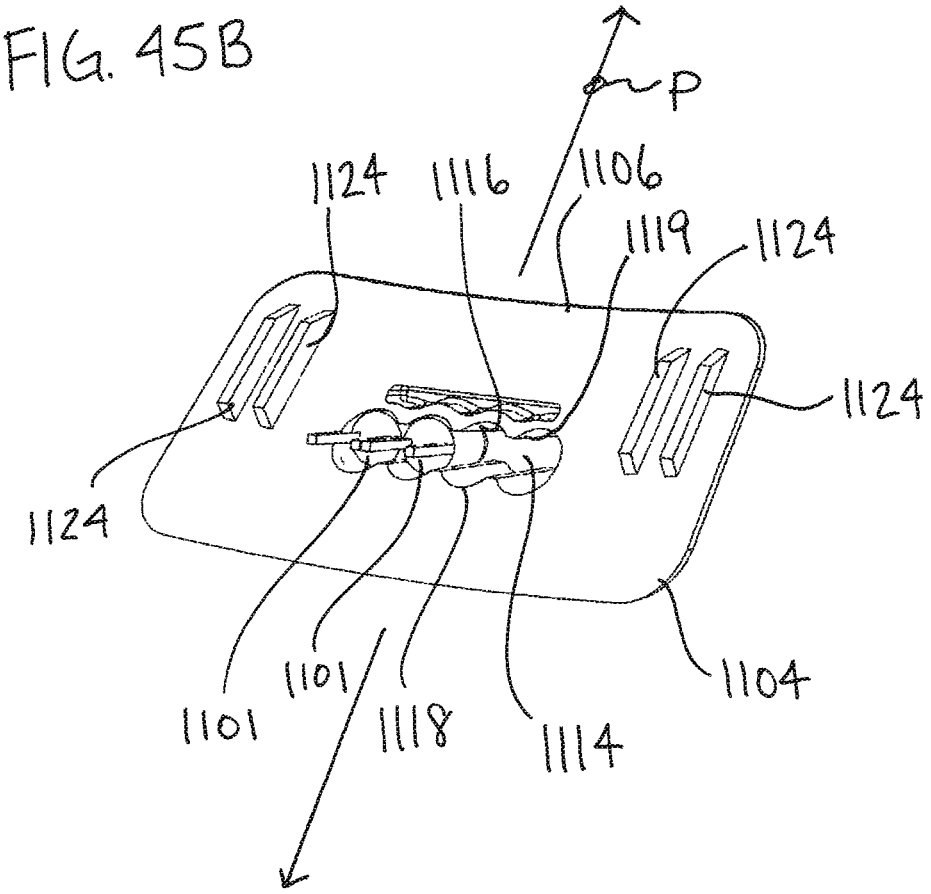
FIG. 45B is a top perspective view of the light holder of FIG. 45A showing LEDs received within cavities in the light holding portion and stand-offs of the base portion.
Figure 45C:
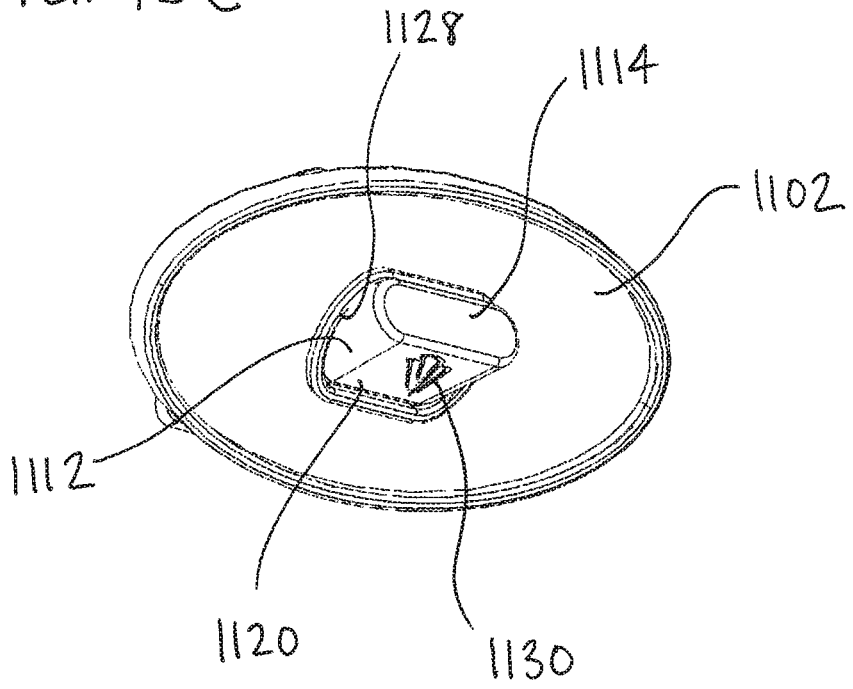
FIG. 45C is a bottom perspective view of the light holder of FIG. 45A showing the light holding portion thereof projecting through an opening in an applique so that the applique overlaps the base portion.

As shown in FIG. 45B, the light-holding portion 1110 includes one or more cavities 1116 accessible through openings 1118 in the upper surface 1106 of the base 1104. Rather than four separate cavities, the cavities 1116 shown are divided by inwardly extending curved projections 1119 configured to define individual, generally cylindrical cavities for reception of the light sources 1101. Alternatively, the cavities 1116 can be separated by dividing walls. In addition, the cavities 1116 can extend along different angles of inclination with respect to one other, as described in other embodiments herein, to project light to relatively near and far areas. Moreover, the light holder can alternatively include two or more light holding portions 1110 as described herein to space the light sources 1101 along the base 1104. So configured, the light sources 1101 can be inserted into the cavities 1116 through the upper surface 1106 of the light holder 1100 and the cavities 1116 can orient the light sources 1101 at a desired angle to emit light along a projection axis T thereof. In the illustrated embodiment, the light holding portion 1110 includes four cavities 1116 therein, each sized to receive one LED therein, extending generally along the same axis of inclination with respect to one another and with respect to the light holding portion 1110 itself. Although the cavities 1116 are shown with a uniform diameter, a variety of diameters can be used to house a variety of different sized LEDs.

The light holding portion 1110 encloses the light sources 1101 by extending laterally therearound and forwardly thereof. More specifically, the outer wall 1112 extends around the light sources 1101 and, combined with the end wall 1114, encloses the light sources 1101, which are then only accessible through the opening 1118 of the base 1104.

Rather than four separate cavities, the cavities 1116 shown are divided by inwardly extending curved projections configured to define individual, generally cylindrical cavities for reception of the light sources 1101. Alternatively, the cavities 1116 can be separated by dividing walls. In addition, the cavities 1116 can extend along different angles of inclination with respect to one other, as described in other embodiments herein, to project light both to near and far areas. Moreover, the light holder 1100 can alternatively include two or more light holding portions 1110, as described with respect to other embodiments herein, to space the light sources 1101 along the base 1104.

The light-holding portion 1110 can include an inclined portion 1120 and a neck portion 1122 that connects the inclined portion 1120 to the base 1104. The neck portion 1122 can be sized to correspond to the thickness of the brim covering material, and any other material mounted thereto, so that the inclined portion 1120 can freely extend forward at the angle of inclination. In one form, the neck extends generally perpendicularly from the base 1104 so that it can easily pass through an opening in the brim covering material. With regard to the inclined portion 1120, it can extend away from the neck portion 1122 at a downward inclination of between about 20 degrees and about 70 degrees with respect to the fore-and-aft centerline axis of the brim. The cavities 1116 can be created to extend generally along this axis or can extend along different axes than that of the inclined portion 1120 itself. Moreover, the light holding portion 1110 need not include an inclined portion at all. Instead, the cavities 1116 can extend through the light holding portion 1110 at set angles to orient the light sources 1101 as desired.

As previously described and shown in FIGS. 45A-45D, the base 1104 includes the upper and lower surfaces 1106, 1108. The upper surface 1106 is configured to abut or be mounted to the lower surface of the brim insert, as described with regard to other embodiments herein. As such, the lower surface 1108 will then engage the brim covering material and the light holding portion 1110 will project through the opening of the brim covering material to position the light sources underneath the brim to projection light to desired areas. The base 1104 can have an upward curvature, as shown, or can be generally planar.

Figure 45D:
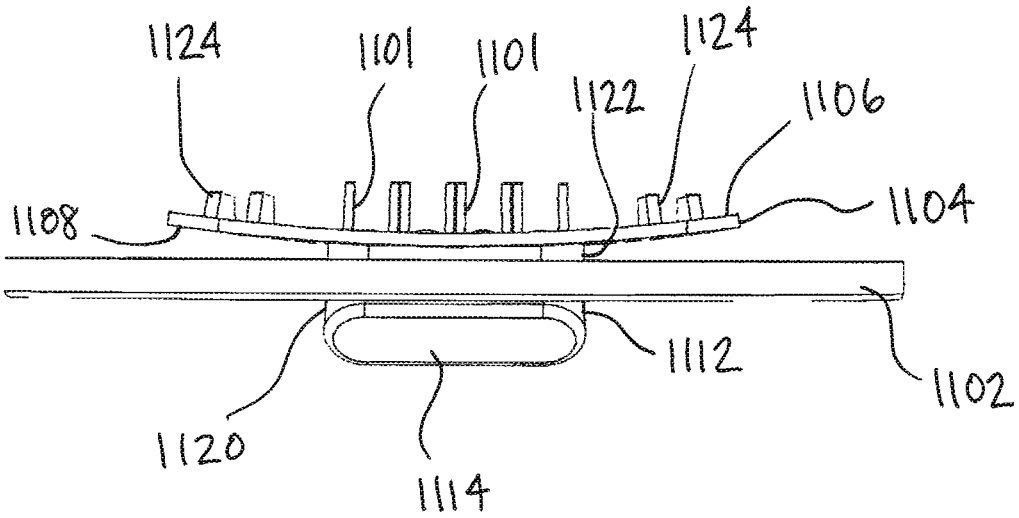
FIG. 45D is a front elevational view of the light holder and applique of FIG. 45C showing the light holding portion projecting through the opening in the applique and the stand-offs of the base portion.
Figure 45E:
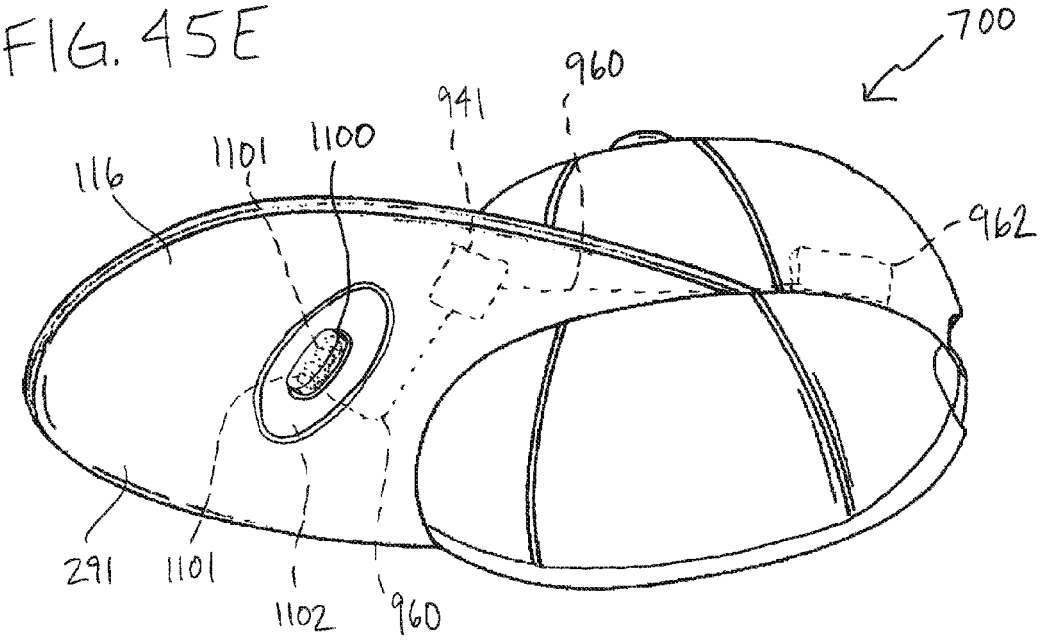
FIG. 45E is a bottom perspective view of a lighted hat having a light assembly including the light holder and applique of FIG. 45C mounted thereto.

As shown in FIGS. 45A, 45B, and 45D, the base 1104 can further include one or more stand-offs 1124 that project upwardly away from the upper surface 1106 thereof. The stand-offs space the light holder 1100 from the brim insert so that electrical connections between the light sources 1101 and the other electrical components of the lighted hat, such as the power source and the switch device, can be disposed within this space rather than be sandwiched between the base 1104 and the brim insert. In the illustrated form, the base 1104 includes 4 stand-offs that are spaced from the edges of the base portion and position so that a pair of stand-offs is on either side of the cavities 1116.

For some applications, it may be desirable to block incident light from passing through one or more walls of the light holder 1100. In this case, an opaque material can be applied over or adhered to areas of the light holder 1100 in which light-blocking is desired. For example, the opaque material can be applied over some or all of the lower surface 1108 of the base 1104 and/or the outer wall 1112 of the light-holding projection 1110. The opaque material can also be applied on the end wall 1114 of the projection 1110 to define circular openings to align with the light sources 1101 and focus or orient the light projected therefrom. Alternatively, the applique 1102 can be mounted or adhered to the brim covering material, as described with respect to various embodiments herein, to generally overlap the base 1104 of the light holder, while the light holding portion 1110 projects through an opening 1128 in a central region thereof. The applique can preferably be made from an opaque material so that it will block any incident light that would otherwise travel through the base 1104 and the brim covering material. The applique 1126 is shown having an oval configuration, but any size and shape can be utilized to overlap the base 1104 and block incident light.

Additionally, if desired, selected portions can be removed or excluded from the opaque material so that the light sources 1101 will illuminate the selected portions when energized. This could advantageously be utilized to show a design, such as a logo 1130 or other graphical or alphanumeric message. Alternatively, the logo 1130 can simply have a different thickness than adjacent portions of light holder 1110 so that the logo 1130 has a different appearance.

The light holder 1100 can be mounted to the brim 116 in any of the variety of ways described herein with respect to the other light holder embodiments. In one form, the light holder 1100 can be mounted to the outside surface of the lower brim covering material 291 with the brim covering material 291 extending between the mounting base 902 and the brim insert, described above. In another form, shown in FIG. 45E, the light holder 1100 is mounted to the brim 116 so that the mounting base 1104 thereof extends between the brim insert and the lower brim covering material 291, with the covering material 291 extending over the base 1104. The light holding portion 1110 extends through an opening 920 in the covering material 291. The opening 920 is sized to receive the light holding portion 1110 therethrough when the light holder 1100 is mounted in this manner. As shown, the light sources 1101 disposed within the light holder 1100 are coupled to the power source 962 mounted to the crown portion of a hat and the switch 941 mounted to the brim 116. The power source 962 is electrically connected to the switch 941, which are both electrically connected to the LEDs 1101 via electrical connections 960, such as wiring, traces, circuit boards, or the like. The LEDs 1101 can be connected in series or parallel, or a combination of both, depending on the desired illumination capability of the light holder 1100. For instance, the switch 941 may be configured to alternate between a full "on" state and a full "off" state. In such configuration, all four LEDs 1101 are connected in series or parallel and feed off a single wire coming from the switch 941. In another configuration, the switch 941 may be configured to sequentially illuminate the outer LEDs, then the inner LEDs, and then all of the LEDs in sequence. Other configurations are also possible, such as each LED 909 being separately connected to the switch 941 and/or a different order of activation when sequentially actuating the switch 941.

In another form and with reference to FIGS. 46-49D, the light holder 200 can be mounted to the brim portion via fasteners 1210 such as, for example, ¼ turn screws or other screw type fasteners. In such a mounting configuration, the mounting base 202 of the light holder 200 can include a plurality of holes 1212 for receiving the screws 1210 therethrough. Plugs 1213 may optionally be inserted into the holes 1212 after fastening. The brim portion 116 can include threaded inserts 1214 received therein that are spaced to correspond to the spacing of the holes 1212 through the mounting base 202. The covering material 291 of the brim can extend over the brim insert 287 to present a streamlined appearance with openings 1216 therein corresponding to the location of the threaded inserts 1214.

The fasteners 1210 can pass through the mounting base 202 and the covering material 291 to externally mount the light holder 200 to the outside surface 293 of the covering material 291 so that a portion of the covering material 291 extends between the mounting base 202 and the brim insert 287. In one form, the holes 1212 are each located inboard of the housings 222 and 224. In another form, the holes 1212 are each located outboard of the housings 222 and 224. Similarly, when the light holder 200 includes only a single housing 222, the holes 1212 can be located on opposite sides of the housing 222. This mounting configuration could also use a single hole 1212, or more than two holes 1212, with various locations through the mounting base 202 if desired.

Figure 49B:
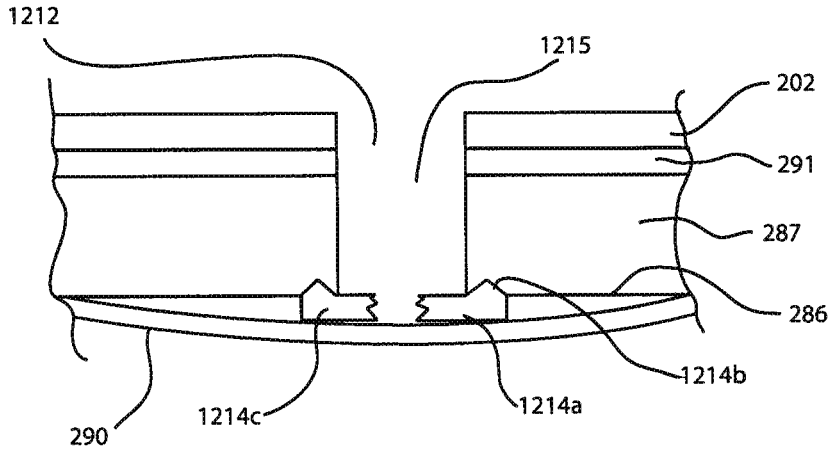
FIG. 49B is a front cross-section view of the externally mounted light holder of FIG. 46 showing a threaded nut mounted between a brim insert and a brim upper covering material.

In one approach, as shown in FIG. 49B, the threaded insert 1214 is in the form of a speed nut 1214*a* that includes a plurality of prongs 1214*b* extending from a periphery of a threaded base portion 1214*c*. In this approach, the brim insert 287 includes a fastener hole 1215 therethrough. The speed nut 1214*a* is located on the upper surface 286 of the brim insert 287 at the location of the fastener hole 1215. The light holder hole 1212 is aligned with the brim fastener hole 1215 so that the fastener 1210 will pass through the light holder 200 and the brim insert 287 to be received by the speed nut 1214, wherein the speed nut will be drawn toward the brim insert 287 such that the prongs 1214*b* grip the brim insert 287 and secure the light holder 200. In one form, the covering material 290 extends across the brim insert upper surface 286 with the speed nut 1214 therebetween. However, the cover material 290 could also include holes therethrough at the location of the fastener holes 1215 if later replacement of the speed nut 1214 is desired.

Figure 49C:
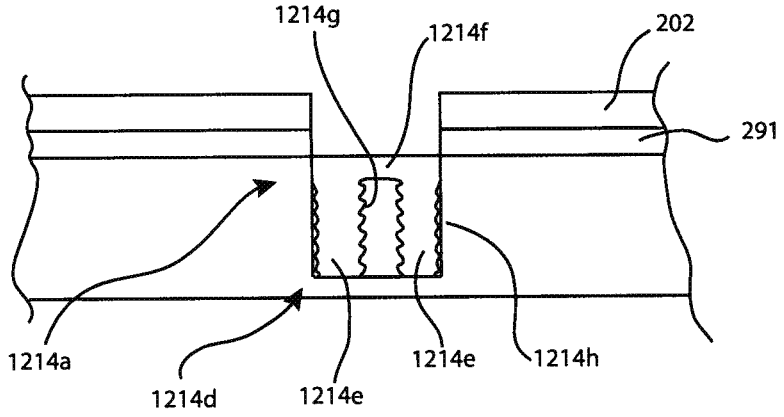
FIG. 49C is a front cross-sectional view of the threaded insert of FIG. 49A.

In another approach, as shown in FIG. 49C, the threaded insert 1214 is in the form of a press fit threaded insert 1214*d*. The press fit insert 1214*d* has a generally cylindrical shape and includes a pair of arm portions 1214*e* extending from a flange or base 1214*f* thereof. The arm portions 1214*e* have internal threading 1214*g* and a gripping external surface 1214*h*. The brim insert 287 can include a recess 1215*a* in which the press fit insert 1214*d* is received. The recess 1215*a* generally has a diameter that is slightly smaller than the outer diameter of the press fit insert 1214*d* so that the press fit insert is frictionally received within the recess 1215*a*. The light holder 200 is attached as described above with fasteners 1210 so that the arms portions 1214*e* will flex outward, creating a tighter fit between the insert 1214*d* and the recess 1215*a*. In another approach, the recess 1215*a* can be in the form of a through hole similar to hole 1215 described above. In another approach, the press fit insert 1214*d* can be configured to receive a quarter turn fastener.

In another approach, the threaded insert 1214 can be molded directly to the brim insert 287 during the brim molding process rather than being press-fit. In such an approach, the threaded inserts 1214 are disposed in the brim similarly to the press-fit insert 1214, but without requiring a friction connection between the threaded insert 1214 and the brim insert 287.

Figure 49D:
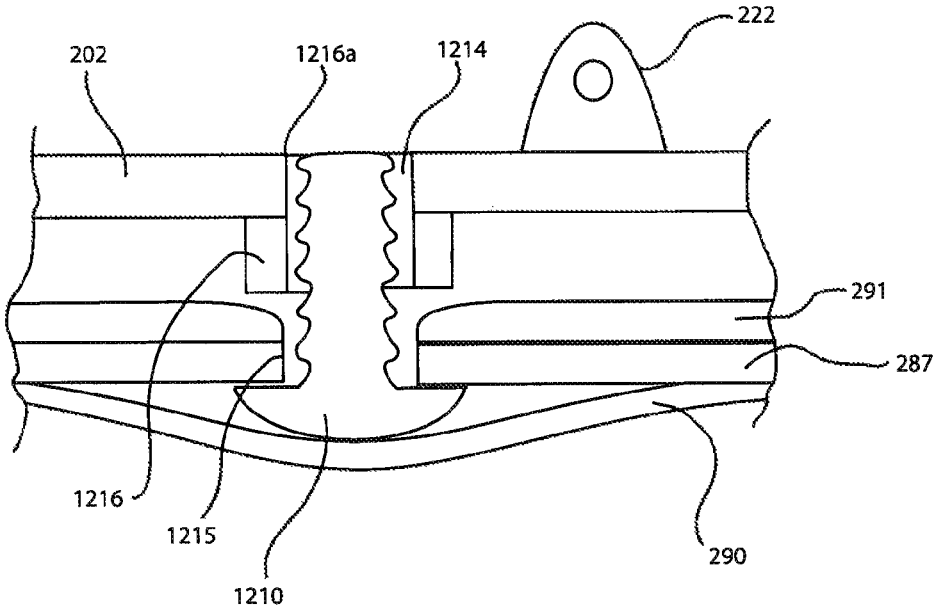
FIG. 49D is a front cross-sectional view of an externally mounted light holder with the light holder having a threaded insert mounted thereto.

As shown in FIG. 49D, in another approach, the threaded inserts 1214 can be installed in or mounted to the mounting base 202 of the light holder 200, with the fastener 1210 being screwed into the mounting base 202 through the brim. For example, the mounting base 202 can include one or more posts or projections 1216 extending from the upper surface 212 thereof. The posts 1216 can be of unitary construction with the mounting base 202, and having a cavity or through-hole 1216*a* therethrough for receiving the fastener 1210 therein. The cavity 1216 can be threaded or self tapping fasteners can be used to create the threaded connection therebetween. Similarly, the mounting base 212 could include the threaded inserts 1214 rather than the brim, or the speed nut 1214 could be disposed on the mounting base 202 rather than on the brim. In each case, the brim insert 287 includes the brim fastener hole 1215 so the fastener 1210 can pass therethrough to be received by the threaded connection of the mounting base 202.

Figure 50:
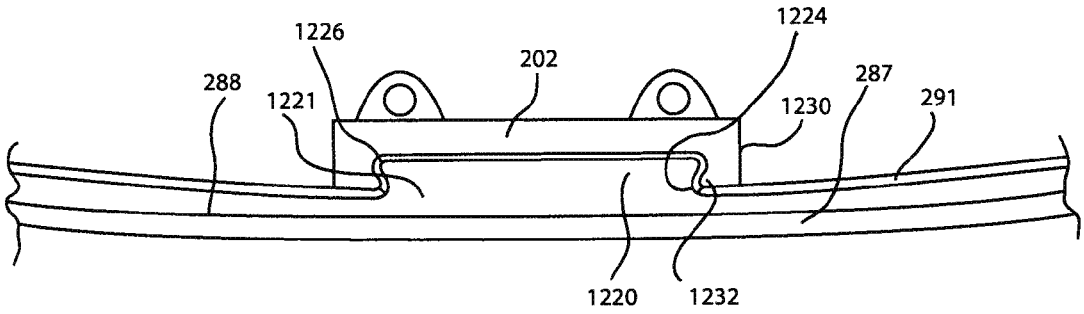
FIG. 50 is a front cross-sectional view of a light holder mounted to the brim of a hat via a snap fit connection.
Figure 51:
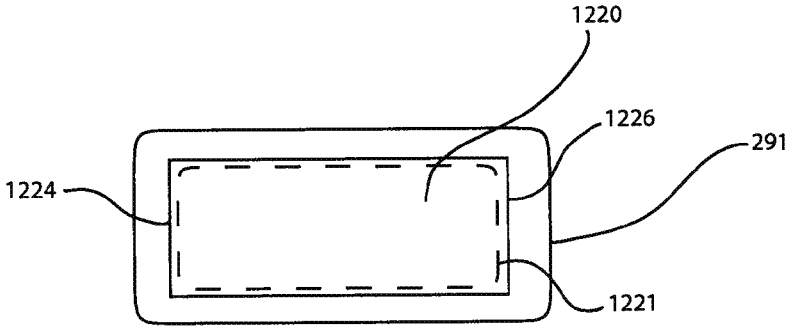
FIG. 51 is a top plan view of a portion of the snap fit connection of FIG. 50.
Figure 52:
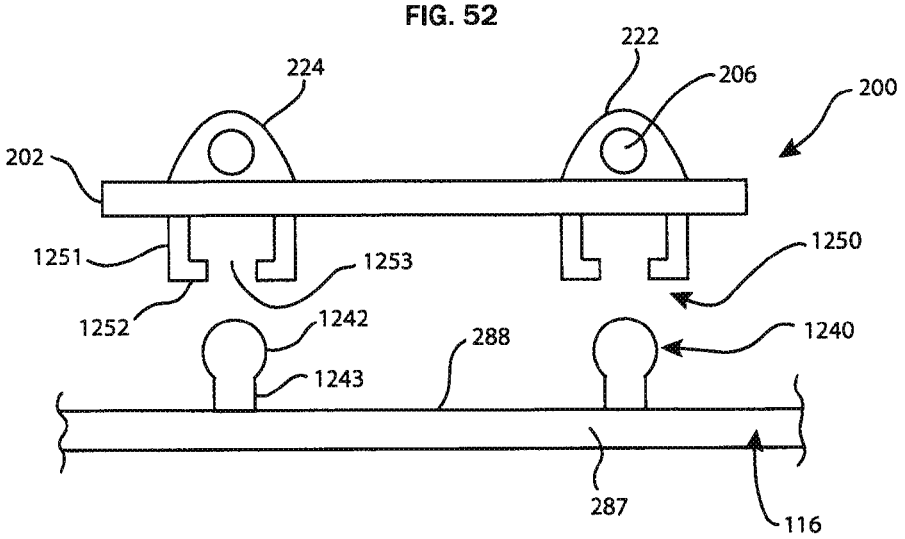
FIG. 52 is a front view of an alternative snap fit connection showing connection members mounted to a hat brim and connection member receptors mounted to a light holder.
Figure 53A:
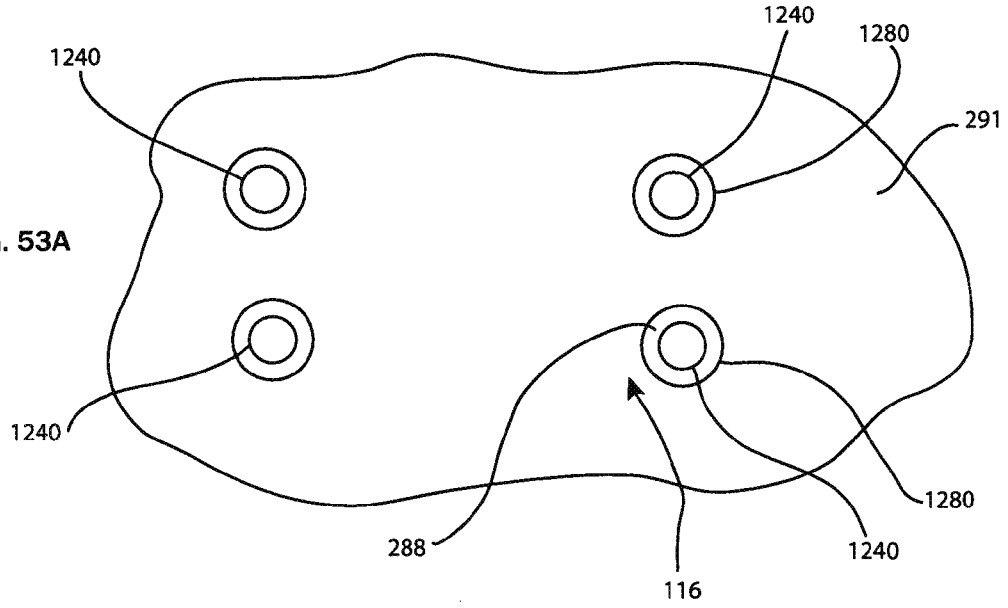
FIG. 53A is a top plan view of a portion of the snap fit connection of FIG. 52 showing a plurality of connection members mounted to the brim of a hat.
Figure 53B:
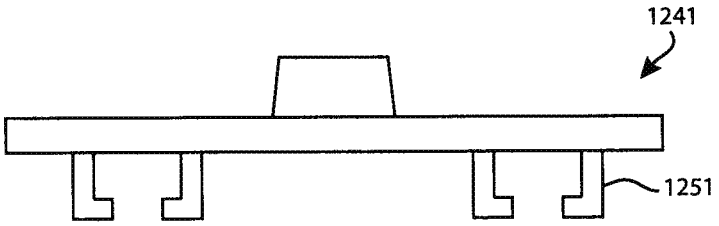
FIG. 53B is a front view of a switch device having connection member receptors.
Figure 53C:
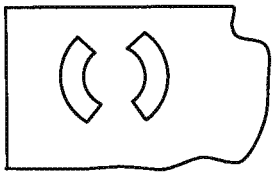
FIG. 53C is a plan view of the connection member receptors of FIGS. 52 and 53B.
Figure 60B:
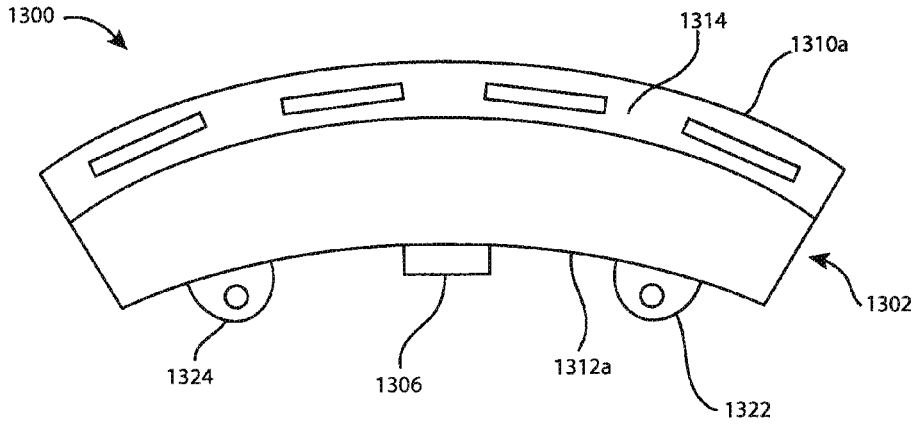
FIG. 60B is a front cross-sectional view showing the light module of FIG. 58 with a housing having a curved profile.
Figure 60C:
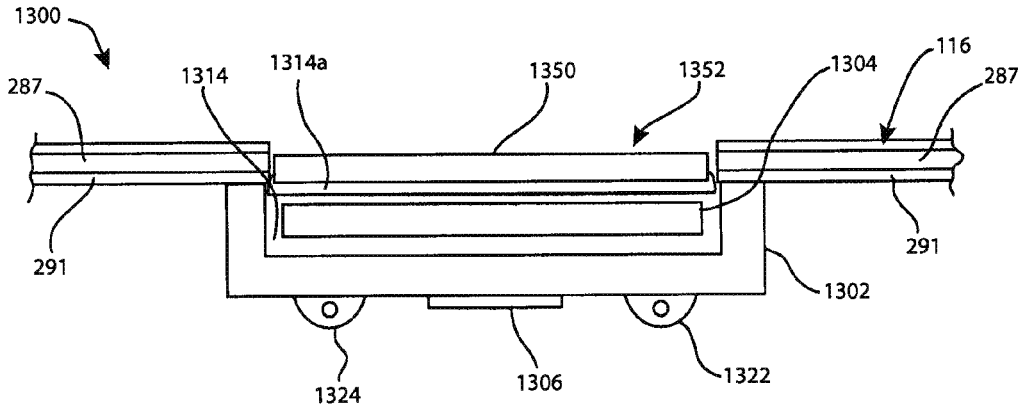
FIG. 60C is a front cross-sectional view showing the light module of FIG. 58 having a solar cell mounted to an upper surface of the housing.
Figure 60D:
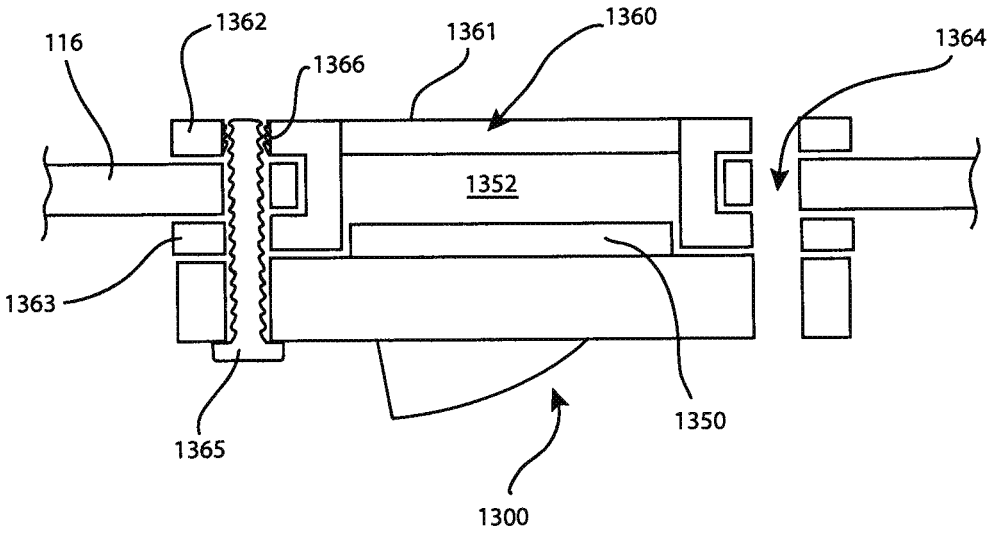
FIG. 60D is a front cross-sectional view of the light module of FIG. 60C showing a covering portion mounted above the solar cell.
Figure 63B:
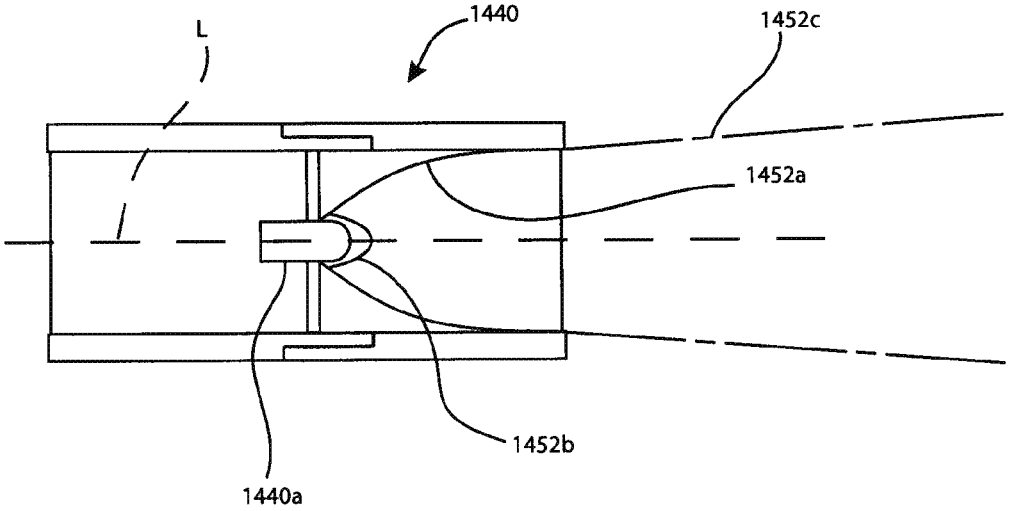
FIG. 63B is a side cross-sectional view showing a parabolic reflector of the upper light device.

In another example and with reference to FIGS. 50-57, the light holder 200 can be mounted to the brim portion 116 via a snap fit connection. With reference to FIGS. 50 and 51, in one form, the snap fit connection can include a coupling member/portion or mounting protrusion 1220 extending away from the lower major surface 288 of the brim insert 287. The upper major surface of the brim insert can have a similar configuration. The brim portion 116 can include covering material 291 extending across the lower major surface 288 of the brim insert 287 with an opening 1221 therein aligned with the mounting protrusion 1220 so that the mounting protrusion can extend therethrough. The size of the opening 1221 generally conforms to the footprint of the coupling member 1220, which in the illustrated form is generally rectangular. The coupling member 1220 may be integrally formed with the brim insert 287 or can be a separate component secured thereto. The coupling member 1220 is generally box-shaped, having a generally rectangular configuration. In one form, the coupling member 1220 includes two undercut portions 1224 on opposite sides thereof for making the snap fit connection. The couple member 1220 can further include rounded edges 1226 to make snap fit connection easier. The undercut portions 1224 are configured for receiving corresponding portions of the mounting base 202 as and the edges 1226 are configured for being received by corresponding portions of the mounting base 202 for completing the snap fit connection, as further described below.

The mounting base 202 includes an upwardly extending pair of arms or cam portions 1230 configured to be received by the undercut portions 1224 of the coupling member 1220. The cam portions 1230 include inwardly extending finger or flange portions 1232 that can resiliently flex outwardly to cam around the edges 1226 of the mounting protrusion 1220, so that the undercut portions 1224 can receive the finger portions 1232. The cam portions 1230 may have a greater height than the height of the coupling member 1220 to create a space between the mounting base 202 and the coupling member 1220 so that electrical wiring can extend from between the mounting base and the protrusion for connection to various electronic components described herein, such as a power source or switch. The mounting base 202 is generally mounted externally in this configuration so that the covering material 291 extends between the cam portions 1230 and the brim insert 287. In another form, the brim insert can include the cam portions 1230, with the mounting base 202 having the coupling member 1220 for creating the snap fit connection.

In another form of snap fit connection and referring now to FIGS. 52-57, the brim portion 116 can include a plurality of connection members or posts 1240 extending from the lower major surface 288 of the brim insert 287. The posts 1240 are preferably integrally formed within the brim insert 287, but can be mounted thereto as desired. The posts 1240 can include a rounded head portion 1242 for being received by a corresponding reception portion of the light holder 200. The head portion 1242 is generally wider than a base 1243 of the post 1240 so that the head 1242 can be secured in the snap fit connection. In one form, the brim insert 287 includes four spaced posts 1240; however, other numbers of posts 1240 can also be used, such as two, three, five, six, or more. The posts 1240 can be centrally located along the brim axis B at center of the lower major surface 288 of the brim insert 287 for centrally mounting the light holder 200; however, the posts 1240 can also be located at different areas along the brim insert 287 depending on the desired location of the light holder 200.

The mounting base 202 includes a plurality of connection member receptors or arm pairs 1250 extending therefrom for receiving the posts 1240 of the brim portion 116. Each arm pair 1250 includes two or more opposing arms 1251 with inwardly extending fingers 1252 that define an opening 1253 between the fingers 1252. The arms 1251 are configured to resiliently flex outwardly when receiving the heads 1242 of the posts 1240. The rounded head 1242 of the post 1240 will deflect the fingers 1252 outwardly so that the fingers 1252 will cam around the head 1242 and snap back inwardly once the head 1242 is received above the fingers 1252 and the fingers 1252 align with the relatively smaller width of the base 1243. The arms 1251 have a generally curved shape (FIG. 53C) for receiving the head 1242. In this manner, the heads 1242 of the posts 1240 are secured within the arm pairs 1250 so that the light holder 200 is secured to the brim 116. The mounting base 202 will be generally spaced from the lower major surface 288 of the brim insert 287 so that the electrical connections of the light holder 200 can extend from between the mounting base 202 and the brim insert 287 for connecting to other electrical components, such as a power source or a switch. In an alternative configuration, the posts 1240 could extend from the light holder 200 and the arms 1251 could extend from the brim insert 287, or a combination of arms 1251 and posts 1240 could extend from both the light holder 200 and the brim insert 287 in order to ensure a proper mounting orientation.

The brim insert 287 can also similarly include a second set of posts 1240*a* located off to the side of the plurality of posts 1240 used for mounting the light holder 200. This additional plurality of posts can be used to connect other components, such as a switch device 1241 or other control panel (FIG. 53B) for actuating the light source 206 mounted to the light holder 200. For example, the switch device 1241 could include connection member receptors 1251 for mounting to the posts 1240*a*. In another form, the switch device 1241 could include the posts 1240*a* with the brim insert 287 having the connection member receptors 1251 for creating the snap fit connection.

In one approach, the brim insert 287 can also include covering material 291 extending over the brim portion lower surface 288. The covering material 291 can include openings 1280 for allowing the posts 1240 to extend therethrough. In this mounting configuration, the covering material 291 will extend between the brim insert 287 and the mounting base 202.

The brim insert 287 can include a peripheral edge portion 1260 and a thin inner portion 1261. In one approach, the edge portion 1260 is about 2.5 mm thick and 5 mm wide, and the inner portion 1261 is about 1 mm thick. The thin inner portion 1161 reduces the weight of the brim insert 287 relative to a brim insert 287 having a generally uniform thickness. The edge 1260 provides stability to the brim 116 and creates the appearance of a uniform brim thickness. In one approach, the brim insert 287 can further include a thick inner wall portion 1262 adjacent the snap fit connection for providing additional stability to the brim 116.

The upper covering material 290 can extend over the upper major surface 286 of the brim insert 287 for providing an aesthetically pleasing appearance of the brim 116. The covering material 290 can wrap around the raised edge 1260 of the brim insert 287 and across the lower major surface 288. The edge portion 1260 can tend to space the covering material 291 from the lower major surface 288 of the brim insert 287. When the light holder 200 is mounted via the snap fit connection, the brim covering material 291 can tend to abut the mounting base 202, creating the appearance the brim 116 is of uniform thickness.

In another embodiment and with reference to FIGS. 58-60D, a light holder or light module 1300 can include a housing 1302 having a body 1303 with a fore-and-aft centerline axis P with a power source 1304 and switch device 1306 mounted thereto or received therein. The combination of the light holder 1300, power source 1304, and switch 1306 creates a light module assembly 1308 that can be preferably mounted to the brim 116 as a unit, and easily removed or replaced if necessary. In one form, the housing 1302 has a generally elongate shape and includes an upper portion 1310 and lower portion 1312. The lower portion 1312 can have two bezels 1322 and 1324 extending therefrom for receiving light sources 1326 and 1328, respectively. Alternatively, a single bezel 1322 could be used having one or more light sources therein, such as one of the bezels described above. As described above with respect to other light holder embodiments, the light sources 1326 and 1328 can be LEDs configured to project a cone of light along an axis of inclination. The axis of inclination of the LED corresponds to the axis of inclination of the bezels that receive and orient the LEDs therein. That various light cones, LED sizes and power, etc. referenced above with respect to other light holder embodiments could be used with light holder 1300. Moreover, the bezels can take any of the forms discussed herein.

The upper portion 1310 includes a power source compartment 1314 for receiving the power source 1304 therein. The compartment 1314 can include an outer door 1314*a* or other covering portion for securing the power source 1304 therein. The power source 1304 can be a plurality of disc shaped batteries, rechargeable batteries such as a lithium ion battery or nickel-metal hydride battery, cylindrical shaped batteries, such as AA or AAA batteries, capacitors, or other removable and/or rechargeable power sources. The power source 1304 is electrically connected to the switch device 1306 and the LEDs 1326 and 1328 by wires, traces, circuit boards, or the like. The switch device 1306 can be in the form of a pushbutton switch or a slide switch, or other suitable switch devices.

The switch device 1306 is mounted to a lower outer surface 1316 of the lower portion 1312 of the housing body 1303 for easy access by a user when the hat is being worn. In one form, the switch device 1306 is mounted to the general center of the lower outer surface 1316; however, the switch device 1316 can also be mounted to other locations of the housing, such as to a front surface 1316*a*, rear surface 1316*b*, or side surface 1316*c* of the housing 1302. The bezels 1322 and 1324 also extend from the lower outer surface 1316. In one form, the two bezels 1322 and 1324 are located on laterally opposite sides of the switch device 1306. The bezels 1322 and 1324 can each include a single LED or two or more LEDs as previously described with respect to the various light holder embodiments. In another form, the switch device 1306 can be mounted to one side of the lower outer surface 1316, with a single bezel or housing 1322 extending from the other side. The bezels 1322 and 1324 can be configured to receive the LEDs 1326 and 1328 to direct beams of light at various angles, orientations, intensities, colors, etc. as described above with respect to the various light holder embodiments. For example, the bezel 1322 could include two or more LEDs having different angles of inclination similar to light holder 350 described above.

The assembly 1308 includes electrical connections or wiring 1331 and/or a printed circuit board 1332 that connect the power source 1304, the switch 1306, and the LEDs 1326 and 1328. Therefore, the assembly 1308 does not require connection to an outside power source or switch to operate the assembly 1308; however, the assembly 1308 could also include such an auxiliary electrical connection if desired to connect to other components. The assembly 1308 can be mounted externally to the brim 116 in the variety of ways mentioned herein. For example, the assembly 1308 can include a plurality of holes 1330 through the body 1303 so the assembly 1308 can be mounted to the brim 116 via screws and threaded inserts, or the housing could include the threaded inserts or similar and the fasteners could extend through the brim 116 as previously described above with respect to other embodiments. In another form, the assembly 1308 can connect to the brim via the snap fit connections described above. The light holder 1300 is preferably mounted externally so that the covering material 291 extends between the upper portion 1310 and the brim insert 287. Therefore, the light holder 1300 can be removed as a unit and be changed, repaired, replaced, etc.

In one approach, the assembly 1308 can have a generally curved shape for cooperating with the curved shape of the brim 116. For example, the upper portion 1310 can have a generally convex outer surface 1310*a* and the lower portion 1312 can have a generally concave outer surface 1312*a*. The battery compartment 1314 can have a curved shape to conform to the upper portion curved lower surface 1310*a*.

In another approach, the light holder 1300 can include a solar cell 1350. The solar cell 1350 can be mounted to the upper portion 1310. In one approach, the solar cell 1350 can be mounted to the battery compartment cover 1314*a*. The light holder 1300 can be mounted to a brim 116 of a hat via one of the mounting approaches described above with respect to other light holders. In one approach, the light holder 1300 is mounted externally so that the covering material 291 extends between the light holder 1300 and the brim insert 287. The brim 116 can further have an opening 1352 therethrough having a location and shape corresponding to the solar cell 1350 so that the solar cell 1350 will receive ambient light through the opening 1352. The solar cell 1350 is electrically connected to the power source 1304 for charging the power source 1304. In one approach, the opening 1352 is located generally along a fore-and-aft centerline of the brim 116 between the crown portion and a brim outboard edge; however, other mounting locations could also be used.

The brim 116 can also include a cover portion 1360 having a transparent portion 1361, such as glass or plastic. The cover portion 1360 is disposed across the opening 1352 so that ambient light can pass therethrough for reaching the solar cell 1350 while protecting it from damage and providing the brim 116 with an aesthetically pleasing appearance. The cover portion 1360 can include upper and lower flange portions 1362 and 1363 that are configured to receive the brim 116 therebetween. The flange portions 1362 and 1363, as well as the brim 116 sandwiched therebetween, can include one or more through-holes 1364 for receiving a fastener 1365 therethrough. The fastener 1365 can mount the light holder 1300 to the cover portion via the threaded connections previously described herein, such as with threaded inserts 1366 mounted to the cover portion 1360, speed nuts, self tapping fasteners screwed into the cover portion 1360, or the like. Similarly, the light holder 1300 could include the threaded insert or the like, with the fastener extending from above and through the brim 116.

Referring now to FIGS. 61-75, another exemplary form of lighted headgear 1400 is illustrated having a crown portion 1402 and a brim portion 1404. The headgear includes a lower light source 1406, preferably an LED, mounted to a lower surface 1408 of the brim portion 1404, and an upper light source 1410, preferably an LED, mounted to an upper surface 1412 of the brim 1404. The brim 104 may include a brim insert portion 1405. The lower light source 1406 can be mounted to the lower surface 1408 via a light holder 1414. The brim lower surface 1408 may also include a brim lower covering material 1415 that extends across the brim insert 1405. The light holder 1414 and lower light source 1406 can be one of the various light holder embodiments previously described for mounting one or more light sources to a lower surface of a brim including both internal and external mounting configurations previously described herein. In one form, the upper light source 1410 is a three Watt LED having approximately 80-100 lumens and the lower light source 1406 is one or more 10,000 MCD LEDs; however, other energy level LEDs could also be used.

Turning now to the upper light source 1410, a hinge base 1420 is mounted to the brim upper surface 1412. The hinge base 1420 includes a generally flat base portion 1422 and a pair of hinge mounts 1424 extending from an upper surface 1426 of the hinge base 1422. The hinge mounts 1424 include holes 1428 therethrough with a central hinge axis H running therebetween. The generally flat base portion 1422 includes a fore-and-aft axis P that is generally perpendicular to the hinge axis H. The brim portion 1404 can include upper surface covering material 1430 extending over the brim insert 1405, and the base portion 1422 can be mounted externally to the upper surface covering material 1430. Alternatively, the hinge base 1420 can be mounted directly to the brim portion 1404, with the covering material 1430 having an opening 1432 for the hinge mounts 1424 to extend therethrough. Moreover, the hinge base 1420 can be mounted to the brim portion 1404 according to the previously described mounting methods for the other light holder embodiments described herein, such as with adhesive, sewing, Velcro, ultrasonic welding, mechanical connections, or the like.

The upper light source 1410 is mounted to the brim upper surface 1412 via a hinge connection. The upper light source 1410 is received within a light holder 1438 in the form of a "headlight style" light housing assembly 1440. The housing assembly 1440 has a generally elongate shape and includes a light housing member 1442 with a depending hinge portion 1444 that is preferably integral with the housing member 1442. The depending hinge portion includes a hole 1445 therethrough for connecting to the hinge base 1420. The housing member 1442 includes the upper light source 1410 mounted therein. The housing member 1442 includes electrical connections 1446 extending therefrom. The housing member 1442 preferably includes external threading for connecting a cover member 1450 thereto. The cover member 1450 includes corresponding internal threading for connecting to the housing member 1442. The cover member 1450 further includes a cone shaped light focusing and enhancing member 1452 having a generally parabolic shape. The cover member 1450 includes a transparent window or lens 1454 for the beam of light to project therethrough.

The housing assembly 1440 has a central axis L along which the upper light source 1410 is oriented. The upper light source 1440, in the form of an LED, is configured to project a beam of light therefrom along the axis L. Thus, as the housing assembly axis L is pivoted about the hinge axis H, the direction of the beam of light from the upper light source 1410 can be adjusted. The upper light source 1410 is mounted within the housing assembly 1440 inward of a forward end 1450*a* so that the beam of light is received by the enhancing member 1452. The light beam will intersect the enhancing member 1452 for being reflected therein to provide for an enhanced and directed beam of illumination along the axis L. In one form, the enhancing member 1452 is in the form of a parabolic reflector 1452*a* that receives an LED 1440*a* within a cone or lens portion 1452*b* of the parabolic reflector 1452*a*. The resulting beam of light 1452*c* is in the form of a spot beam configured to illuminate far away distances such as greater than 50 feet. Of course, closer distances are illuminated as well. In one form, the LED 1440 is coupled to a heatsink (not shown) for dissipated heat therefrom.

The light housing assembly 1440 is pivotably mounted to the hinge base 1420 to create the hinge connection. A cylindrical hinge member 1456 extends through the hole of the depending hinge portion 1444 and is secured at each end to the hinge mounts 1424 of the hinge base 1420. The hinge portion 1444 is frictionally mounted to the hinge mounts 1424, so the light housing assembly 1440 with the upper light source 1410 therein can be pivoted about the hinge axis H and held in place by the friction of the hinge connection. Therefore, the hinge connection allows the light housing assembly 1440 to be manually adjusted for projecting light upwardly from the brim portion 1404, forwardly from the brim portion 1404, or even downwardly from the brim portion 1404. When adjusted to the project light downwardly, the brim 1404 can block a portion of the beam of light to shield the user's eyes while providing illumination to areas forwardly and downwardly from the user. In one form, when the light housing assembly 1440 is angled downwardly such that it contacts the brim 1404, the angle of inclination Z between a fore-and-aft brim axis B and a central axis L of the light housing assembly 1420 is about 12.5 degrees; however other angles of inclination could also be used. The friction between the hinge base 1420 and the hinge portion 1444 allows the positioning of the light housing assembly 1440 to remain relatively stationary until further adjustment by the user.

In another form, the hinge portion 1444 could extend from the hinge base 1420 with the hinge mounts 1424 depending from the light housing assembly 1440 to create the hinge connection. In another form, the hinge connection could be in the form of a ball-and-socket connection between the hinge base 1420 and the light housing assembly 1440 so that the light housing assembly can be rotationally adjusted in addition to being pivotably adjusted.

Figure 70:
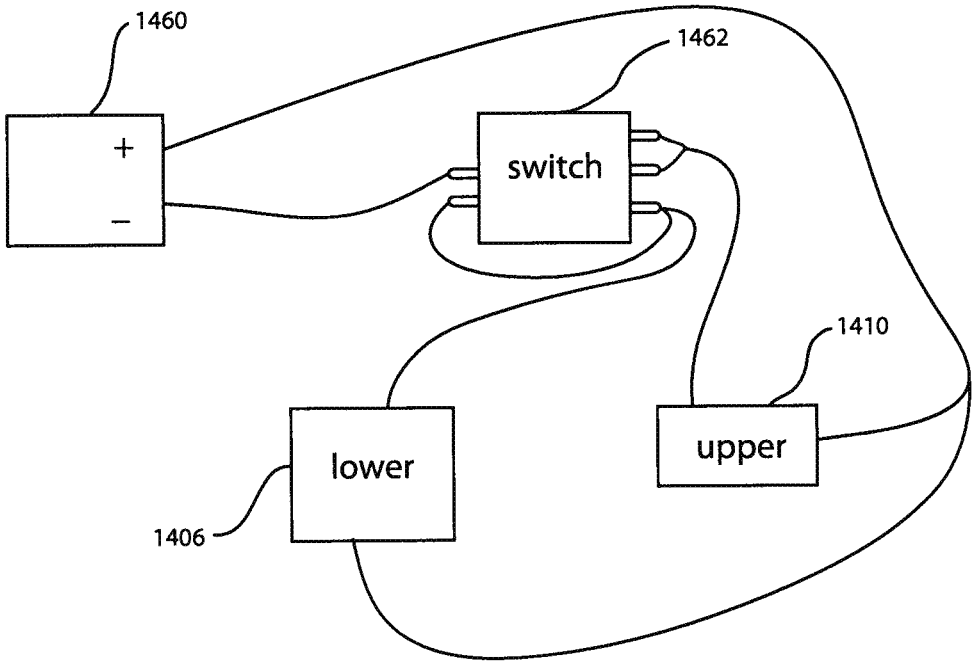
FIG. 70 is a schematic view of the electrical connections of FIGS. 68 and 69.
Figure 71:
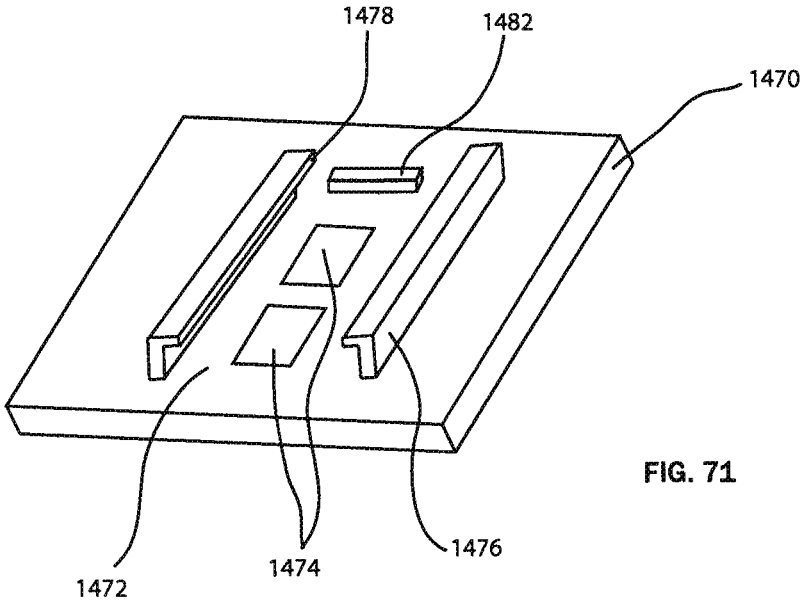
FIG. 71 is a perspective view of a hinge base receptor for mounting an alternative embodiment of the upper light device of FIG. 61.
Figure 72:
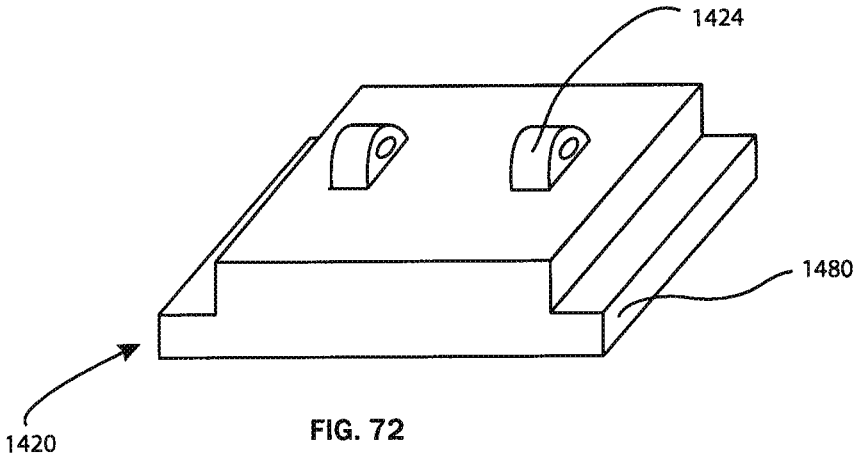
FIG. 72 is a top perspective view of an alternative hinge base configured for mounting to the hinge base receptor of FIG. 71.
Figure 73:
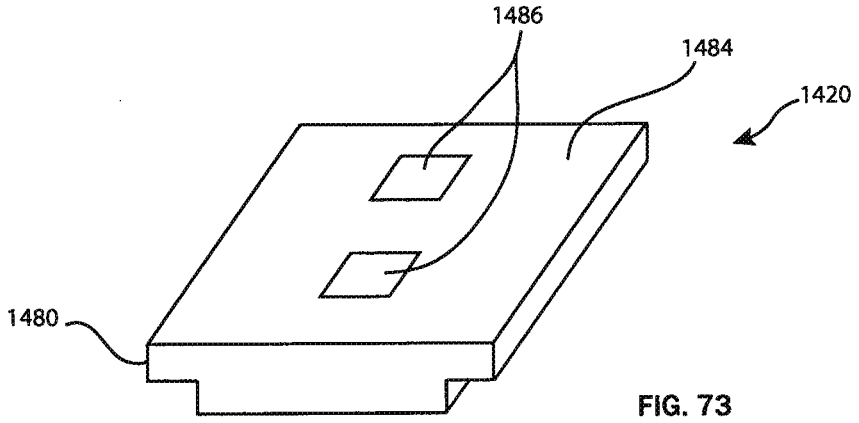
FIG. 73 is a bottom perspective view of the alternative hinge base of FIG. 72.
Figure 74:
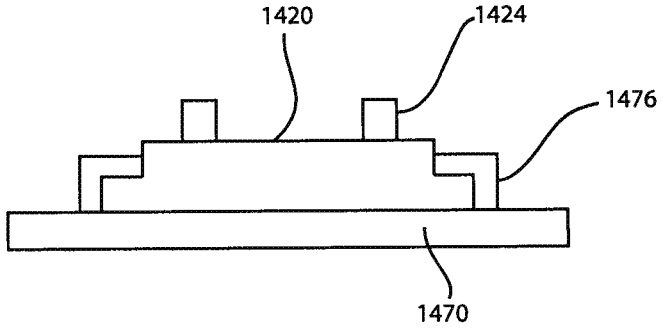
FIG. 74 is a front cross-sectional view showing the connection between the alternative hinge base and the hinge base receptor.
Figure 75:
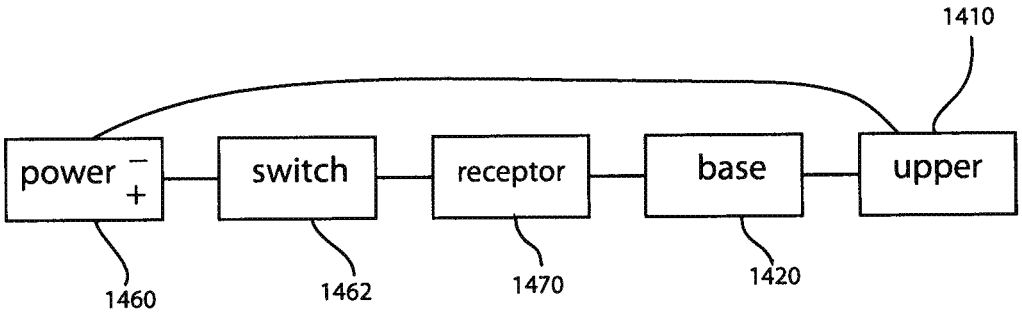
FIG. 75 is a schematic view of electrical connections between the hinge base receptor and the hinge base for connecting the upper light device to the switch device and power source of the hat.

As shown in FIGS. 68-70, the light housing assembly 1440 and the lower light source 1406 mounted to the brim lower surface 1408 are electrically connected to a power source 1460 and a switch device 1462 mounted to the hat 1400. The power source 1460 can be mounted to the crown portion 1402. The switch device 1462 can be mounted to the brim portion 1404. The electrical connectors 1446 of the light housing assembly 1440 can extend through a hole 1447 in the brim 1440 to connect with electrical wiring 1449 for connecting the power source 1460, the switch device 1462, the light housing assembly 1440 having the upper light source 1408, and the lower light source 1406. The electrical wiring 1449 is preferably sandwiched between the brim lower covering material 1415 and the brim insert 1405. A schematic of the electrical connection of the upper light source 1408, the lower light source 1406, the power source 1460, and the switch device 1462 is illustrated in FIG. 70; however other electrical connections could also be used.

In another form, and with reference to FIGS. 71-75, the light housing assembly 1440 and hinge base 1420 can be removably mounted to the brim upper surface 1412 via a sliding connection. A hinge base receptor 1470 is mounted to the brim upper surface 1412 via adhesive, fasteners, or other known connection methods. The hinge base receptor 1470 includes a generally flat surface or floor portion 1472 having electrical connections 1474 thereon. The hinge base receptor 1470 also includes a pair of wall portions 1476 with inward facing cantilevered edges 1478. The light housing assembly 1440 is configured similar to the above description, with a depending hinge portion 1444 pivotably mounted to the hinge mounts 1424 of the hinge base 1420. In this configuration, the hinge base 1420 is mounted to the hinge base receptor 1470 rather than to the brim upper surface 1412. The hinge base 1420 includes a mounting flange 1480 that corresponds to the shape of the wall portions 1476 of the hinge base receptor 1470 so the hinge base 1420 can be slidably received within the wall portions 1476. The hinge base receptor 1470 will frictionally receive and hold the hinge base 1420 therein. The hinge base receptor 1470 can further include a stopwall portion 1482 to ensure the hinge base 1420 is properly received within the hinge base receptor 1470.

The hinge base 1420 further includes a lower surface 1484 having electrical connections 1486 thereon that correspond to the electrical connections 1474 of the floor portion 1472. The hinge base 1420 is received within the hinge base receptor 1470 to create the sliding connection therebetween that aligns the electrical connections 1486 and 1474 completing an electrical connection therebetween. The light housing assembly 1440 is electrically connected to the hinge base 1420 via a wiring harness or the like. The hinge base receptor 1470 is electrically connected to the power source 1460 and the switch 1462 via electrical wiring 1490. Thus, the upper light housing assembly 1440 can be electrically connected to the power source 1460 and switch 1462 through the sliding connection between the hinge base 1420 and the hinge base receptor 1470 for providing power and actuating the operation of the upper light source 1410, as illustrated schematically in FIG. 75. In another form, the hinge base 1420 and hinge base receptor 1470 can be free of electrical contacts, with the second light source 1410 being electrically connected to the power source 1460 and switch 1462 via an auxiliary connection.

Figure 76:
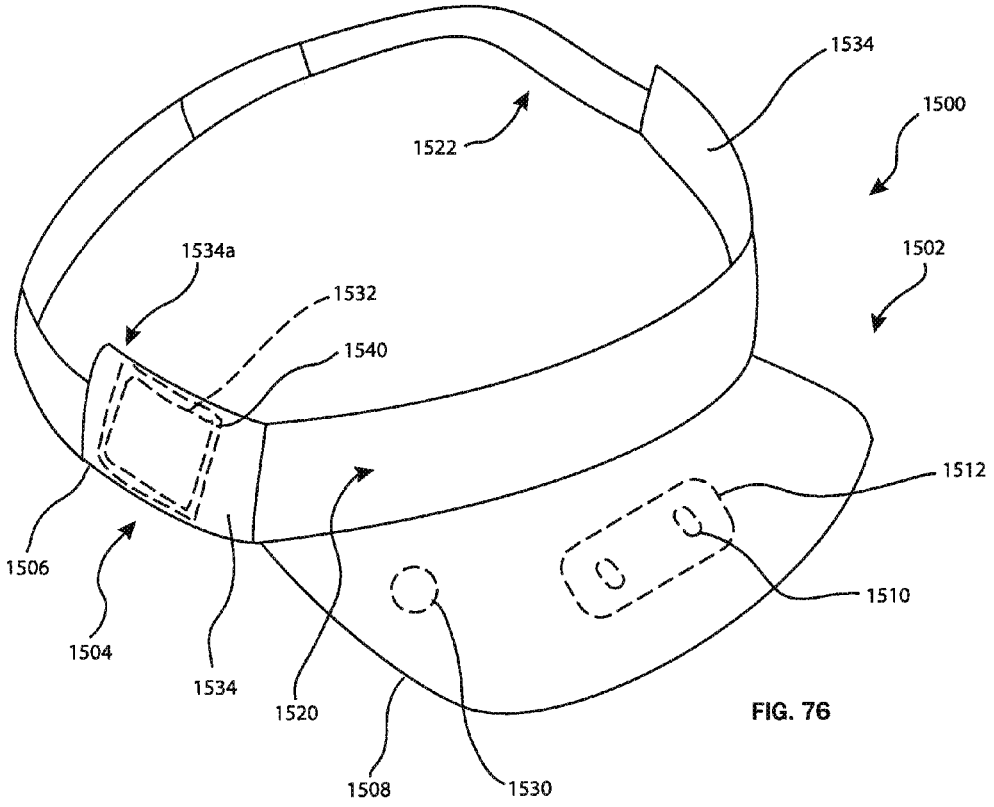
FIG. 76 is a perspective view of an alternative lighted headgear having a power source mounted thereto.
Figure 77:
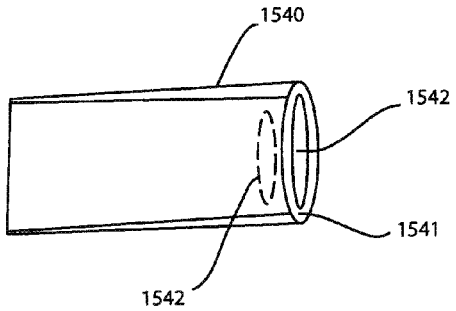
FIG. 77 is a perspective view of a pouch for receiving the power source of FIG. 76.
Figure 80:
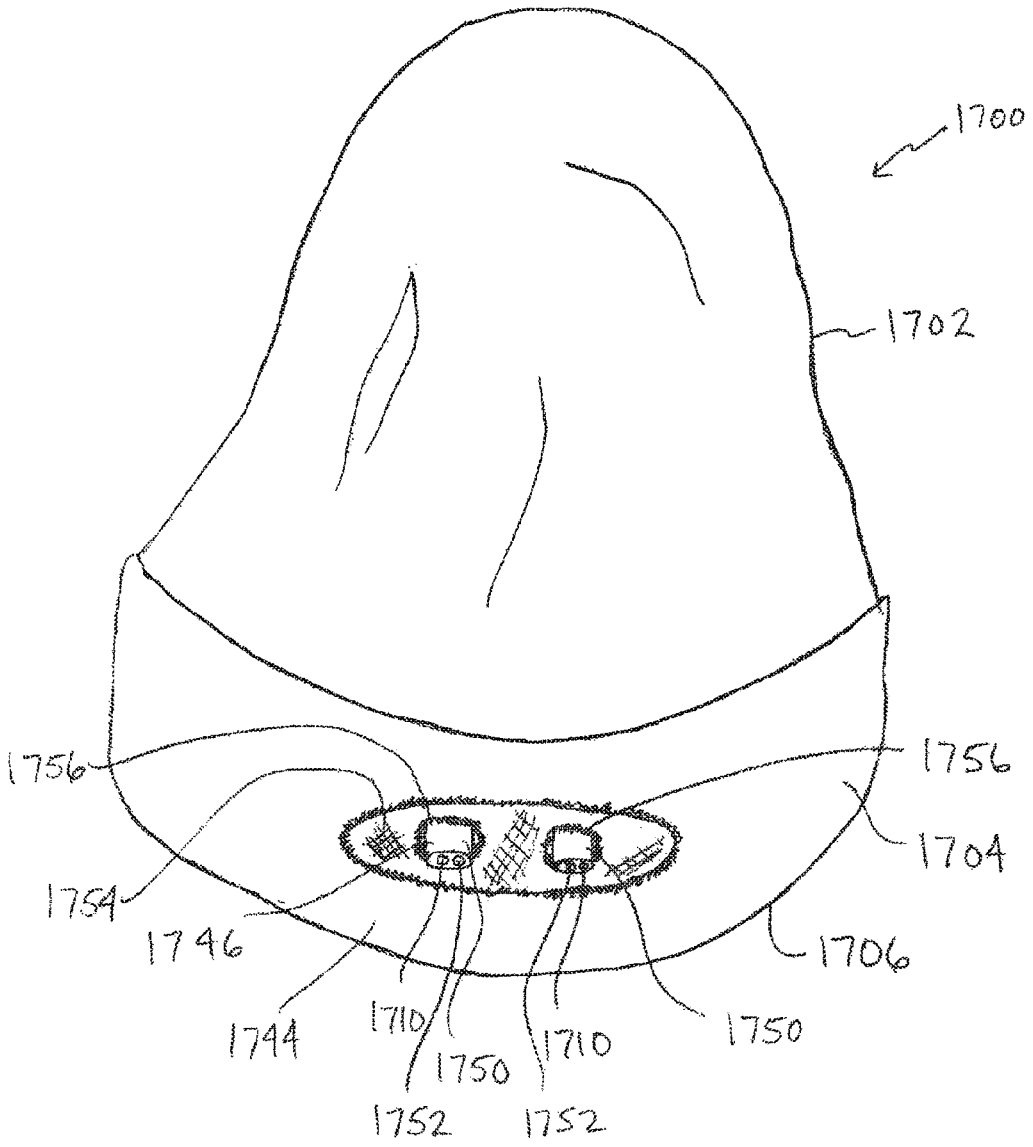
FIG. 80 is a perspective view of a lighted cap showing bezel portions of a light holder mounted in a hat band of the lighted cap projecting through opening in the hat band.
Figure 81:
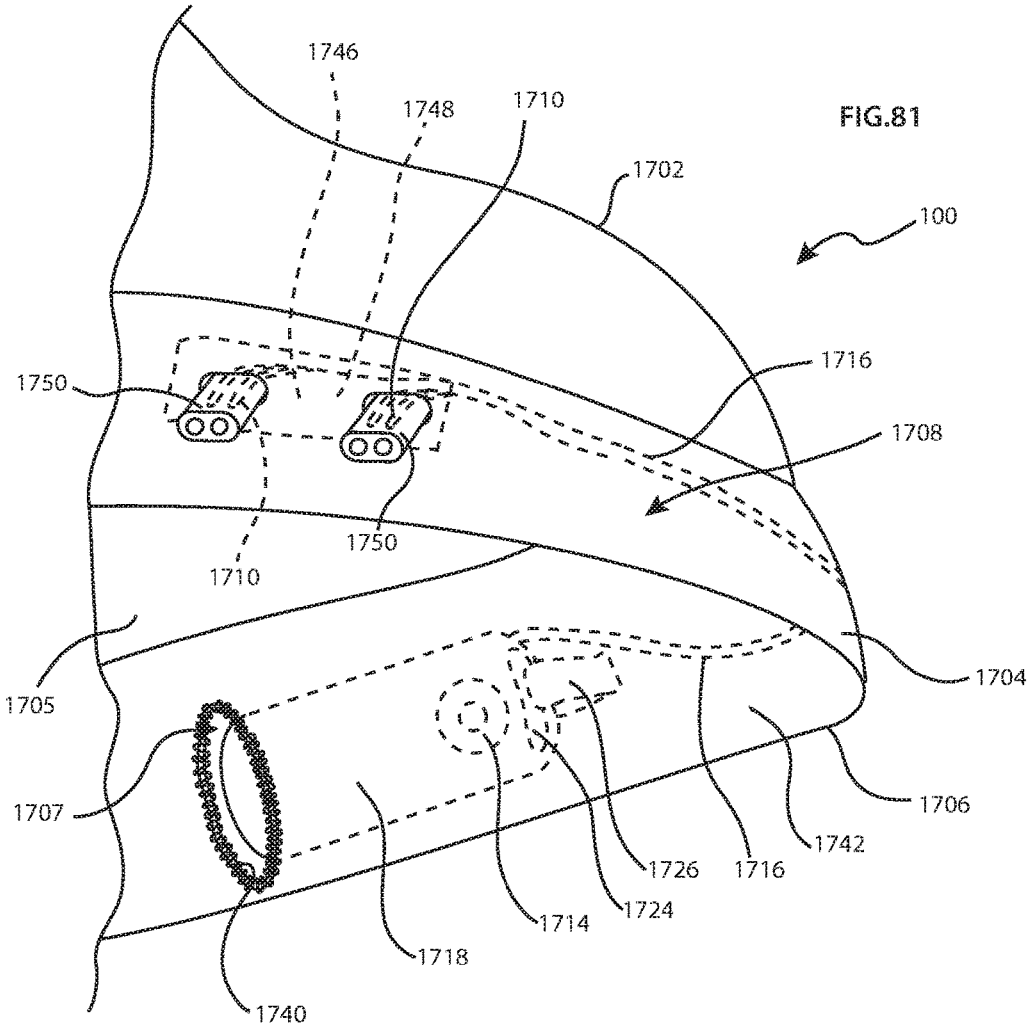
FIG. 81 is a sectional view of the lighted cap of FIG. 80 showing in phantom the light assembly mounted within the hat band including light sources, a power source, a switch device, and electrical connections therebetween.

With reference to FIGS. 76-77, an alternative lighted headgear 1500 is provided in the form of a visor 1502. The visor includes a head fitting portion 1504 in the form of a band 1506, and a brim portion 1508 extending in a forward direction from the band 1506. One or more light sources 1510 can be mounted to the brim portion via a light holder 1512. The light holder 1512 and method of mounting can correspond to the various embodiments previously described herein with respect to lighted hats.

The band 1506 can include a front portion 1520 for wicking away sweat similar to the front portion of a baseball cap sweatband. The band 1506 can also include a rear portion 1522 extending from opposite sides of the front portion and being connected at the rear opposite the brim portion 1508. The front portion 1520 has a relatively higher profile than the rear portion for covering a user's forehead and/or allowing for indicia to be shown thereon. The rear portion 1522 has a relatively lower profile for providing airflow to the user's head and a streamlined appearance. In one form, the rear portion 1522 is made of an elastic material. In another form, the rear portion 1522 can be a relatively inelastic fabric material similar to the front portion that has an adjustable connection such as Velcro or other rear cap connection types.

A switch device 1530 is mounted to the brim portion 1508 for actuating the light source 1510. A power source 1532 is mounted to the band 1506 for providing power to the light source 1510.

The power source 1532 is preferably mounted to the front portion 1520 due to the higher profile hiding the power source 1532 from view. The front portion 1520 includes a pair of front side portions 1534 extending from opposite sides of the brim 1508. The front side portions 1534 are configured to extend along the side of a user's head for providing a comfortable mounting location for the power source 1532. For instance, if the power source 1532 were mounted to the front portion 1520 adjacent the brim 1508, the power source could press against a user's forehead and cause discomfort. The side portions 1534 include an inner pouch 1540 having an opening 1541 for receiving the power source 1532. In one form an optional Velcro style fastener 1542 closes the pouch 1540 securing the power source 1532 therein. The front portion 1520 can extend to various distances away from the brim 1508. For instance, the front portion 1520 can extend such that the rear portion 1522 is minimized or even eliminated, such that the front side portions 1534 connect to each other at the rear of the headgear. The pouch 1540 is preferably mounted adjacent a rearward end 1534*a* of one of the front side portion 1534. For example, if the side portions 1534 extend behind the ears of a user, the pouch 1540 would be located behind the ears of the user. If the side portions 1534 extend to the rear of the band 1506 so that they connect to each other, the pouch 1540 would be located at the back of a user's head.

With reference to FIGS. 78-79, headgear such as a lighted hat 1600 is provided having a crown portion 1602 and a brim portion 1604 extending forwardly therefrom. The lighted hat 1600 includes a light source mounted to the brim 1604 electrically connected to a switch device and a power source according to one of the various embodiments described herein. The lighted hat 1600 includes a removable covering portion 1610 extending across an upper surface 1612 of the brim 1604. The covering portion 1610 has a generally curved profile having a similar shape and curvature as the brim upper surface 1612 so the covering portion 1610 and brim 1604 will have a streamlined appearance. The covering portion 1610 can include indicia or other marking for describing or decorating the lighted hat 1600.

The covering portion 1610 is secured to the crown portion 1602 via a pair of stakes 1614. The stakes 1614 can be made from a nylon material or other flexible material. The stakes 1614 have opposing "T" shaped ends 1615. The covering portion 1610 includes a pair of holes 1616 through opposite sides of the covering portion 1610. The holes 1616 are preferably located adjacent the intersection of the brim 1604 and the crown portion 1610 when the covering portion 1610 is disposed on the brim 1604. The stakes 1614 are inserted through the holes 1616 and further through the stitching of the crown portion 1602. The "T" shaped ends 1615 are flexible and resilient so that they will flex when inserted through the holes 1616 and/or the crown portion 1602, and flex back to extend across the holes 1616 and or the crown portion 1610. The covering portion 1610 can thereby be secured to the lighted hat 1600 for providing removable indicia thereon. Mounting the covering portion 1610 in this manner allows for a user to pivot the covering portion 1610 about the two stakes 1616 to lift the covering portion 1610 away from the brim 1604 to view the brim upper surface 1612. The covering portion 1610 can also be easily removed by cutting the stakes 1614 when the covering portion 1610 is no longer desired. While the covering portion 1610 has been described with reference to a lighted hat, the covering material 1610 can also be used for other headgear such as visors, traditional baseball caps, or the like, with or without light and power sources mounted thereto.

A lighted stocking cap 1700 is shown in FIGS. 80-88 sized to fit on the head of a wearer. The stocking cap 1700 has a dome-shaped crown 1702 with a lower hat band portion 1704 that extends around a lower edge portion 1706 of the stocking cap 1700. In one form, the hat band 1704 includes a section of crown material that is doubled over and secured to an inner surface 1705 of the crown 1702, such as by stitching, adhesive, ultrasonic welding, or the like. As such, the hat band 1704 includes the loop of crown material forming an enclosed pocket 1707 extending around the lower portion of the stocking cap 1700. The stocking cap 1700 can be of a fabric material and can have elastic properties if desired.

The lighted cap 1700 further includes a lighting assembly 1708 that is mounted thereto to generally project light forwardly or more specifically forwardly and downwardly from the cap 1700. The lighting assembly 1708 includes one or more light sources 1710, a power source 1712, a switch device 1714, and electrical connections 1716, such as wires, circuit boards, traces, or the like, extending therebetween.

Figure 88:
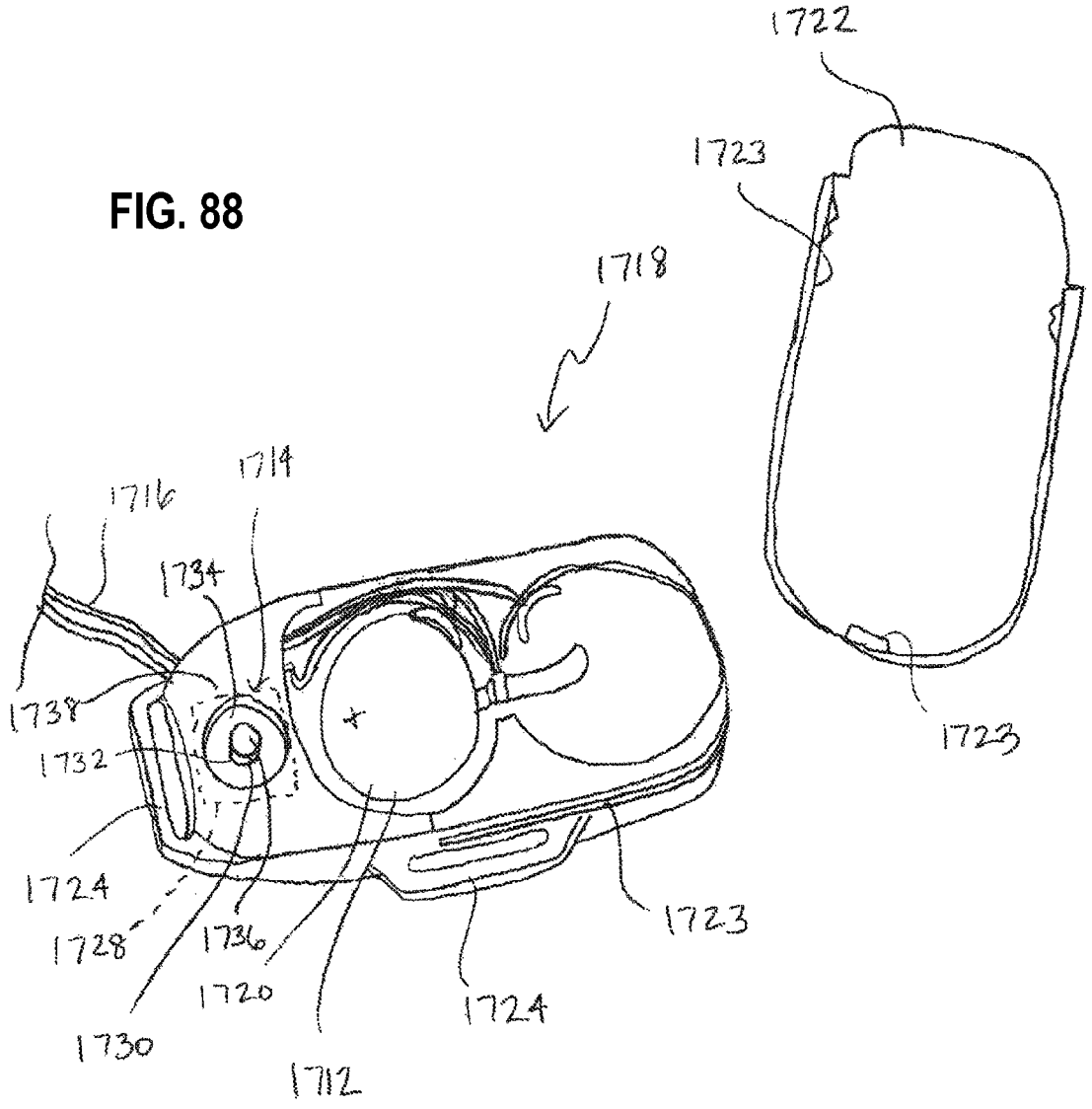
FIG. 88 is a perspective view of a power source module compartment having a cover removed to show a battery and a switch device.

Turning now to FIG. 88, the power source 1712 can be contained in a power source module which can include a power source housing 1718 sized to receive one or more batteries 1720 therein. The batteries 1720 can be replaceable batteries, such as coin cell, AA, AAA, or the like. In this form, the housing 1718 can further include a removable or moving door 1722, that can pivot or slide on the housing 1718 such as via a tongue and groove structure 1723, so that a user can remove and replace the batteries 1720. Alternatively, the battery 1720 can be a rechargeable battery and, as such, the housing can be sealed together against opening, if desired. The housing 1718 can also include a handle or loop 1724 on an end or side thereof sized to receive a loop of material 1726 therethrough, which can then be secured to the cap 1700 as by stitching. As such, the loop of material 1726 secures the housing 1718 to the cap 1700.

The housing 1718 can further be sized to receive the switch device 1714 therein. In the illustrated form, the switch device 1714 is a push button switch device having a switch base 1728 and a switch actuator 1730 that projects away from the switch base 1728 and is shiftable with respect thereto. As such, the switch base 1728 can be disposed within the housing 1718 and the housing 1718 includes an opening 1732 sized to receive the actuator 1730 therethrough. The actuator 1730 is then accessible to a user of the lighted cap 1700 to shift the light sources 1710 between on and off configurations.

In order to protect against inadvertent actuation, the housing 1718 can include a recessed well 1734 having the opening 1732 centrally therein. The activation point of the actuator 1730, i.e., the point at which the light sources 1710 are switched between on and off configurations, can then correspond to a location where an upper surface 1736 of the actuator 1730 is shifted from above to being below a raised surface 1738 of the housing 1718 extending around the recess 1734 and the actuator 1730 therein. With this configuration, the switch device 1714 cannot be actuated by pressing the housing 1718 against a flat surface, such as could easily happen if the cap 1700 were left on a table, for example. Instead, a user has to at least partially press the actuator 1730 down into the recess 1734.

Advantageously, the housing 1718 and the loop of material 1726 can be secured and disposed within the pocket 1707 of the hat band 1704 to substantially keep the housing 1718 hidden from view. As such, the hat band 1704 can include an opening 1740 on an inner surface 1742 thereof so that a user of the cap 1700 can access the housing 1718 through the opening 1740 such as for replacing the batteries 1720 disposed therein.

In order to provide lighting forward of the cap 1700, the light sources 1710 are mounted to a forward portion 1744 of the cap, and more specifically to a lower, forward portion of the cap 1700 within the lower band 1704 thereof. The light sources 1710 can be mounted in any of the ways described above, including, for example, the modules and light holders mounted to the exterior surfaces of the brim portions. In this example, the exteriorly-mounted modules and light holders would mount to a forward surface of the cap 1700 rather than the brim portion as described above. In another example, as shown, the light sources 1710 are received within a light holder 1746 having a mounting base 1748 and one or more light holder or bezel portions 1750, such as those described above. In the illustrated form, the light holder portions 1750 are each sized to receive two light sources 1710 in two distinct cavities 1752 therein. The cavities 1752 of each light holder portion 1750 extend at different angles with respect to one another so that the light holder 1750 is configured to orient light sources to project light along axes that are at different angles with respect to the cap 1700 so that light is projected in different directions, such as disclosed with respect to FIGS. 15A-15H. As shown, however, the cavities 1752 can have the same dimensions so that the axes along which light is projected are substantially parallel and the light holder portions 1750 can have an elliptical cross-section.

Figure 83:
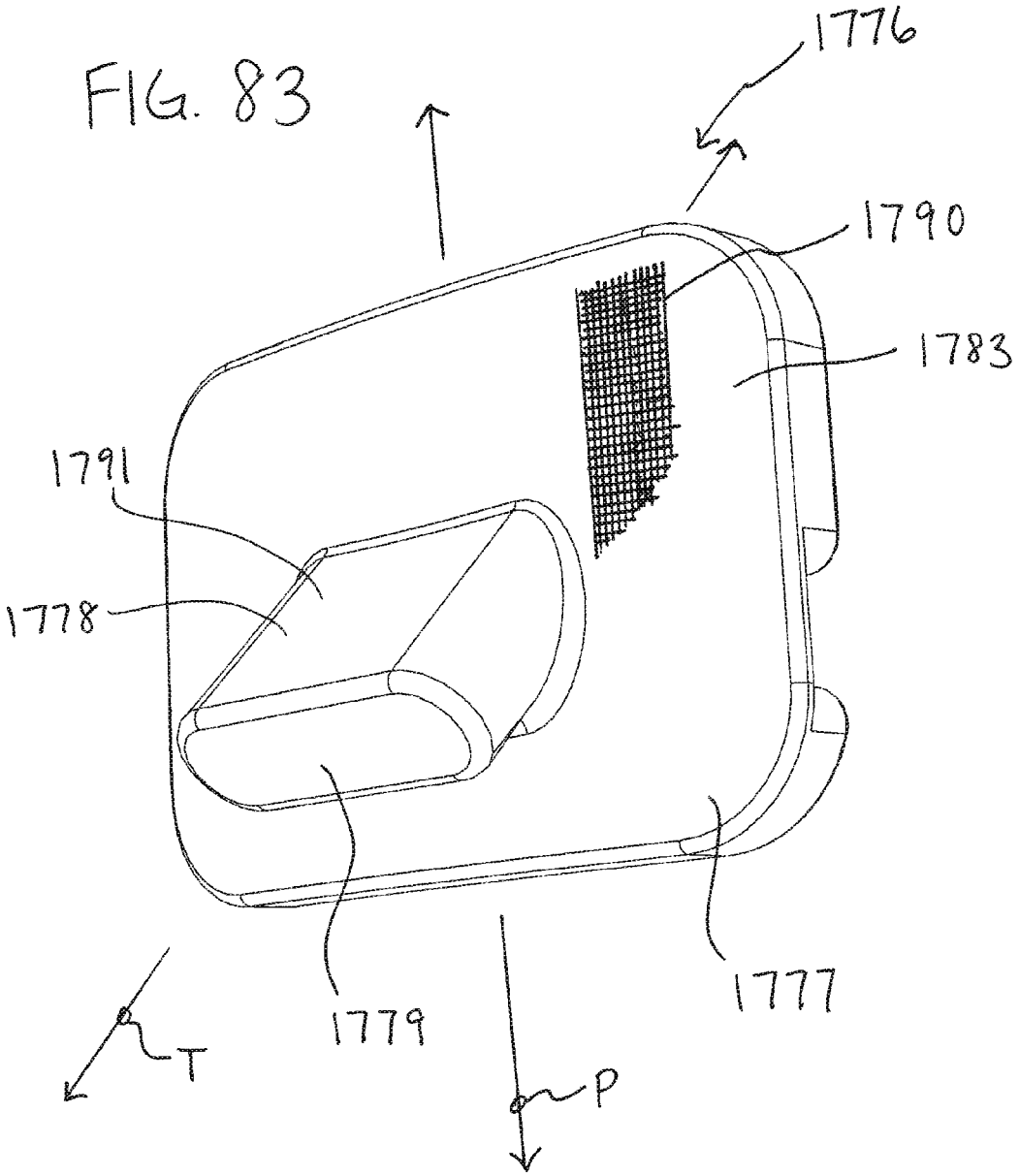
FIG. 83 is a front perspective view of a transparent or translucent light holder for being mounted to headgear having a light holding portion and a base portion.
Figure 84:
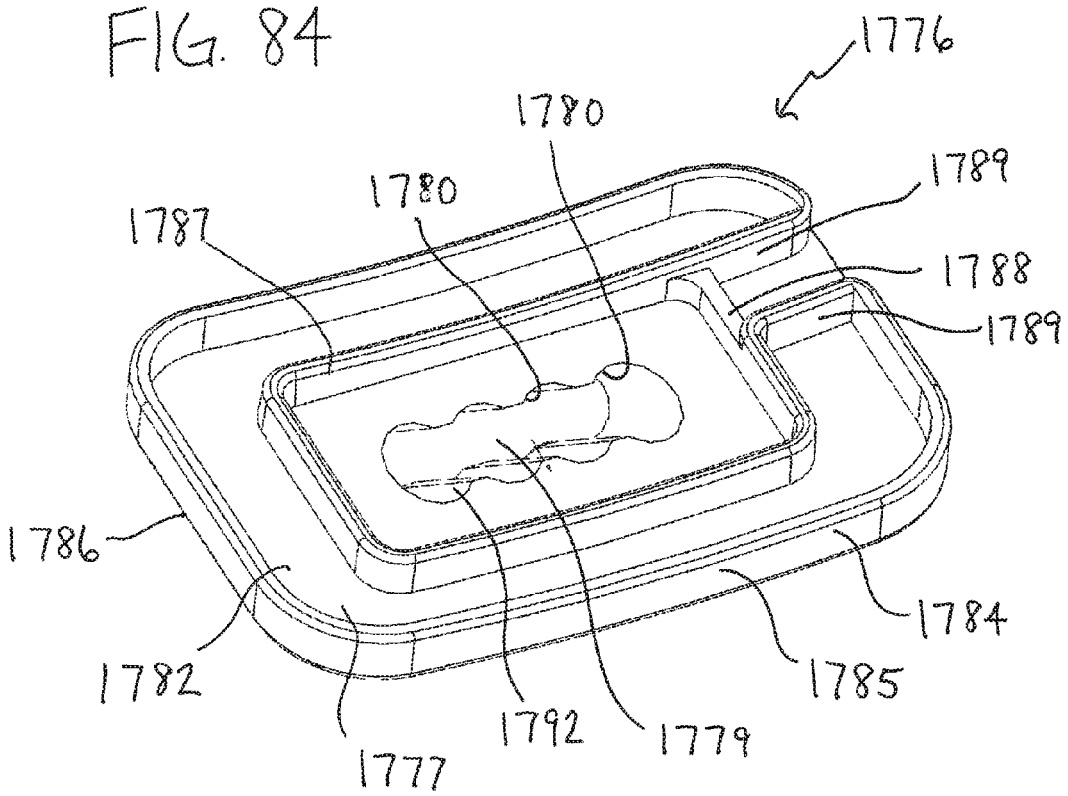
FIG. 84 is a rear perspective view of the light holder of FIG. 83 showing a cavity in the light holding portion for reception of light sources and upstanding wall portions of the base portion.
Figure 85:
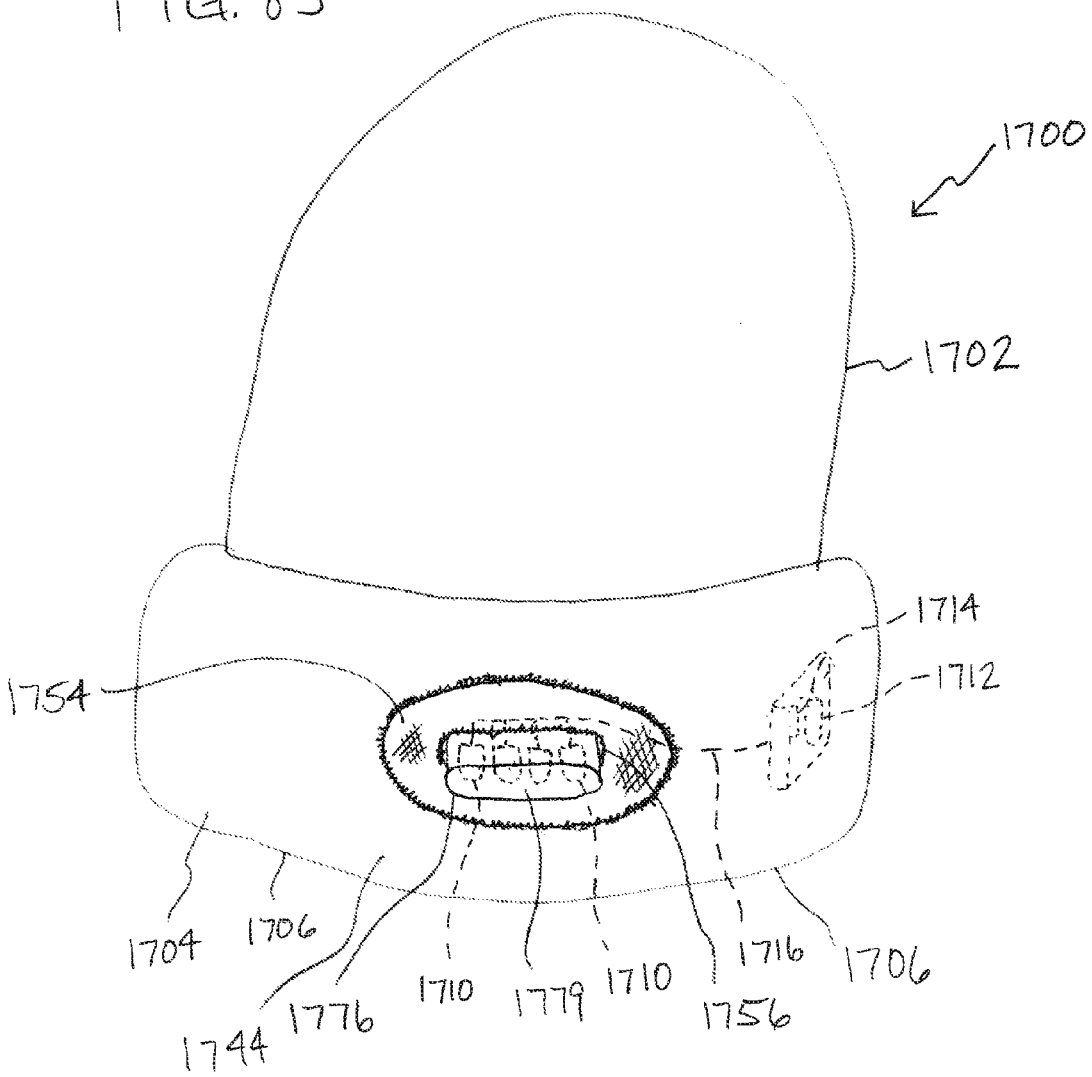
FIG. 85 is a perspective view of a lighted cap having a light assembly including the light holder of FIG. 83 mounted thereto.

An alternative light holder 1776 for the cap 1700 is shown in FIGS. 83-85. In this form, the light holder 1776 is made of a transparent or translucent material, such as a clear or semi-transparent plastic or the like. As such, when the light sources 1710 are disposed or mounted therein, light emitted therefrom will pass through the walls of the light holder 1776. This can be utilized to illuminate desired walls of the light holder 1776 and direct emitted light exteriorly thereof, e.g. the close and far distances discussed herein.

As shown, the light holder 1776 includes a base portion 1777 that extends along a fore-and-aft axis P and an outwardly projecting light-holding portion or bezel 1778, which can be integral or separate from the base 1777 as desired. The light-holding portion 1778 includes an outer wall 1791 that extends therearound and a distal end wall 1779. In the illustrated form, the light holding portion 1778 has an inclined configuration with a racetrack shaped cross-section in order to receive several of the light sources 1710 therein arranged a lateral row. In other configurations, circular or rectangular cross-sections can also be utilized, as well as stacked or arrayed light sources.

In contrast to the earlier embodiments, the distal end wall 1779 does not need to include any distal end openings therein to allow light emitted from the light sources 1710 to project to desired areas because of the light transmissive nature of the light holder 1776. In this regard, the end wall 1779 can extend over and across the light source to act as a cover therefor. The absence of openings in the end wall 1779 advantageously prevents debris from entering the light-holding portion 1778.

As shown in FIG. 84, the light-holding portion 1778 includes one or more cavities 1780 accessible through openings 1781 in a rear surface 1782 of the light holder 1776. So configured, the light sources 1710 can be inserted into the cavities 1780 through the rear surface 1782 of the light holder 1776 and the cavities can orient the light sources 1710 at a desired angle to emit light along desired a projection axis T. In the illustrated embodiment, the light holding portion 1778 includes four cavities 1780 therein extending generally along the same axis of inclination with respect to one another and with respect to the portion 1778 itself.

Rather than four separated cavities, the cavities 1780 shown are divided by inwardly extending curved projections 1792 configured to define individual, generally cylindrical cavities for reception of the light sources 1710. Alternatively, the cavities 1780 can be separated by dividing walls. In addition, the cavities 1780 can extend along different angles of inclination with respect to one other, as described in other embodiments herein, to project light to relatively near and far areas. Although the cavities 1780 are shown with a generally uniform diameter, a variety of diameters can be used to house a variety of different sized LEDs. Moreover, the light holder can alternatively include two or more portions 1778 as described herein to space the light sources 1710 along the base 1777.

The light holding portion 1778 encloses the light sources 1710 by extending laterally therearound and forwardly thereof. More specifically, the outer wall 1791 extends around the light sources 1101 and, combined with the end wall 1779, encloses the light sources 1710, which are then only accessible through the opening 1781 of the base 1777.

The light-holding portion 1778 extends away from the base 1777 at a downward inclination of between about 30 degrees and about 70 degrees. Of course, the cavities 1780 within the portion 1778 can extend along different axes than that of the portion 1778 itself. Moreover, the portion 1778 need not be inclined at all. Instead, the cavities 1780 can extend through the portion 1778 at desired angles to orient the light sources 1710.

As shown in FIGS. 84 and 85, the base 1777 includes a front surface 1783 and the rear surface 1782 with upstanding walls 1784 projecting away from the rear surface 1782. The base 1777 can be generally planar or curved to conform to the forehead of a wearer of the cap 1700. Alternatively, or in addition, the base 1777 can be constructed from a flexible material so that it will flex to conform to the forehead of a wearer.

As shown in FIG. 85, the walls 1784 of the base 1777 include an outer wall portion 1785 that extends around a majority of a perimeter 1786 thereof and an inner wall portion 1787 that generally encircles the openings 1781 to the cavities 1780. The inner and outer wall portions 1785 and 1787 provide additional structure to the base 1777, as well as space the rear surface 1782 from the cap material. This structure provides a convenient space for the electronics connecting the light sources 1710 to the power source 1712 and the switch device 1714. As such, the inner wall portion 1787 can include a cut-out or shortened portion 1788 so that the electrical connections 1716 are within the space provided by the walls 1784. If desired, the outer wall portion 1785 can connect to the inner wall portion 1787 on either side of the cut-out 1788 forming a channel 1789 for the electrical connections 1716.

For some applications, it may be desirable to block incident light from passing through one or more walls of the light holder 1776. In this case, an opaque material 1790 can be applied over or adhered to areas of the light holder 1776 in which light-blocking is desired. For example, the opaque material can be applied over some or all of the front surface 1783 of the base 1777 and/or the outer wall 1791 of the light-holding portion 1778. The opaque material 1790 can also be applied on the end wall 1779 of the portion 1778 to define circular openings to align with the light sources 1710 and focus or orient the light projected therefrom.

Additionally, if desired, selected portions can be removed or excluded from the opaque material so that the light sources will illuminate the selected portions when energized. This could advantageously be utilized to show a design, such as a logo or other graphical or alphanumeric message, such as described above and shown in FIGS. 45A-45E. Alternatively, the logo can simply have a different thickness than adjacent portions of light holder so that the logo has a different appearance.

Next, the cap 1700 can include a mounting patch 1754, as discussed above, extending along a portion of the hat band 1704. The mounting patch 1754 includes openings 1756 therein sized to allow the light holder portions 1750, 1778 to extend therethrough so that the mounting base 1748, 1777 abuts and extends adjacent to an inner surface of the mounting patch 1754. The mounting patch 1748 provides a surface to mount the light holder 1746, 1776 that is configured so that adhesive disposed therebetween will generally not wick all the way forwardly through the cap band concealing the adhesive from view, but securely attaching the light holder 1746, 1776 to the cap 1700. The lighting assembly 1708 can then be fully received within the loop of material of the hat band 1704 with the wires 1716 extending between the light sources 1710 and the power source housing 1718. This conceals the lighting assembly 1708 from view and spaces the assembly 1708 from the head of a wearer.

Figure 82:
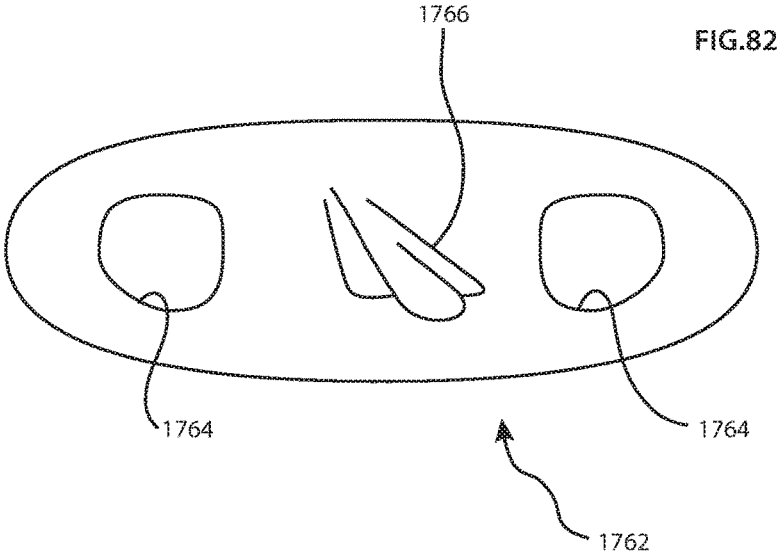
FIG. 82 is a top plan view of an appliqué for securing to fabric showing openings thereof that are configured to receive light holder bezel portions therethrough.

By another approach, a stand-alone patch member or appliqué 1762, such as that shown in FIG. 82 can be ultrasonically welded to the cap 1700, and specifically the hat band 1720 thereof, using standard equipment. The appliqué 1762 is constructed of a suitable material for ultrasonic welding, such as an elastomer. Moreover, the appliqué 1762 can include openings 1764 therein configured to align with openings in the hat band, such as the openings 1756 described above, configured to allow the light holder portions 1750, 1778 to extend therethrough. With this approach, the appliqué 1762 would prevent any adhesive used to attach the light holder 1746, 1776 to the cap 1700 from being visible. Additionally, the appliqué 1762 can have a logo 1766 or other indicia printed or embossed thereon for easy branding or decoration of the cap 1700.

Another form of cap 1770 is shown in FIGS. 86 and 87. The cap 1770 of this form includes the dome-shaped crown 1702 with the lower hat band portion 1704 and can include the loop of crown material forming the enclosed annular pocket 1707 extending around the lower portion of the stocking cap 1700. The lighted cap 1770 further includes the lighting assembly 1708, described above, mounted thereto to generally project light forwardly or forwardly and downwardly from the cap 1770. The lighting assembly 1708 of this form also includes the one or more light sources 1710, the power source 1712, the switch device 1714, and the electrical connections 1716 extending therebetween.

Rather than projecting through the opening 1756 or 1764 described above, however, the light sources 1710 of this form are mounted to a back mounting plate 1772 that is configured to be secured to the forwardly facing portion 1744 of the cap 1770, such as by ultrasonic welding, stitching, adhesive, or the like. Leads of the light sources 1710 pass through the back plate 1772 into the pocket 1707 to electrically connect with the other components of the lighting assembly 1708, including the power source 1712 and the switch device 1714. The back plate 1772 can be sized to accommodate any number of light sources 1710 thereon, such as three as shown in FIG. 86, less than three, such as one or two, or more than three. Next, a lens or transmissive cover portion or member 1774 is mounted to the back plate 1772, such as by ultrasonic welding, adhesive, or the like, so that the light sources 1710 are captured between the lens member 1774 and the back plate 1772. So configured, the light sources 1710 are protected against damage from water. Alternatively, the lens portion 1774 can be integral with the back plate and the light sources 1710 disposed therebetween. If desired, the light sources 1710 can be mounted to project light forwardly, as shown, or can be canted to project light forwardly and downwardly.

Figure 89:
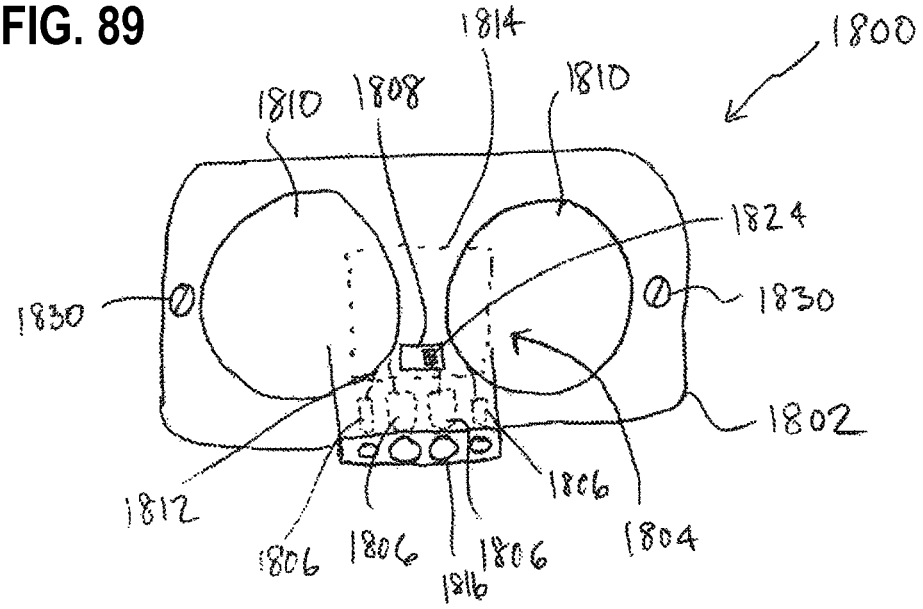
Figure 90:
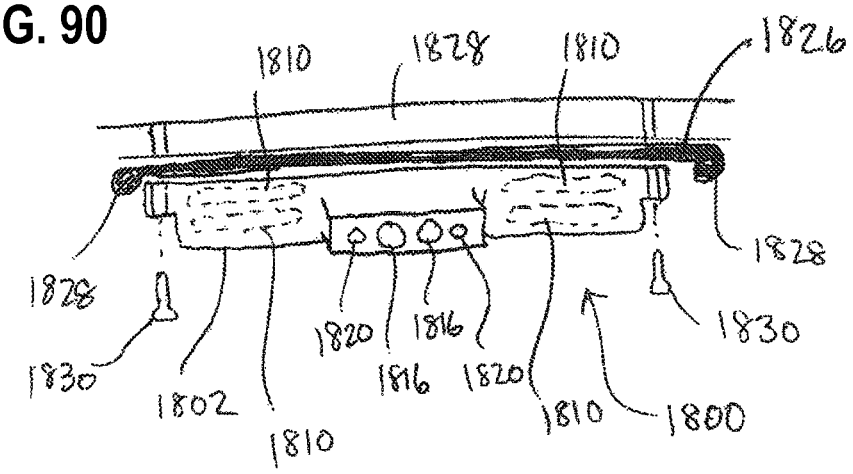

FIGS. 89 and 90 are directed to a light module 1800 that has a housing 1802 having a lighting assembly 1804 therein. The lighting assembly 1804 includes one or more light sources 1806, a switch device 1808, and a power source 1810 all operably coupled together by electrical leads 1812 and traces on a circuit board 1814. The light sources 1806 are received within a light holder, which can take any of the shapes and configurations described herein. In the illustrated form, two central cavities 1816 have a relatively larger diameter to receive a larger LED and the two outer cavities 1820 have a relatively smaller diameter to receive a smaller LED, as discussed above. Moreover, the smaller cavities 1820 can be configured to orient the LEDs received therein to project their light along axes that are directed more downwardly relative to the larger cavities 1816, as discussed above. The housing 1802 is sized to receive a pair of coin cell batteries therein in side-by-side, stacked configurations. Additionally, the switch device 1808 is illustrated as a slide switch having an actuator 1824 configured to be shifted laterally by a user; however, other switches as described herein can also be utilized. In a preferred form, the light module 1800 can further include a back seal member 1826 that is ultrasonically or otherwise secured to a brim member 1828 prior to attachment of the module housing 1802. The back seal member can include rolled or enlarged edges 1828 that surround the module housing 1802. As such, the back seal member 1826 prevents any moisture from traveling through the brim portion 1828 and damaging the light assembly 1804. As shown, the module housing 1802 can connect to the brim portion 1828 using screws 1830, as discussed above, or anything other suitable method described herein.

Those skilled in the art will recognize that a wide variety of modifications, alterations, and combinations can be made with respect to the above described embodiments without departing from the spirit and scope of the invention, and that such modifications, alterations, and combinations, are to be viewed as being within the scope of the invention.

The invention claimed is:

1. A light holder configured to be mounted to headgear in combination with the headgear, the combination comprising:

the light holder comprising:

a base portion having a fore-and-aft axis;

a light holding portion of a transparent or translucent material projecting away from the base portion and including an inclined portion that extends at an oblique angle of inclination with respect to the fore-and-aft axis of the base portion, the inclined portion having an outer wall and a distal end wall;

a cavity of the inclined portion configured to receive a light source therein and orient the light source to project light along an oblique projection axis with respect to the fore-and-aft axis of the base portion, the cavity being configured to orient the light source to project light through the distal end wall of the inclined portion;

the headgear comprising:

a head-fitting portion configured to be received on a wearer's head; and a brim portion extending from a forward, lower edge of the head fitting portion, the light holder being mounted to the brim portion for orienting a light source forwardly and/or downwardly therefrom for project light in a forward and/or downward direction from the brim portion;

a light assembly including:

a light source disposed within the light holder;

a power source mounted to the head-fitting portion and electrically coupled to the light source to provide power thereto; and a switch device mounted to the brim portion and electrically coupled to the power source and the light source for selectively energizing the light source;

wherein the brim portion includes a brim insert and covering material having an opening therein extending thereover, and the light holder is mounted to the brim portion so that the base portion is received between the brim insert and the covering material and the light holding portion projects through the opening of the covering material.

2. The light holder of claim 1 wherein the light holding portion further includes an opaque material disposed on portions of the outer wall thereof configured to block incident light from the light source.

3. The light holder of claim 2 wherein the opaque material is configured to define a logo that is illuminated with incident light passing through the transparent or translucent material of the light holder.

4. The light holder of claim 1 wherein the light holder has portions with different thicknesses configured such that a pattern is illuminated by incident light passing through the transparent or translucent material of the light holder.

5. The light holder of claim 1 wherein the base portion is of the transparent or translucent material.

6. The light holder of claim 1 wherein the base portion includes a rear surface and stand-off structure extending away from the rear surface configured to space the rear surface from an adjacent mounting surface.

7. The light holder of claim 6 wherein the stand-off structure comprises an outer upstanding wall extending around a perimeter of the base portion.

8. A light holder configured to be mounted to headgear, the light holder comprising:

a base portion having a fore-and-aft axis;

a light holding portion of a transparent or translucent material projecting away from the base portion and including an inclined portion that extends at an oblique angle of inclination with respect to the fore-and-aft axis of the base portion, the inclined portion having an outer wall and a distal end wall;

a cavity of the inclined portion configured to receive a light source therein and orient the light source to project light along an oblique projection axis with respect to the fore-and-aft axis of the base portion, the cavity being configured to orient the light source to project light through the distal end wall of the inclined portion;

wherein the base portion includes a rear surface and stand-off structure extending away from the rear surface configured to space the rear surface from an adjacent mounting surface wherein the stand-off structure comprises an outer upstanding wall extending around a perimeter of the base portion;

wherein the stand-off structure further comprises an inner upstanding wall extending around an interior portion of the base portion, the inner upstanding wall including a recessed or cut-out portion configured to receive electrical connections therethrough connecting the light sources to other electrical components mounted to the headgear.

9. The combination of claim 1 further comprising an applique mounted to an outer surface of the covering material around the opening thereof to at least partially overlap the base portion.

10. A lighted hat comprising:

a light holder including:

a base portion having a fore-and-aft axis;

a light holding portion of a transparent or translucent material projecting away from the base portion and including an inclined portion that extends at an oblique angle of inclination with respect to the fore-and-aft axis of the base portion, the inclined portion having an outer wall and a distal end wall;

a cavity of the inclined portion configured to receive a light source therein and orient the light source to project light along an oblique projection axis with respect to the fore-and-aft axis of the base portion, the cavity being configured to orient the light source to project light through the distal end wall of the inclined portion;

a head-fitting portion configured to be received on a wearer's head;

a brim portion extending from a forward, lower edge of the head fitting portion, the light holder being mounted to the brim portion for orienting a light source forwardly and/or downwardly therefrom for project light in a forward and/or downward direction from the brim portion;

a light assembly including:

a light source disposed within the light holder;

a power source mounted to the head-fitting portion and electrically coupled to the light source to provide power thereto; and a switch device mounted to the brim portion and electrically coupled to the power source and the light source for selectively energizing the light source;

an applique of an opaque material and having an opening therein, the applique mounted to the brim portion to overlap the base portion of the light holder such that the light holding portion thereof projects through the opening of the applique.

* * * * *